US012448847B2

(12) United States Patent
Wang et al.

(10) Patent No.: US 12,448,847 B2
(45) Date of Patent: Oct. 21, 2025

(54) COAL MINE INTELLIGENT DIRECTIONAL DRILL AND DRILLING METHOD THEREFOR

(71) Applicant: CCTEG CHONGQING RESEARCH INSTITUTE, ChongQing (CN)

(72) Inventors: Qingfeng Wang, ChongQing (CN); Dezhong Xin, ChongQing (CN); Jun Wan, ChongQing (CN); Hang Chen, ChongQing (CN); Xiaohua Liu, ChongQing (CN); Yuqing Xiao, ChongQing (CN); Daihui Ma, ChongQing (CN); Shizhai Zhang, ChongQing (CN); Lin Yang, ChongQing (CN); Zhengang Ma, ChongQing (CN); Xin Dou, ChongQing (CN); Min Tang, ChongQing (CN); Jian Pu, ChongQing (CN); Keyu Chen, ChongQing (CN); Jinjun Lv, ChongQing (CN); Yuan Wan, ChongQing (CN); Xing Wang, ChongQing (CN); Shiping Lu, ChongQing (CN); Fujia Zhou, ChongQing (CN); Changjiang Li, ChongQing (CN); Yi Qin, ChongQing (CN); Yange Yang, ChongQing (CN)

(73) Assignee: CCTEG ChongQing Research Institute Co., Ltd., Chongqing (CN)

( * ) Notice: Subject to any disclaimer, the term of this patent is extended or adjusted under 35 U.S.C. 154(b) by 0 days.

(21) Appl. No.: 18/875,732

(22) PCT Filed: Sep. 21, 2023

(86) PCT No.: PCT/CN2023/120215
§ 371 (c)(1),
(2) Date: Dec. 17, 2024

(87) PCT Pub. No.: WO2025/043787
PCT Pub. Date: Mar. 6, 2025

(65) Prior Publication Data
US 2025/0305364 A1 Oct. 2, 2025

(30) Foreign Application Priority Data
Aug. 28, 2023 (CN) ..... 202311093146.0

(51) Int. Cl.
*E21B 3/02* (2006.01)
*E21B 7/04* (2006.01)
(Continued)

(52) U.S. Cl.
CPC ..... *E21B 7/04* (2013.01); *E21B 3/02* (2013.01); *E21B 19/14* (2013.01); *E21B 44/00* (2013.01)

(58) Field of Classification Search
CPC . E21B 3/02; E21B 3/022; E21B 21/02; E21B 44/00; E21B 7/00; E21B 7/04; E21B 7/06; E21B 7/067
See application file for complete search history.

(56) References Cited

U.S. PATENT DOCUMENTS

2007/0004320 A1* 1/2007 Lindgren ..... B24B 3/33 451/217
2013/0068490 A1* 3/2013 Van Zee ..... E21B 17/18 173/40

(Continued)

*Primary Examiner* — Kipp C Wallace
(74) *Attorney, Agent, or Firm* — Wang Law Firm, Inc.

(57) ABSTRACT

The present invention relates to a coal mine intelligent directional drill and its drilling method, belonging to the technical field of coal mine drills. It comprises a moving platform, machine frame, clamper, main manipulator, power head, drill pipe storage system, control system, and hydraulic system. The power head structure is improved by adding (Continued)

an angle adjuster with accurate angle adjustment, locking, and anti-rotation functions. The angle adjuster is positioned on the gearbox side opposite the main motor, connected via a driving shaft. The control system includes a toolface azimuth detection and initialization system that works with the angle adjuster. This solves prior issues such as the absence of specialized toolface azimuth adjustment devices, low precision, low track adjustment efficiency, and challenges in achieving automatic directional drilling in the prior art. The invention enhances precision and efficiency, enabling automated, intelligent directional drilling.

19 Claims, 15 Drawing Sheets

(51) Int. Cl.
*E21B 19/14* (2006.01)
*E21B 44/00* (2006.01)

(56) References Cited

U.S. PATENT DOCUMENTS

2013/0186662 A1* 7/2013 Argent ..... E21B 3/022
173/47
2016/0069136 A1* 3/2016 Metcalf ..... E21B 15/04
175/57
2017/0321807 A1* 11/2017 Walker ..... E21B 21/02

* cited by examiner

COAL MINE INTELLIGENT DIRECTIONAL DRILL AND DRILLING METHOD THEREFOR

FIELD OF INVENTION

The present invention belongs to the technical field of coal mine drills, and relates to a coal mine intelligent directional drill and a drilling method therefor.

BACKGROUND ART OF THE INVENTION

At present, three kinds of drills are commonly used in coal mines in China, which are ordinary rotary drills, automatic (rotary) drills and directional drills. Compared with the ordinary rotary drills, the automatic drills have the functions of automatic drill pipe installation and removal, automatic drilling, remote control, automatic data recording, etc., and have significant advantages with respect to automation degree and safety. The directional drills have the significant advantages of controllable drilling track, large drilling depth and wide drilling coverage range. With the popularization and application of the automatic drills and the directional drills, higher requirements are put forward for drilling technology and equipment in coal mine fields, and a combination of high automation degree and directional drilling function is one of the most extensive and urgent requirements.

The existing automatic drills carry out construction on a principle of rotary drilling, and have the functions of automatic drilling and automatic small drill pipe installation and removal. However, because a power head does not have the function of automatic toolface azimuth adjustment, a drilling track is unpredictable and uncontrollable, and directional drilling cannot be realized, which limits further improvement of disaster control effect and overall construction efficiency to a certain extent. An automatic drill pipe installation and removal system thereof is universally suitable for drill pipes with a small diameter and a light weight, and a storage quantity is suitable for non-directional drilling (generally within 100 m).

In addition, length and quality of drill pipes used in directional drilling are significantly greater than those of drill pipes used in rotary drilling, and much more drill pipes are required for each drilling (at least 200-300 m), but the drill pipe installation and removal system of the existing automatic drills is difficult to meet the needs of conveying drill pipes with a large capacity and a large size in directional drilling. The existing directional drills generally have a low automation degree, lack a special toolface azimuth adjustment device, have low drilling track adjustment precision and efficiency, and are difficult to realize automatic directional drilling; the existing directional drills lack an automatic drill pipe installation and removal system, so the drill pipes are still installed and removed manually during drilling, which results in high labor intensity and a potential safety hazard; and the existing directional drills lack an electrohydraulic control system for conditions switching, so automatic drilling cannot be realized.

DISCLOSURE OF THE INVENTION

In view of this, the purpose of the present invention is to provide a coal mine intelligent directional drill and a drilling method therefor to solve the problems that the existing directional drills lack a special toolface azimuth adjustment device and an initial value of a toolface azimuth cannot be measured and cannot be compensated or corrected.

To achieve the above purpose, the present invention provides the following technical solution:

A coal mine intelligent directional drill, comprising a moving platform, a machine frame, a clamper, a main manipulator, a power head, a drill pipe storage system, a control system and a hydraulic system, wherein the machine frame, the drill pipe storage system, the control system, the hydraulic system and the main manipulator are installed on the moving platform, the clamper and the power head are installed on both ends of the machine frame, respectively, the power head comprises a main motor, a gearbox and a main shaft, the gearbox is provided with a driving shaft, one end of the driving shaft is connected with the main motor, the driving shaft is engaged with the main shaft through a gear in the gearbox, a drill pipe is circumferentially and fixedly connected with the main shaft, a downhole motor is arranged on the front end of the drill pipe to serve as a downhole drilling actuator, and the other end of the driving shaft is connected with an angle adjuster through the gearbox;

The angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

The rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk;

The control system comprises a toolface azimuth detection and initialization system, the toolface azimuth detection and initialization system comprises a first segment, a second segment and a third segment which are connected in sequence, a first signal combination identifier is arranged in the first segment, a first sensor and a second signal combination identifier are arranged in the second segment, a second sensor is arranged in the third segment, an angle $\varphi$ between the first sensor and the first signal combination identifier is measured by the first sensor, and an angle $\rho$ between the second sensor and the second signal combination identifier is measured by the second sensor;

The first signal combination identifier comprises a first signal source and a second signal source, and the first signal source and the second signal source are opposite and in staggered arrangement in the first segment; and the second signal combination identifier comprises a third signal source and a fourth signal source, and the third signal source and the fourth signal source are opposite and in staggered arrangement in the second segment.

Further, the angle adjuster also comprises a driving piston and an adjuster connecting seat, the driving piston is sheathed on the transmission shaft and is located on one side of the fixed toothed disk away from the moving toothed disk, and one end of the driving piston away from the driving shaft is connected with the moving toothed disk;

The adjuster connecting seat is sheathed on the driving piston, an outer circle of the adjuster connecting seat is divided by three diameters, a middle section has a largest diameter, both end surfaces of the middle section are connected with the gearbox and the rotary speed reducer, respectively, to realize relative axial positioning among the gearbox, the adjuster connecting seat and the rotary speed reducer, and an inner diameter of the adjuster connecting seat is divided by three apertures, wherein the apertures of two sections away from the gearbox are matched with an outer diameter of the driving piston, and the two sections are sheathed on the driving piston;

The driving piston is a two-stage stepped shaft, a sealing groove is formed in an outer circle of a small-diameter end of the driving piston, a sealing ring is installed in the sealing groove and is matched with a corresponding position of the adjuster connecting seat sheathed on the driving piston to form a first seal, an outer circle of a large-diameter end is matched with a sealing ring installed in a corresponding position of the adjuster connecting seat to form a second seal, a sealing cavity located between the driving piston and the adjuster connecting seat is formed between the first seal and the second seal, an oil inlet communicated with the sealing cavity is arranged on the adjuster connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

Further, the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

An outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

Further, the power head also comprises a water swivel, an active drill pipe, a hexagonal hole connecting sleeve and a connecting shaft, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

The mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

The connecting shaft is a hollow shaft and is arranged in the main shaft, both ends of the connecting shaft are connected with the mandrel of the water swivel and the active drill pipe having an axial floating structure, respectively, a hexagonal head is arranged on one end of the connecting shaft close to the mandrel, the hexagonal hole connecting sleeve is fixedly connected with one end of the main shaft close to the water swivel and is sheathed on the connecting shaft, and a hexagonal hole matched with the hexagonal head is formed in the hexagonal hole connecting sleeve to form a sliding connection between the connecting shaft and the hexagonal hole connecting sleeve to limit rotation, thus to enable the connecting shaft and the mandrel to float axially.

Further, the power head also comprises a chuck, the chuck is connected with one end of the main shaft away from the water swivel and rotates with the main shaft, the axial floating structure of the active drill pipe comprises springs and a drill pipe end cover, the active drill pipe is in key connection with the chuck, the springs are arranged on one end surface of the active drill pipe close to the chuck to enable the active drill pipe to float axially, and the drill pipe end cover is sheathed on the active drill pipe and is fixedly connected with the chuck to limit an axial floating distance of the active drill pipe.

Further, the first segment is the downhole motor, the second segment is a gauging nipple mounting pipe, and the third segment is a drill pipe.

Further, during measurement, the second sensor of the third segment is pointed to a 0° direction, an initial angle of a toolface azimuth of the first segment is $\omega=\varphi+\rho$, and an upward direction perpendicular to the horizontal plane is taken as a 0° direction of the second sensor.

Further, the first signal source and the second signal source in the first signal combination identifier are of a same type and transmit signals with same intensity; and the third signal source and the fourth signal source in the second signal combination identifier are of a same type and transmit signals with same intensity.

Further, the hydraulic system comprises a chuck pressure control system, and the chuck pressure control system comprises a pressure reducing valve, an electromagnetic directional valve, a hydraulic operated directional valve, a main pump, an auxiliary pump and a chuck;

The electromagnetic directional valve is a three-position four-way electromagnetic directional valve with a port A, a port B, a port P and a port T; and the hydraulic operated directional valve has a port P, a port T, a port A and a hydraulic operated port, and the chuck has a control port;

The main pump is connected to the port P of the hydraulic operated directional valve; an oil circuit of the auxiliary pump is divided into two branches: one branch is connected to the port P of the hydraulic operated directional valve, and the other branch is connected to the port P of the electromagnetic directional valve through the pressure reducing valve; and a drainage port of the pressure reducing valve is connected with the port T of the electromagnetic directional valve and drains oil;

Oil out of the port A of the electromagnetic directional valve is divided into two streams: one stream is connected with the port P of the hydraulic operated directional valve, and the other stream is connected with the hydraulic operated port of the hydraulic operated directional valve;

The port B of the electromagnetic directional valve is connected with the port T of the hydraulic operated directional valve; and the port A of the hydraulic operated directional valve is connected with the control port of the chuck.

Further, an oil circuit of the main pump enters the port P of the hydraulic operated directional valve via a first check valve, the oil circuit of the auxiliary pump is connected to the port P of the hydraulic operated directional valve via a second check valve, and the port A of the electromagnetic directional valve is connected to the port P of the hydraulic operated directional valve via a third check valve.

Further, the electromagnetic directional valve has a position Y1 and a position Y2.

Further, in a working condition I, the position Y1 and the position Y2 are de-energized, and pressure oil from the main pump reaches and stops at the port P of the hydraulic operated directional valve; and pressure oil from the auxiliary pump reaches and stops at the port P of the electromagnetic directional valve via the pressure reducing valve;

In a working condition II, the position Y2 is energized, and pressure oil from the main pump reaches and stops at the port P of the hydraulic operated directional valve; and one stream of pressure oil from the auxiliary pump reaches and stops at the port P of the hydraulic operated directional valve, and the other stream flows through the electromagnetic directional valve via the pressure reducing valve and reaches the control port of the chuck via the hydraulic operated directional valve;

In a working condition III, the position Y1 is energized, pressure oil from the main pump flows into the control port of the chuck via the hydraulic operated directional valve, one stream of pressure oil from the auxiliary pump reaches the control port of the hydraulic operated directional valve via the electromagnetic directional valve to switch a working state of the hydraulic operated directional valve, the other stream flows into the control port of the chuck via the hydraulic operated directional valve, and hydraulic oil from the main pump and hydraulic oil from the auxiliary pump converge.

Further, the drill pipe storage system comprises a plurality of drill pipe boxes arranged in a matrix form, and drill pipes in all of the drill pipe boxes have a same orientation; and each drill pipe box comprises a base, a side wall is arranged above the base, partition boards are arranged on the side wall, and a distance between two adjacent partition boards is matched with a diameter of the drill pipes.

Further, one side of each drill pipe box is provided with a slide rail in a same direction as the drill pipes therein, a grasping manipulator is slidably arranged on the slide rail, and the grasping manipulator is driven by a translation assembly to slide on the slide rail;

The translation assembly comprises at least two stages of traveling cylinders, a first stage of traveling cylinder is fixed on the drill pipe storage system arranged in a matrix form, a piston rod of the first stage of traveling cylinder is provided with a buckle plate, the buckle plate is driven by the first stage of traveling cylinder to slide in the slide rail, and a next stage of traveling cylinder is fixed on the buckle plate; and a last stage of traveling cylinder is fixed on the buckle plate of the former stage of traveling cylinder, a piston rod of the last stage of traveling cylinder is fixedly connected with the grasping manipulator, and both sides of the buckle plate are provided with slide blocks used for matching with the slide rail.

Further, the grasping manipulator comprises:

A first telescopic barrel, which is provided with a crossbeam assembly on one end, drives the crossbeam assembly to move along a direction close to or away from the first telescopic barrel, is slidably connected with the guide rail and is fixedly connected with the translation assembly;

A second telescopic barrel, which is arranged on one end of the crossbeam assembly away from the first telescopic barrel and moves on the crossbeam assembly along the direction close to or away from the first telescopic barrel;

A mechanical claw, which is arranged on one end of the second telescopic barrel away from the crossbeam assembly and is used for grasping the drill pipes.

Further, pipe placing troughs are fixedly arranged on the drill pipe box and are used for fixing and temporarily storing drill pipes grasped by the grasping manipulator, each pipe placing trough comprises a drill pipe trough seat fixedly arranged on one side of the drill pipe box close to the machine frame, a drill pipe trough is arranged on the drill pipe trough seat, a second clamping cylinder is arranged on the drill pipe trough seat, a piston rod of the second clamping cylinder is connected with a slide plate, a drill pipe baffle is fixedly arranged on the slide plate, and the slide plate is driven by the second clamping cylinder to make the drill pipe baffle move in a direction toward or away from the drill pipe trough; and two pipe placing troughs are provided and correspondingly arranged on both ends of the drill pipe box close to one side of the machine frame, respectively so that a space used for temporarily storing the drill pipe is formed between the drill pipe baffle and the drill pipe trough.

Further, the main manipulator is arranged on the moving platform, located between the drill pipe box and the machine frame arranged on the moving platform, and used for conveying the drill pipe temporarily stored in the pipe placing troughs to the machine frame; the machine frame comprises a machine frame connecting seat fixedly connected with the moving platform of the drill and a machine frame body hinged on the machine frame connecting seat, the main manipulator comprises a pitching cylinder, a rotary driver, a pitching arm, a rotary shaft, a rotary arm and a manipulator claw, the pitching cylinder is a double-head combined cylinder, a piston rod II on one end of the pitching cylinder is hinged with the moving platform of the drill through a first cylinder seat fixedly connected with the moving platform of the drill, a piston rod I on the other end of the pitching cylinder is hinged with the pitching arm, a vertical plane where an axis of the pitching cylinder is located is parallel to a vertical plane where an axis of the machine frame is located, and when the piston rod I is fully retracted and the piston rod II is fully extended, the manipulator is in a horizontal position;

The pitching arm comprises a connecting sleeve, a supporting body, a shaft seat and a rotary barrel, one end of the rotary barrel is fixedly connected with the connecting seat in the machine frame, the connecting sleeve is sheathed on and rotationally connected with the rotary barrel, one end of the supporting body is fixedly connected with the connecting sleeve, the other end of the supporting body is connected with the shaft seat, the pitching cylinder is hinged with the supporting body, one end of the shaft seat is connected with the rotary driver, the rotary shaft is installed in an inner cavity thereof, one end of the rotary shaft is circumferentially and fixedly connected with an output shaft of the rotary driver, the other end of the rotary shaft is connected with the rotary arm, and the rotary arm is connected with the manipulator claw;

The manipulator claw comprises a moving claw body, clamping jaws, a first clamping cylinder, a fixing seat and a moving cylinder, the fixing seat is a concave cavity, the moving cylinder is hinged in the concave cavity, a moving pair is formed by the moving claw body and a back surface of the concave cavity, the rotary arm is connected with the manipulator claw through a side surface of the concave cavity, a top part of the moving claw body is a fixed jaw and is hinged and matched with the clamping jaws to realize drill pipe clamping and fixation, and a bottom part of the moving claw body is hinged with a piston rod of the moving cylinder to drive the moving claw body to move; the moving claw body is provided with an internal cavity, the first clamping cylinder is hinged in the internal cavity, and a back surface of one clamping jaw is hinged with a piston rod of the first clamping cylinder to drive the clamping jaws to clamp the drill pipe; when the piston rod of the moving cylinder is fully retracted to make the moving claw body move to a highest point, a distance between a rotating center line of the rotary arm and a clamping center line of the moving claw body is equal to a distance between the rotating center line of the rotary arm and a drilling center line of the machine frame; and when the piston rod of the moving cylinder is fully extended to make the moving claw body move to a lowest point, the clamping center line of the moving claw body coincides with a placement center line of the drill pipe temporarily stored in the pipe placing troughs.

Further, the drill also comprises a manipulator positioning system, the manipulator positioning system comprises an isogonism sensor, an increment sensor, an angle marking plate and a pressing rod, the pressing rod is connected with one side of the fixing seat opposite to the rotary arm, the isogonism sensor comprises a proximity sensor, a pressing plate, a pressing plate seat, an elastic part, a supporting seat, a slide rod, a slide seat, a mounting frame, a slide cylinder and a slide cylinder seat, a bottom part of the mounting frame is fixedly connected with the machine frame body in the machine frame, a top part of the mounting frame is connected with and used for supporting the slide seat, the slide rod is matched and connected with the slide seat to form a moving pair, the slide cylinder is hinged with the mounting frame and the slide cylinder seat fixedly connected with the slide rod, respectively, a bottom part of the supporting seat is fixedly connected with the slide rod, one end of the supporting seat close to the manipulator claw is provided with the proximity sensor, one end of the pressing plate seat is hinged with the supporting seat, one side of the pressing plate seat close to the proximity sensor is provided with a side plate extending downward to make the side plate paired with the proximity sensor to form a signal sensing group, the elastic part is arranged between the pressing plate seat and the supporting seat, the pressing plate seat is lifted in a natural state to avoid engagement of the side plate of the pressing plate seat with the proximity sensor, the pressing plate is a bent plate, a top end of the pressing plate is used for contacting the pressing rod, and a bottom end of the pressing plate is fixedly connected with the pressing plate seat;

The angle marking plate is a circular ring with a local fan-shaped bulge, the circular ring is provided with a plate body and a bulged fan-shaped block, an inner hole of the circular ring is movably sheathed on one side of the rotary barrel facing the machine frame, the fan-shaped block has a shifting notch, one side of the machine frame body in the machine frame facing the manipulator is fixedly connected with a shifting rod, the shifting rod is inserted into the shifting notch so that when an inclination angle of the machine frame body is changed, the angle marking plate is changed by a same angle as the machine frame body, the increment sensor is arranged on one side of the connecting sleeve close to the angle marking plate and is located on one side of the connecting sleeve close to the isogonism sensor, and the increment sensor is paired with the fan-shaped block to form a signal sensing group;

When the drilling center lines of the manipulator and the machine frame are both in a horizontal position, the increment sensor is in a horizontal position, an edge line of one end of the fan-shaped block close to the increment sensor is located above a horizontal line, the increment sensor is not engaged, and the pressing plate can be pressed down due to a vertical height of the pressing rod to make the proximity sensor engaged.

A drilling method for a coal mine intelligent directional drill is characterized in that: the coal mine intelligent directional drill is provided, the control system controls driving conditions of the main motor, the rotary speed reducer and the downhole motor and an engagement state of the fixed toothed disk and the moving toothed disk so that the coal mine intelligent directional drill has four working conditions of sliding directional drilling, rotary drilling, combined drilling and drill pipe fishing, and the sliding directional drilling comprises the following steps:

dz0. Initial state: the value of the toolface azimuth is reset to zero by the toolface azimuth detection and initialization system, the chuck is controlled by the chuck pressure control system to be in a released state, the front half of the clamper clamps the existing drill pipes in a drill hole, the back half of the clamper is released, and the fixed toothed disk and the moving toothed disk are engaged through skewed teeth by sliding the moving toothed disk axially to make the angle adjuster in a locked condition; the piston rod II of the pitching cylinder is fully extended and the piston rod I is fully retracted to make the main manipulator in a horizontal position; and the piston rod of the moving cylinder is fully extended to make a drill pipe clamping center line of the manipulator claw coincide with a drill pipe placement center line of the pipe placing troughs, and the slide cylinder of the isogonism sensor is fully retracted;

dz01) First Stage of Drill Pipe Conveying dz01-1) Box selection: the grasping manipulator is driven by the translation assembly to move along a length direction of the drill pipe box to grasp drill pipes from any one of the drill pipe boxes;

dz01-2) Column selection: the mechanical claw moves along the crossbeam assembly to switch among columns of drill pipes;

dz01-3) Layer selection: a height of the mechanical claw is adjusted by the first telescopic barrel and the second telescopic barrel according to a drill pipe storage condition, thus to make the mechanical claw reach a height suitable for grasping a drill pipe selected by the system;

dz01-4) Grasping: the drill pipe selected to be grasped is clamped by the mechanical claw;

dz01-5) Lifting: the first telescopic barrel is fully extended, and the second telescopic barrel is fully retracted to make the mechanical claw in a highest position;

dz01-6) Aligning: the grasping manipulator is driven by the translation assembly to move along the slide rail to a position aligned with the middle position of a connecting line of the two pipe placing troughs;

dz01-7) Pipe conveying: the mechanical claw moves along the crossbeam assembly to a position above the pipe placing troughs, and the first telescopic barrel and the second telescopic barrel are moved in combination to adjust the height of the mechanical claw so as to place the drill pipes in the pipe placing troughs;

dz02) Second Stage of Drill Pipe Conveying dz02-1) Drill pipe clamping: the first clamping cylinder is extended, and the drill pipe in the pipe placing trough is clamped by the clamping jaws;

dz02-2) Manipulator claw extension: the piston rod of the moving cylinder is retracted to drive the moving claw body to move upward and reach the highest position;

dz02-31) Pitch up: when a drilling inclination angle of the machine frame body is a pitch up inclination angle, or the drilling inclination angle of the machine frame body is a pitch down inclination angle, the angle marking plate is driven to rotate by the shifting rod connected to the machine frame body, and the increment sensor is made not enter a coverage range of the angle marking plate, the piston rod II of the pitching cylinder is retracted, and an inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

Or dz02-32) pitch up: when a drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

dz02-41) Pitch down: when the previous step is dz02-31), the piston rod II of the pitching cylinder is extended, and the inclination angle of the main manipulator is decreased; when the piston rod II is fully extended, if the side plate in the pressing plate seat does not enter a sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

Or dz02-42) pitch down: when the previous step is dz02-32), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down;

dz02-5) Turnover: the manipulator claw is driven by the rotary driver to turn towards the machine frame body, and the drill pipe is conveyed to a position between the power head and the rear half of the clamper on the machine frame body;

dz02-6) Manipulator claw release: the drill pipe is clamped by the rear half of the clamper, the clamping jaws are released, and drill pipe conveying is completed;

dz02-7) Turnover recovery: the manipulator claw is driven by the rotary driver to turn away from the machine frame, and the slide cylinder of the isogonism sensor is retracted to make the pressing plate retracted;

dz02-8) Inclination angle zeroing: the piston rod II of the pitching cylinder is fully extended, and the piston rod I remains fully retracted to make the inclination angle of the main manipulator return to the horizontal position;

dz02-9) Manipulator claw retraction: the piston rod of the moving cylinder is fully extended to make the moving claw body and the clamping jaws return to the lowest position, and make the main manipulator restored to the initial state;

dz03) Drilling dz03-1) Angle adjuster unlocking: the fixed toothed disk is separated from the moving toothed disk by siding the moving toothed disk axially to make the angle adjuster in an unlocked condition;

dz03-2) Rear end connection: the chuck is controlled by the chuck pressure control system to be in a low-pressure clamping state, the main motor of the power head rotates forward to drive the active drill pipe to rotate, the power head is driven by the thrust cylinder in the machine frame to move forward, and the active drill pipe is connected with the rear end of the drill pipe conveyed in step dz02;

dz03-3) Front end connection: the rear half of the clamper is released, the front half of the clamper clamps the last drill pipe in the drill hole, the active drill pipe and the drill pipe with the rear end connection completed in the previous step are driven by the main motor and the thrust cylinder to continue rotating and moving forward, connection between a front end joint of the drill pipe and an ending drill pipe in the hole is completed, and then the front half of the clamper is released;

dz03-4) Angle adjuster locking: the fixed toothed disk and the moving toothed disk are engaged through skewed teeth by sliding the moving toothed disk axially to make the angle adjuster in the locked condition;

dz03-5) Toolface azimuth adjustment: on the basis of resetting the value of the toolface azimuth to zero by the toolface azimuth detection and initialization system, a specified toolface azimuth is selected, the transmission shaft is driven by the rotary speed reducer to rotate at a low speed, and rotation motion is transferred to the gearbox through the driving shaft, then transferred to the drill pipes through the main shaft of the power head, and finally transferred to the downhole motor in the hole through the drill pipes, thus to achieve accurate toolface azimuth adjustment;

dz03-6) Automatic drilling: the rotary speed reducer stops driving, and an external medium pump is used to inject a drilling medium into the downhole motor through the water swivel, thus to drive the downhole motor to make the drill bit rotate; the power head, all the drill pipes connected with the active drill pipe and the downhole motor are driven by the thrust cylinder to move forward, thus to realize sliding directional drilling;

dz03-7) Power head resetting: after the present drill pipe is fully drilled into the hole, the present drill pipe is clamped by the front half of the clamper, the rear half is kept released, the fixed toothed disk is separated from the moving toothed disk by siding the moving toothed disk axially to make the angle adjuster in the unlocked condition, the main motor rotates backward to drive the active drill pipe to rotate backward and be disconnected from the threaded joint at the rear end of the drill pipe, the power head is driven by the thrust cylinder to return to the rearmost end of the machine frame, the chuck is controlled by the chuck pressure control system to be in the released state, and drilling is continued according to steps dz01)-dz03) until set track and depth are achieved.

Further, the sliding directional drilling also comprises a drill pipe withdrawal process, specifically comprising the following steps:

tz0) Initial State

The drill has completed current drilling construction, the power head is located at a foremost end of the machine frame, the active drill pipe is connected with the ending drill pipe, the angle adjuster is in the locked condition, the chuck is controlled by the chuck pressure control system to be in the released state, the front half and the rear half of the clamper are released, the first telescopic barrel is fully extended, the second telescopic barrel is fully retracted to make the mechanical claw in the highest position, the mechanical claw is released, no drill pipe is placed in the pipe placing troughs, the piston rod II of a main pitching cylinder is fully extended, the piston rod I is fully retracted to make the main manipulator in the horizontal position, the piston rod of the moving cylinder is fully extended to make the drill pipe clamping center line of the manipulator claw coincide with the drill pipe placement center line of the pipe placing troughs, and the slide cylinder of the isogonism sensor is fully retracted;

tz01) Drill Pipe Withdrawal tz01-1) Sliding drill pipe withdrawal: the chuck is controlled by a chuck multistage pressure control system to be in the low-pressure clamping state, the power head, all the drill pipes connected with the active drill pipe and the downhole motor are driven by the thrust cylinder to withdraw until the ending drill pipe is completely out of the hole;

tz01-2) Angle adjuster unlocking: the fixed toothed disk is separated from the moving toothed disk by siding the moving toothed disk axially to make the angle adjuster in the unlocked condition;

tz01-3) Front end disconnection: the ending drill pipe is clamped by the rear half of the clamper, a drill pipe before the ending drill pipe is clamped by the front half of the clamper, the front half and the rear half rotate relative to each other, threaded connection between the two drill pipes are pre-loosened, the rear half is released, the main motor rotates backward to drive the active drill pipe to rotate backward, at the same time, the power head is driven by the thrust cylinder to withdraw, and the ending drill pipe is disconnected from the drill pipe before the ending drill pipe;

tz01-4) Rear end disconnection: the ending drill pipe is clamped by the rear half of the clamper, the active drill pipe is driven by the main motor to continue rotating backward and is driven by the thrust cylinder to withdraw, and the ending drill pipe is disconnected from the active drill pipe;

tz02) Second Stage of Pipe Conveying for Drill Pipe Withdrawal tz02-1) Manipulator claw extension: the piston rod of the moving cylinder is retracted to drive the moving claw body to move upward and reach the highest position;

tz02-21) Pitch up: when the drilling inclination angle of the machine frame body is a pitch up inclination angle, or the drilling inclination angle of the machine frame body is a pitch down inclination angle, the angle marking plate is driven to rotate by the shifting rod connected to the machine frame body, and the increment sensor is made not enter the coverage range of the angle marking plate, the piston rod II of the pitching cylinder is retracted, and the inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

Or tz02-22) pitch up: when the drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

tz02-31) Pitch down: when the previous step is tz02-21), the piston rod II of the pitching cylinder is extended, and the inclination angle of the main manipulator is decreased; when the piston rod II is fully extended, if the side plate in the pressing plate seat does not enter the sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

Or tz02-32) pitch down: when the previous step is tz02-22), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down;

tz02-4) Turnover: the manipulator claw is driven by the rotary driver to turn towards the machine frame body, and the manipulator claw not clamping drill pipes turns over to enter a space between the power head of the machine frame body and the rear half of the clamper and makes contact with the ending drill pipe;

tz02-5) Drill pipe clamping: the first clamping cylinder is extended, and the ending drill pipe is clamped by the clamping jaws; and at the same time, the rear half of the clamper is released;

tz02-6) Turnover recovery: the manipulator claw is driven by the rotary driver to turn away from the machine frame, and the slide cylinder of the isogonism sensor is retracted to make the pressing plate retracted;

tz02-7) Inclination angle zeroing: the piston rod II of the pitching cylinder is fully extended, and the piston rod I remains fully retracted to make the inclination angle of the main manipulator return to the horizontal position;

tz02-8) Manipulator claw retraction: the piston rod of the moving cylinder is fully extended to make the moving claw body and the clamping jaws return to the lowest position, and make the ending drill pipe enter the pipe placing trough;

tz02-9) Manipulator claw release: the clamping jaws are released, and the main manipulator is restored to the initial state;

tz03) First Stage of Pipe Conveying for Drill Pipe Withdrawal tz03-1) Aligning: the grasping manipulator is driven by the translation assembly to move along the slide rail to a position aligned with the middle position of a connecting line of the two pipe placing troughs;

tz03-2) Pipe taking: the mechanical claw moves along the crossbeam assembly to a position above the pipe placing troughs, the first telescopic barrel and the second telescopic barrel are moved in combination to adjust the height of the mechanical claw to make the mechanical claw come into contact with the drill pipes in the pipe placing troughs, the clamping center of the mechanical claw coincides with the center of the drill pipe, and the drill pipe is clamped by the mechanical claw;

tz03-3) Lifting: the second telescopic barrel is fully retracted, and the first telescopic barrel is fully extended to lift the mechanical claw and the drill pipe to a high position;

tz03-4) Box selection: the grasping manipulator is driven by the translation assembly to move along the slide rail to place the drill pipe back to any one of the drill pipe boxes;

tz03-5) Column selection: the mechanical claw moves along the crossbeam assembly to switch among the columns and select columns for storing drill pipes;

tz03-6) Layer selection: the height of the mechanical claw is adjusted by the first telescopic barrel and the second telescopic barrel according to a real-time drill pipe storage condition judged by the control system, thus to start drill pipe placing back from a lowest position where the drill pipe can be placed in a specified column;

tz03-7) Pipe placing: the mechanical claw is released, the first telescopic barrel is fully extended, and the second telescopic barrel is fully retracted to make the mechanical claw return to the high position;

tz04) Power head and clamper resetting: the power head is driven by the thrust cylinder to return to the front end of the machine frame, the main motor rotates forward to drive the active drill pipe to rotate forward and be connected with the present ending drill pipe, the front half of the clamper is released, the chuck is controlled by the chuck pressure control system to be in the released state, and drill pipe withdrawal is continued according to steps tz01)-tz04) until all the drill pipes are withdrawn from the hole.

Further, in the working condition of rotary drilling, the fixed toothed disk is separated from the moving toothed disk by siding the moving toothed disk axially to make the angle adjuster always in the unlocked condition, the chuck is always controlled by the chuck pressure control system to be in the low-pressure clamping state, and the drill pipes are always driven by the main motor to rotate to realize rotary drilling.

Further, in the working condition of combined drilling, the fixed toothed disk is separated from the moving toothed disk by siding the moving toothed disk axially to make the angle adjuster always in the unlocked condition, the chuck is always controlled by the chuck pressure control system to be in the low-pressure clamping state, the drill pipes are always driven by the main motor to rotate, and the external medium pump is used to inject a drilling medium into the downhole motor through the water swivel, thus to drive the downhole motor to make the drill bit rotate to realize combined drilling.

Further, in the working condition of drill pipe fishing, the active drill pipe, the connecting shaft and the water swivel need to be removed, the drill pipes are connected directly through the chuck, the fixed toothed disk is separated from the moving toothed disk by siding the moving toothed disk axially to make the angle adjuster always in the unlocked condition, the chuck is always controlled by the chuck pressure control system to be in a high-pressure clamping state when clamping the drill pipe, and the drill pipes are driven by the main motor to rotate to realize drill pipe fishing.

Further, a method for resetting the value of the toolface azimuth to zero by the toolface azimuth detection and initialization system, With a known initial angle $\omega$ of the toolface azimuth, comprising the following steps:

S1: calculating an adjustment value $\delta$ and making adjustments:

When $\omega\epsilon(0°, 90°]\cup(270°, 360°)$, an initialization zero point is 0°;

At this time, the adjustment value $\delta$ and the adjustment direction are:

When $\omega\epsilon(0°, 90°]$, $\delta=0$, making anti-clockwise adjustments;

When $\omega\epsilon(270°, 360°$, $8=360°-\omega$, making clockwise adjustments;

When $\omega\epsilon(90°, 270°]$, the initialization zero point is 180°;

At this time, the adjustment value $\delta$ and the adjustment direction are:

When $\omega\epsilon(90°, 180°]$, $\delta=180°-\omega$, making clockwise adjustments;

When $\omega E$ (180°, 270°], $\delta=\omega-180°$, making anti-clockwise adjustments.

Further, before step S1, the method further comprises step S0: simplifying the initial angle $\omega$ of the toolface azimuth, when $\omega>360°$, taking $\omega'=\omega-360°$, and when $\omega<360°$, taking $\omega'=\omega$ first; and in step S1, using $\omega'$ instead of $\omega$.

Further, after step S1, the method further comprises step S2: resetting a measured value of the toolface azimuth to zero, and when the toolface azimuth needs to be adjusted to $\gamma$, if the initialization zero point is 0°, the adjustment value is $\gamma'=\gamma$; and if the initialization zero point is 180°, the adjustment value is $\gamma'=\gamma-180°$.

Further, a control system is provided in step S2, only the toolface azimuth $\gamma$ to be adjusted is entered during operation, and the actual adjustment value $\gamma'$ is calculated by the control system according to the initialization zero point.

The present invention has the following beneficial effects:

1. In the coal mine intelligent directional drill, a mechanism of the power head is improved, the angle adjuster is arranged on one side of the gearbox away from the main motor, and the transmission shaft in the angle adjuster is circumferentially and fixedly connected with the driving shaft, so as to realize accurate and efficient adjustment of the toolface azimuth and prevent rebounding and rotation of the main shaft of the power head caused by elastic deformation of the drill pipe by the angle adjuster with functions of accurate angle adjustment, locking and anti-rotation, which solves the problems of lack of a special toolface azimuth adjustment device, low precision and low efficiency of track adjustment, and being difficult to realize automatic directional drilling in the prior art;

Meanwhile, a driving force required for toolface azimuth adjustment is greatly reduced, a good energy saving effect is achieved, the structure of the rotary brake device of the main motor is simplified, and the functions of a large number of internal parts are transferred to the external rotary speed reducer, which greatly reduces difficulty of maintenance, and reduces consumption of wearing parts;

Secondly, the water swivel is integrally connected with the active drill pipe through the connecting shaft, so manual installation and removal of the water swivel during drilling is avoided, which is more suitable for an intelligent drill; and the water inlet assembly in the water swivel is connected with the mandrel by the shell which is symmetrical about a median surface so as make the water inlet assembly uniformly stressed in an axial direction of the mandrel, so as to avoid stress imbalance of the mandrel support bearings caused when a drilling driving medium enters the mandrel; the mandrel is connected with the active drill pipe having an axial floating structure by the connecting shaft, which effectively prevents the water swivel from withstanding an axial impact from the drill pipe during drilling; the axial impact is transferred to the main shaft and the chuck through the active drill pipe and cushioned by the springs, which further prevents the mandrel support bearings from the axial impact, thereby increasing a service life thereof and reducing the number of equipment repairs.

2. When the drill pipe boxes in the drill pipe storage system are fully filled with the drill pipes, as the drill pipe boxes and the drill are in an integrated structure, the arrangement form of the drill pipe boxes arranged in a matrix form can significantly increase the capacity of the drill pipe boxes and reduce the labor intensity of workers; the translation assembly is driven by multiple stages of cylinders, which makes a moving stroke of the translation assembly larger in case that a mounting space is limited; the way of clamping the pipe placing troughs by the clamping cylinders on both sides to the middle is convenient for the control system to record grasping position information of the drill pipes, and the matrix arrangement of the drill pipes is convenient for the control system to record the number and position information of the drill pipes in the drill pipe boxes by two-dimensional coordinates; and secondly, position deviation of the drill pipes during clamping can be effectively avoided through synchronous movement of the clamping jaws on both sides, which can better ensure the accuracy of drill pipe conveying, and a connecting rod mechanism is used to realize synchronous clamping of the clamping jaws on both sides, which is simple in structure and easy to manufacture.

3. On the basis that the drill pipes in the drill pipe boxes are conveyed to the pipe placing troughs by the drill pipe storage system, the drill pipes are conveyed from the pipe placing troughs to the machine frame body by the main manipulator, and then the automatic installation and removal of the drill pipes are realized by matching with the power head and the clamper; the inclination angle of the pitching arm in the main manipulator is adjusted under the driving of the pitching cylinder parallel to the machine frame without the use of a servo motor or a rotary speed reducer in the prior art, so the mounting space is greatly saved in a direction perpendicular to the machine frame; the manipulator claw is moved upward to lift the drill pipes instead of moving downward to grasp the drill pipes in the prior art, and when the manipulator is moved counterclockwise to the machine frame after grasping the drill pipes, components such as the machine frame and an attitude adjusting mechanism can be naturally avoided, and a required motion space is significantly reduced, so the manipulator is well suitable for a narrow space, especially for the highly integrated automatic directional drills at present, and has a great application prospect; and secondly, the drill pipe conveying manipulator positioning system is simple and reliable, which requires only two position sensors, i.e., the isogonism sensor and the increment sensor, matched with each other to work within an inclination angle range designed for the drill and convey the drill pipes to the machine frame at a corresponding drilling angle; the system is simple and reliable, workload in a drill pipe conveying process and workload for maintaining the positioning system during later use are reduced, and the problems that the drill pipes are still installed and removed manually during directional drilling and the labor intensity is high are solved.

4. The toolface azimuth detection and initialization system in the control system uses two signal sources of the same type at different distances from the sensors to form directional combination signals, and two pairs of combination signals and sensors convert a relative angle value to an absolute angle value, which completes measurement of the initial value of the toolface azimuth of the downhole motor and solves the problem that the initial value of the toolface azimuth cannot be measured and cannot be compensated or corrected. The measured value of the toolface azimuth is subjected to piecewise simplified calculation, and two initialization zero points of 0° and 180° are set in the system, which shortens the adjusting time and improves the efficiency;

Secondly, the chuck pressure control system forms a low-pressure control oil circuit through the pressure reducing valve, and finally forms three working states of chuck control pressure by using left, middle and right reversing modes of the electromagnetic directional valve in combination with left and right reversing modes of the hydraulic operated directional valve, that is, a chuck release state, a chuck low-pressure clamping state and a chuck high-pressure clamping state, which can effectively ensure stable output of a chuck clamping force and reduce overflow losses. The system can better cooperate with the control system to switch drilling conditions, which not only can keep the oil circuit smooth and clean in high- and low-pressure switching and extend the service life of related hydraulic components, but also avoid long-term high-pressure operation, thus having good energy saving effect.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF THE DRAWINGS

To enable the purpose, the technical solution and the advantages of the utility model to be more clear, the utility model will be preferably described in detail below in combination with the drawings, wherein.

Figure 1:
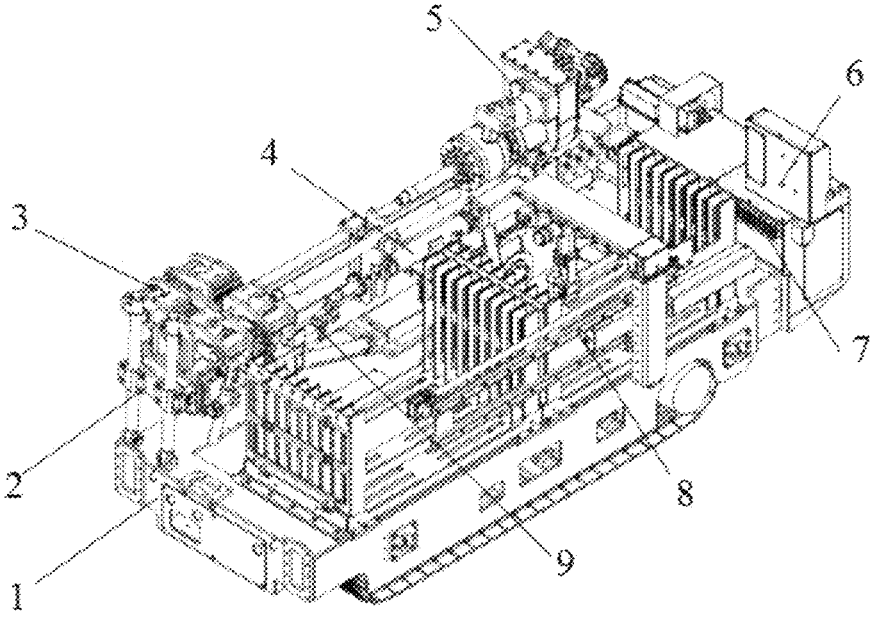
FIG. 1 is a structural schematic diagram of a coal mine intelligent directional drill of the present invention.
Figure 2:
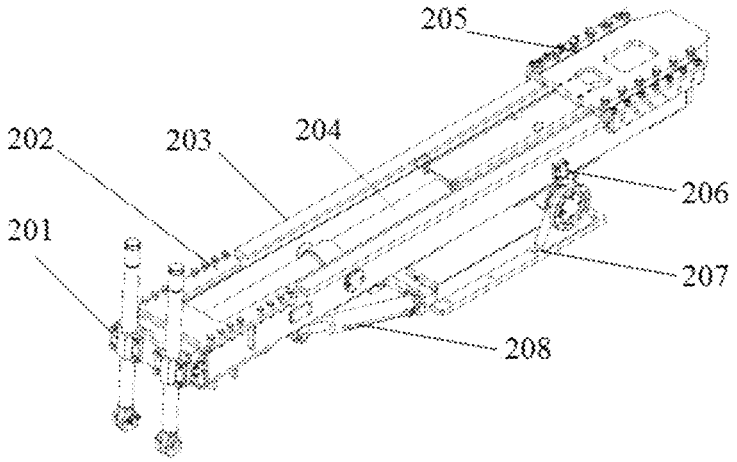
FIG. 2 is a structural schematic diagram of a machine frame in a first viewing angle.
Figure 3:
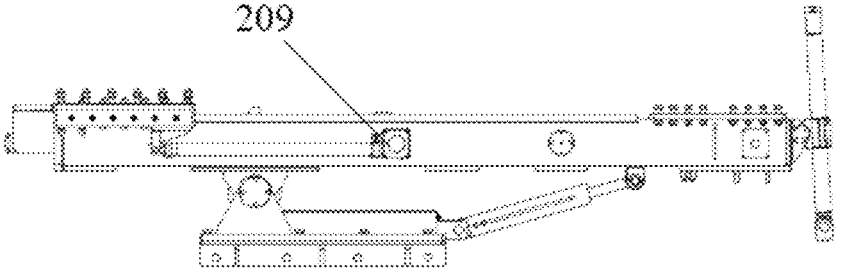
FIG. 3 is a structural schematic diagram of a machine frame in a second viewing angle.
Figure 4:
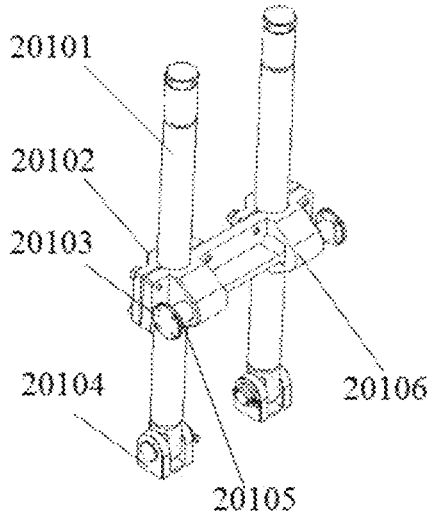
FIG. 4 is a structural schematic diagram of a support pillar assembly.
Figure 5:
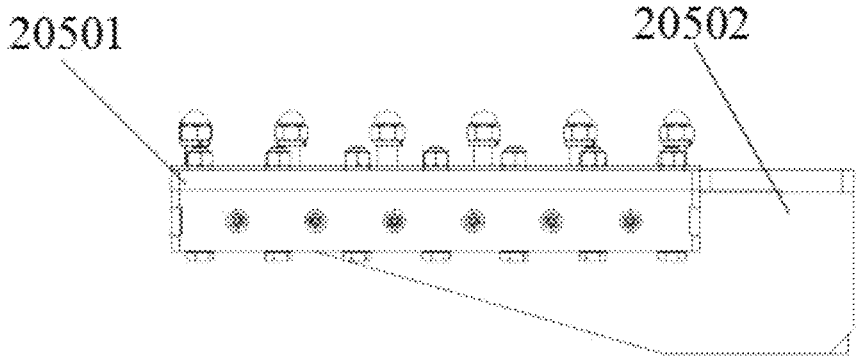
FIG. 5 is a structural schematic diagram of a power head mounting seat in a first viewing angle.
Figure 6:
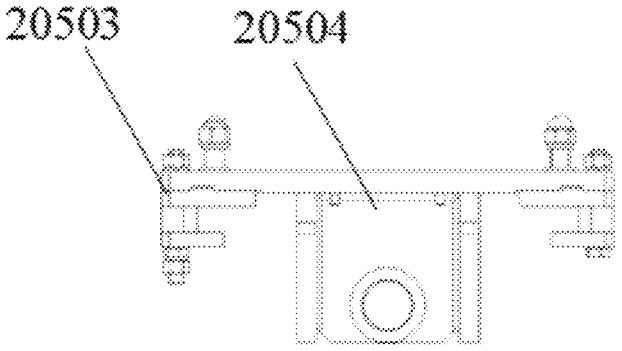
FIG. 6 is a structural schematic diagram of a power head mounting seat in a second viewing angle.
Figure 7:
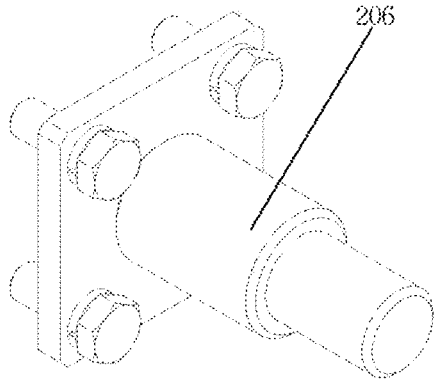
FIG. 7 is a structural schematic diagram of an angle shifting rod.
Figure 8:
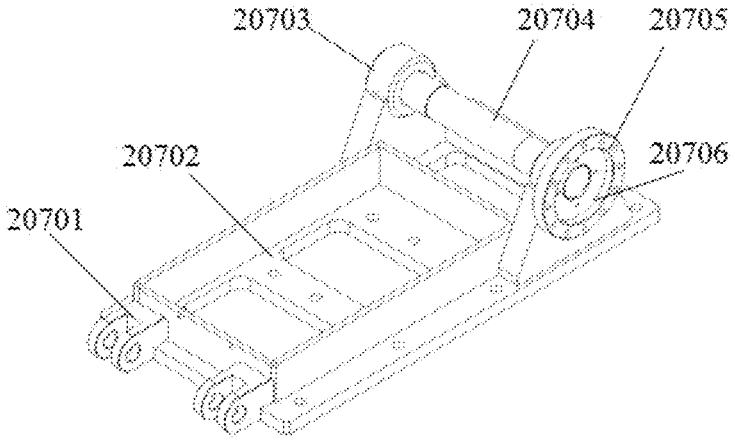
FIG. 8 is a structural schematic diagram of a machine frame connecting seat.
Figure 9:
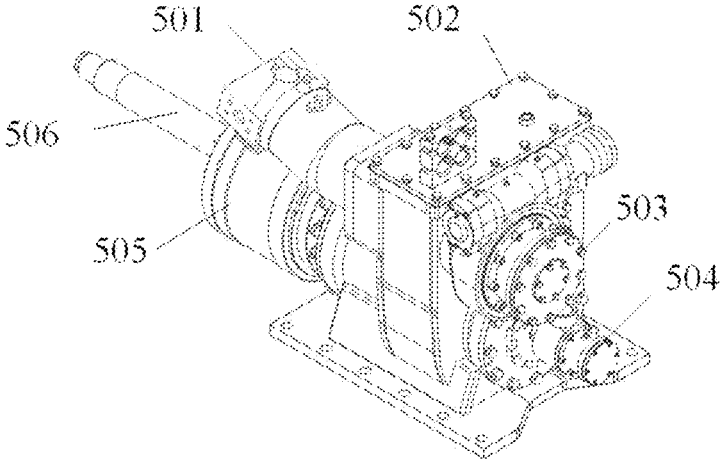
FIG. 9 is a structural schematic diagram of a power head.
Figure 10:
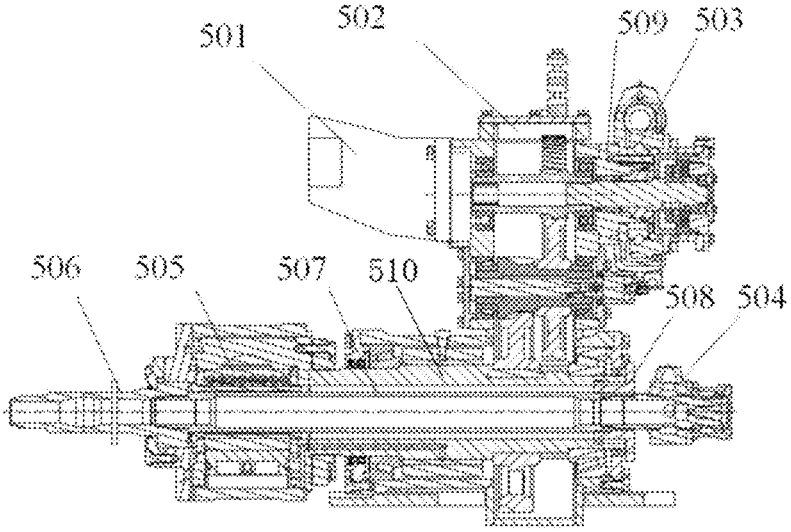
FIG. 10 is a sectional structural schematic diagram of a power head.
Figure 11:
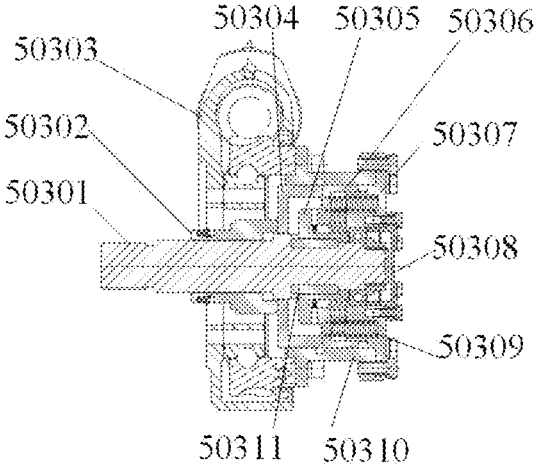
FIG. 11 is a structural schematic diagram of an angle adjuster.
Figure 12:
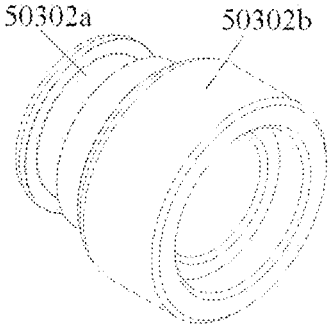
FIG. 12 is a structural schematic diagram of a driving piston.
Figure 13:
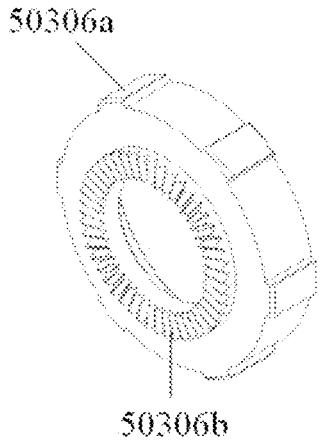
FIG. 13 is a structural schematic diagram of a moving toothed disk.
Figure 14:
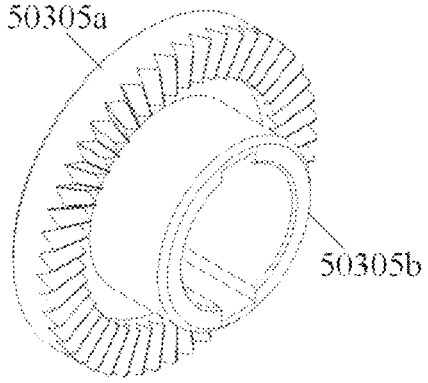
FIG. 14 is a structural schematic diagram of a fixed toothed disk.
Figure 15:
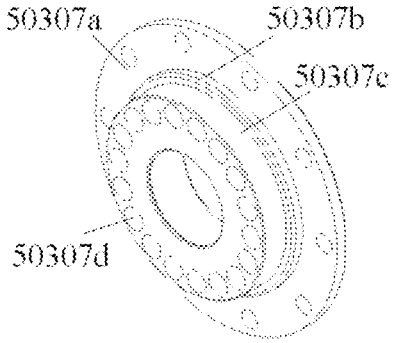
FIG. 15 is a structural schematic diagram of an angle adjuster end cover.
Figure 16:
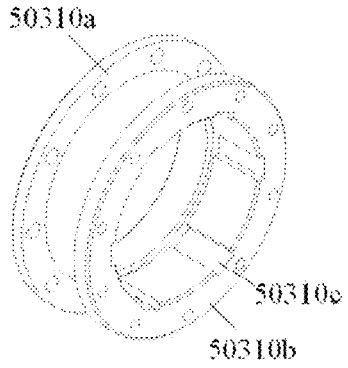
FIG. 16 is a structural schematic diagram of a rotary seat.
Figure 17:
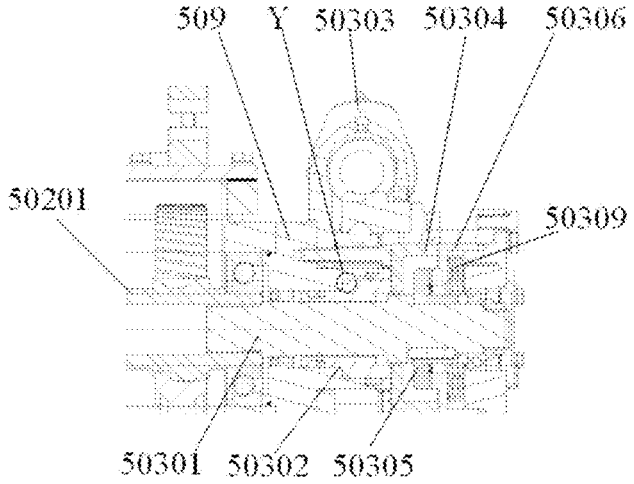
FIG. 17 is a partial structural schematic diagram of an angle adjuster.

Reference signs: 1—moving platform, 2—machine frame, 201—support pillar assembly, 20101—pillar, 20102—gland, 20103—first end cover, 20104—pillar seat, 20105—rotating shaft, 20106—rotating seat, 202—clamper mounting seat, 203—machine frame body, 204—thrust cylinder, 205-power head mounting seat, 20501—seat plate, 20502—side plate, 20503—first slide block, 20504—cylinder plate, 206—angle shifting rod, 207—machine frame connecting seat, 20701—fifth cylinder seat, 20702—bottom plate, 20703—left rotary seat, 20704—machine frame connecting seat mandrel, 20705—right rotary seat, 20706—second end cover, 208—inclination adjusting cylinder, 209—power head displacement sensor, 3—clamper, 4—main manipulator, 401—first cylinder seat, 402—pitching cylinder, 40201—piston rod I, 40202—piston rod II, 40203—cylinder barrel, 403—rotary driver, 404—pitching arm, 40401—connecting sleeve, 40402—increment sensor mounting plate, 40403—supporting body, 40404—third end cover, 40405—shaft seat, 40406—second cylinder seat, 40407—sealing cover, 40408—rotary barrel, 405—rotary shaft, 406—rotary arm, 407—manipulator claw, 40701—moving claw body, 40702—clamping jaw, 40703—first clamping cylinder, 40704—fixing seat,

40705—moving cylinder, 40706—connecting flange, 408—pressing rod, 5—power head, 501—main motor, 502—gearbox, 50201—driving shaft, 503—angle adjuster, 50301—transmission shaft, 50302—driving piston, 50302*a*—sealing groove, 50302*b*—outer circle of large-diameter end, 50303—rotary speed reducer, 50304—transmission piston, 50305—fixed toothed disk, 50305*a*—toothed disk, 50305*b*—fixed shaft, 50306—moving toothed disk, 50306*a*—lug boss, 50306*b*—first skewed tooth, 50307—angle adjuster end cover, 50307*a*—maximum outer diameter section, 50307*b*—intermediate diameter section, 50307*c*—minimum diameter section, 50307*d*—spring mounting hole, 50308—bearing gland, 50309—spring, 50310—rotary seat, 50310*a*—rotary speed reducer connecting disk, 50310*b*—end cover connecting disk, 50310*c*—groove, 50311—flat key, 504—water swivel, 50401—mandrel support bearing, 50402—mandrel, 50403—water inlet assembly, 50404—bearing seat, 50405—grease nipple, 50406—distance sleeve, 50407—water swivel end cover, 50408—cover plate, 50409—sealing shaft, 505—chuck, 510—main shaft, 506—active drill pipe, 507—connecting shaft, 50701—external thread, 50702—hexagonal head, 50703—internal thread, 508—hexagonal hole connecting sleeve, 509—adjuster connecting seat, 6—control system, 602—toolface azimuth detection and initialization system, 60201—downhole motor, 60202—first signal source, 60203—gauging nipple mounting pipe, 60204—second signal source, 60205—first sensor, 60206—third signal source, 60207—fourth signal source, 60208—second sensor, 60209—drill pipe, 7—hydraulic system, 701—chuck pressure control system, 70101—pressure reducing valve, 70102—electromagnetic directional valve, 70103—first check valve, 70104—second check valve, 70105—third check valve, 70106—hydraulic operated directional valve, 70107—oil tank, 8—drill pipe storage system, 801—drill pipe box, 80101—moving baffle, 80102—base, 80103—slide rail, 80104—side wall, 802—translation assembly, 80201—second slide block, 80202—buckle plate, 80203—second traveling cylinder, 80204—cylinder mounting seat, 80205—first traveling cylinder, 803—grasping manipulator, 80301—mechanical claw, 80301*a*—connecting body, 80301*b*—third clamping cylinder, 80301*c*—second clamping jaw, 80301*d*—first clamping jaw, 80301*e*—clamping jaw fixing pin shaft, 80301*f*—first pin shaft, 80301*h*—second pin shaft, 80301*i*—transmission rod, 80301*j*—transmission rod pin shaft, 80302—second telescopic barrel, 80303—crossbeam assembly, 80304—first telescopic barrel, 804—pipe placing trough, 80401—slide plate, 80402—second clamping cylinder, 80403—drill pipe trough seat, 80404—drill pipe trough, 80405—drill pipe baffle, 9—manipulator positioning system, 901—isogonism sensor, 90101—proximity sensor, 90102—pressing plate, 90103—pressing plate seat, 90104—spring group, 90105—supporting seat, 90106—slide rod, 90107—slide seat, 90108—mounting frame, 90109—slide cylinder, 90110—slide cylinder seat, 902—angle marking plate, 90201—plate body, 90202—shifting notch, 90203—fan-shaped block, 903—increment sensor, Y—sealing cavity.

DETAILED DESCRIPTION OF THE INVENTION

Embodiments of the utility model are described below through specific embodiments. Those skilled in the art can understand other advantages and effects of the utility model easily through the disclosure of the description. The utility model can also be implemented or applied through additional different specific embodiments. All details in the description can be modified or changed based on different perspectives and applications without departing from the spirit of the utility model. It should be noted that the figures provided in the following embodiments only exemplarily explain the basic conception of the utility model, and if there is no conflict, the following embodiments and the features in the embodiments can be mutually combined.

Wherein the drawings are only used for exemplary description, are only schematic diagrams rather than physical diagrams, and shall not be understood as a limitation to the utility model. In order to better illustrate the embodiments of the utility model, some components in the drawings may be omitted, scaled up or scaled down, and do not reflect actual product sizes. It should be understandable for those skilled in the art that some well-known structures and description thereof in the drawings may be omitted.

Same or similar reference numerals in the drawings of the embodiments of the utility model refer to same or similar components. It should be understood in the description of the utility model that terms such as "upper", "lower", "left", "right", "front" and "back" indicate direction or position relationships shown based on the drawings, and are only intended to facilitate the description of the utility model and the simplification of the description rather than to indicate or imply that the indicated device or element must have a specific direction or constructed and operated in a specific direction, and therefore, the terms describing position relationships in the drawings are only used for exemplary description and shall not be understood as a limitation to the utility model; for those ordinary skilled in the art, the meanings of the above terms may be understood according to specific conditions.

Referring to FIGS. 1-45, a coal mine intelligent directional drill is shown, comprising a moving platform 1, a machine frame 2, a clamper 3, a main manipulator 4, a power head 5, a control system 6, a hydraulic system 7, a drill pipe storage system 8 and a manipulator positioning system 9, wherein the moving platform 1 is a bearing and moving platform for components installed in the directional drill, and the machine frame 2, the drill pipe storage system 8, the control system 6, the hydraulic system 7 and the main manipulator 4 are installed on the moving platform 1. At the same time, the moving platform 1 can travel in a mine to realize the field transfer and machine relocation; the moving platform 1 can be various traveling devices, such as a tracked vehicle, a rubber-tired cart and a rail car, and a driving form thereof can be hydraulic drive, electric drive, fuel drive, etc. According to working conditions and explosion-proof requirements of an underground drilling field, a hydraulically driven tracked vehicle is preferred to be used as the moving platform 1 in the present application. The machine frame 2 and the drill pipe storage system 8 are arranged on both sides of the moving platform 1, respectively, the main manipulator 4 is arranged between the machine frame 2 and the drill pipe storage system 8, and the control system 6 and the hydraulic system 7 are arranged at a tail end of the moving platform 1.

Referring to FIGS. 2-8 in particular, the machine frame 2 is a bearing component and a drilling feed driving device of drilling and drill pipe installation and removal executing mechanisms such as the power head 5, the clamper 3 and the main manipulator 4. The machine frame 2 comprises a support pillar assembly 201, a clamper mounting seat 202, a machine frame body 203, a thrust cylinder 204, a power head mounting seat 205, an angle shifting rod 206, a machine frame connecting seat 207, an inclination adjusting cylinder 208 and a power head displacement sensor 209;

The machine frame connecting seat 207 is used for connecting the machine frame body 203 with the moving platform 1, and comprises fifth cylinder seats 20701, a bottom plate 20702, a left rotary seat 20703, a machine frame connecting seat mandrel 20704, a right rotary seat 20705 and a second end cover 20706, the bottom plate 20702 is a main body of the machine frame connecting seat 207, a front end of the bottom plate 20702 is provided with two fifth cylinder seats 20701 which are symmetrical about an axis of the machine frame connecting seat 207 and used for installing the inclination adjusting cylinder 208 by hinging, a rear end of the bottom plate 20702 is provided with the left rotary seat 20703 and the right rotary seat 20705, respectively, the machine frame connecting seat mandrel 20704 passes through and is rotationally connected with the left rotary seat 20703 and the right rotary seat 20705, and a lug base corresponding to the machine frame connecting seat mandrel 20704 is arranged below and is hinged with the machine frame body, thus to realize hinging of the machine frame connecting seat 207 with the machine frame body 203; and outer end surfaces of the left and right rotary seats are provided with end cover mounting flanges used for installing the second end cover 20706 and axially limiting the machine frame connecting seat mandrel 20704. In addition, a mounting flange used for mounting a rotary barrel 40408 of the main manipulator 4 is arranged on the right rotary seat 20705 (i.e. the rotary seat on one side of the machine frame connecting seat 207 close to the main manipulator 4).

The inclination adjusting cylinder 208 is a common hydraulic cylinder, a cylinder barrel thereof is hinged with the fifth cylinder seats 20701 by pin shafts, and a piston rod thereof is hinged with a corresponding lug base arranged below the machine frame body 203 by pin shafts. When an inclination angle of the machine frame body 203 is 0°, the piston rod of the inclination adjusting cylinder 208 is extended by a certain length only and is not completely retracted or extended, and the specific extension length can be adjusted adaptively according to directional drills of different specifications. When the piston rod of the inclination adjusting cylinder 208 is further extended, the machine frame body 203 is pitched up and the inclination angle is increased. When the piston rod of the inclination adjusting cylinder 208 is retracted, the machine frame body 203 is pitched down and the inclination angle is decreased.

The machine frame body 203 is a structural main body and a main stress part of the machine frame 2, a middle part of the machine frame body 203 is provided with a hollow cavity, other parts of the machine frame 2 and components of the drill are installed on the machine frame body 203 by arranging various mounting interfaces, flanges, etc., an outer side of the machine frame body 203 is provided with a slide rail symmetrical about an axis of the machine frame body 203, the slide rail is paired with a first slide block 20503 in the power head mounting seat 205 to form a moving pair and move the power head mounting seat 205 forward and backward along an axis direction of the machine frame body 203 under the driving of the thrust cylinder 204, and a front end and a bottom part of the machine frame body 203 are provided with lug bases hinged with rotating shafts 20105, the inclination adjusting cylinder 208, and the machine frame connecting seat mandrel 20704, respectively;

Left and right sides of a cylinder barrel of the thrust cylinder 204 are hinged with an inner side of the cavity of the machine frame body 203 by pin shafts to realize pitch swing of the thrust cylinder 204 at a certain angle, thereby lowering machining accuracy requirements of parts and components of the machine frame body 203, etc., and a piston rod of the thrust cylinder 204 is fixedly connected with the power head mounting seat 205;

The power head mounting seat 205 comprises a seat plate 20501, a side plate 20502, a first slide block 20503 and a cylinder plate 20504. The seat plate 20501 is a mounting plate of the power head 5 and is provided with a mounting hole corresponding to a bottom plate of a gearbox 502 in the power head 5, the power head 5 is fixed on the seat plate 20501 by bolts, the side plate 20502 and the cylinder plate 20504 are combined and located in the cavity of the machine frame body 203 to form a mounting bracket of the piston rod in the thrust cylinder 204, a top part of the mounting bracket is fixedly connected (preferably welded) with a bottom part of the seat plate 20501, the cylinder plate 20504 has a connecting hole used for connecting with the piston rod of the thrust cylinder 204, and the first slide block is fixedly connected with the seat plate 20501 by bolts, is located on the outer side of the machine frame body 203, and is paired with the slide rail of the machine frame body 203 to form a moving pair and make the power head mounting seat 205 slidably connected with the machine frame body 203. The power head displacement sensor 209 is installed on one side of the machine frame body 203 and is used for detecting displacement of the power head mounting seat 205.

The support pillar assembly 201 is used as a support of the front end of the machine frame body 203, in particular as a guiding and supporting member when the inclination angle of the machine frame body 203 is adjusted, the support pillar assembly 201 comprises pillars 20101, glands 20102, pillar seats 20104, the rotating shafts 20105 and rotating seats 20106, the pillars 20101 are arranged at the front end of the machine frame body 203 in left-right symmetry, bottom parts of the pillars 20101 are connected with the moving platform 1 through the pillar seats 20104, the pillar seats 20104 are fixedly connected with the moving platform 1 and hinged with the pillars 20101 by pin shafts, middle parts of the pillars 20101 close to the machine frame body 203 are pressed by the glands 20102 and installed in semi-circular grooves inside the rotating seats 20106, the rotating seats 20106 are hinged with hinging seats at the front end of the machine frame body 203 through the two rotating shafts 20105 in left-right symmetry, and outer sides of the rotating shafts 20105 are axially limited by first end covers 20103.

A bottom part of the clamper mounting seat 202 is fixedly connected (preferably welded) with an upper surface of the front end of the machine frame body 203, a clamper mounting hole is formed in an upper part of the clamper mounting seat 202, and the clamper 3 is fixed on the clamper mounting seat 202 by bolts.

The mounting plate is arranged on one side of the angle shifting rod 206 close to the machine frame body 203, the mounting plate is connected with the machine frame body 203 by bolts, a cylindrical rod is arranged on one side of the angle shifting rod 206 away from the machine frame body 203, and a front end of the cylindrical rod is inserted into a shifting notch 90202 in an angle marking plate 902. When the inclination angle of the machine frame body 203 is changed, the angle marking plate 902 is shifted by the angle shifting rod 206 through the shifting notch 90202 so that the angle of the angle marking plate 902 is always changed along with the machine frame body 203.

The clamper 3 is mainly used for clamping a drill pipe, maintaining a position of the drill pipe in a drilled hole, and matching with the power head 5 to realize threaded connection and disconnection of the drill pipe. The clamper 3 can be in various forms, such as cylinder clamp type, plier type and chuck type. Preferably, the clamper 3 of the present application is a dual clamper of cylinder clamp type, a front half is used for clamping the drill pipe in the hole, and a rear half is used for matching with the power head 5 and the main manipulator 4 to connect and disconnect the drill pipe. In addition, the front half and the rear half of the clamper 3 can be rotated by a certain angle relative to each other to pre-loosen threads of the drill pipe. The clamper 3 is connected with the machine frame body 203 by bolts in combination with the clamper mounting seat 202.

The key of the present application is that the coal mine intelligent directional drill comprises the power head 5, the drill pipe storage system 8, the main manipulator 4 and the manipulator positioning system 9.

Referring to FIGS. 9-17 in particular, the power head comprises a main motor 501, a gearbox 502, an angle adjuster 503, a water swivel 504, a chuck 505, a main shaft 510, a connecting shaft 507, a hexagonal hole connecting sleeve 508 and an active drill pipe 506, the main motor 501 is connected with the main shaft 510 through the gearbox 502, the active drill pipe is connected with one end of the main shaft 510 through the chuck 505, the water swivel 504 is arranged on one end of the gearbox 502 corresponding to the active drill pipe and is connected with the active drill pipe through the connecting shaft 507 which is arranged in the main shaft 510, the angle adjuster 503 is arranged on one end of the gearbox 502 corresponding to the main motor 501, and a transmission shaft 50301 in the angle adjuster 503 is circumferentially and fixedly connected with a driving shaft 50201 in the gearbox 502.

The main motor 501 is one of the power sources driving the active drill pipe to rotate, the rotation power required for rotary drilling, combined drilling, and drill pipe connection and disconnection is from the main motor 501, and the main motor 501 can be various rotary power driven devices, for example: one of the power driven devices such as hydraulic motor and electric motor. According to complex working conditions and explosion-proof requirements of a coal mine, the main motor 501 in the present embodiment is preferably a hydraulic motor.

The gearbox 502 is a variable speed transmission mechanism of the power head of the directional drill, which is mainly used for transferring rotation speed and torque output by the main motor 501 and the angle adjuster 503 to the main shaft 510 (i.e., to the drill pipe) in a certain transmission ratio, thus to meet the requirements of drilling as well as drill pipe connection and disconnection. According to existing hydraulic motor technology and drilling needs, the gearbox 502 is generally a gearbox 502 with decelerating, torque increasing and transferring functions. The gearbox 502 is provided with the driving shaft 50201, one end of the driving shaft 50201 is splined with an output shaft of the main motor 501 to realize circumferential and fixed connection, and the other end is splined with the transmission shaft 50301 in the angle adjuster 503 to realize circumferential and fixed connection, thereby transferring the rotation speed and torque output by the main motor 501 and the angle adjuster 503 to the main shaft 510 and the active drill pipe 506 in a certain transmission ratio, thus to meet the requirements of directional drilling as well as drill pipe connection and disconnection.

The angle adjuster 503 comprises the transmission shaft 50301, a rotary seat 50310, an adjuster connecting seat 509, a bearing gland 50308 and springs 50309; a driving piston 50302, a transmission piston 50304, a fixed toothed disk 50305, a moving toothed disk 50306 and an angle adjuster end cover 50307 which are sheathed on the transmission shaft 50301 from left to right in sequence; and a rotary speed reducer 50303 with a self-locking function. The transmission ratio of the rotary speed reducer 50303 is greater than that of the gearbox 502; a left end of the transmission shaft 50301 is provided with a spline which is inserted into the driving shaft 50201 of the gearbox 502, and the driving shaft 50201 is provided with a keyway matched with the spline on the transmission shaft 50301, thus to make the transmission shaft 50301 form a spline connection with the driving shaft 50201 and then form a circumferential and fixed connection; and a right end of the transmission shaft 50301 is connected with the fixed toothed disk 50305 sheathed on the transmission shaft 50301 through a flat key 50311 to form a circumferential and fixed connection, and is rotationally connected in the angle adjuster end cover 50307 through a bearing, the angle adjuster end cover 50307 is located on one side of the fixed toothed disk 50305 away from the driving shaft 50201, i.e., located on a right side of the fixed toothed disk 50305, distance sleeves are arranged on both sides of the bearing, and the bearing gland 50308 which is fixedly connected with the angle adjuster end cover 50307 by bolts is arranged on one side of the angle adjuster end cover 50307 away from the fixed toothed disk 50305, thus to position the bearing.

The driving piston 50302 is a hollow two-stage stepped shaft and is sheathed on the transmission shaft 50301, a sealing groove **50302*a* is formed in an outer circle of a small-diameter end, a sealing ring is installed in the sealing groove 50302*a* and is matched with an inner hole in a corresponding position of the adjuster connecting seat 509 sheathed on the driving piston 50302 to form a first seal, and an outer circle 50302*b* of a large-diameter end is matched with a sealing ring installed in a sealing ring mounting groove in a corresponding position of the adjuster connecting seat 509 to form a second seal; and a sealing cavity Y located between the driving piston 50302 and the adjuster connecting seat 509 is formed in the first seal and the second seal, an oil inlet communicated with the sealing cavity Y is arranged on the adjuster connecting seat 509, hydraulic oil enters the sealing cavity Y through the oil inlet on the adjuster connecting seat 509 to push the driving piston 50302 to move from the small-diameter end to the large-diameter end, and the small-diameter end of the driving piston 50302 is an end close to the driving shaft 50201**.

Preferably, a two-stage stepped inner hole is formed in the driving piston 50302, one side facing the angle adjuster end cover 50307 is a large-diameter inner hole, and the transmission shaft 50301 is correspondingly provided with a shaft shoulder matched with the two-stage stepped inner hole to limit a displacement distance of the driving piston 50302 in an axial direction, thus to prevent the driving piston 50302 from moving beyond limit.

The transmission piston 50304 is a disk-like part with a central through hole and is sheathed on the transmission shaft 50301, a left end of the transmission piston 50304 is in contact and connected with the large-diameter end of the driving piston 50302, a right end of the transmission piston 50304 is in contact and connected with the moving toothed disk 50306, and a main function of the transmission piston 50304 is to transfer a driving force of the driving piston 50302 (the driving force of displacement to the right end) to the moving toothed disk 50306, thus to make the moving toothed disk 50306 move towards the angle adjuster end cover 50307.

A main body of the moving toothed disk 50306 is a disk-like part with a central through hole, a stepped through hole is formed in the middle for the transmission shaft 50301 and a fixed shaft 50305*b* of the fixed toothed disk 50305 to pass through, one side of the through hole facing the angle adjuster end cover 50307 is a large-diameter through hole, an inner end surface of the large-diameter through hole is used for withstanding an end thrust force of the springs 50309, one end surface of the moving toothed disk 50306 facing one side of the transmission piston 50304 is provided with first skewed teeth 50306*b* distributed circumferentially, an outer circular surface of the moving toothed disk 50306 is provided with lug bosses 50306*a* distributed uniformly, and the lug bosses 50306*a* are matched with grooves 50310*c* in an inner hole of the rotary seat 50310 sheathed thereon, thus to transfer rotation and torque of the rotary speed reducer 50303 connected with the rotary seat 50310.

The fixed toothed disk 50305 is provided with a toothed disk 50305*a* and the fixed shaft 50305*b* located in a center of the toothed disk 50305*a*, the fixed shaft 50305*b* is a hollow shaft, an inner through hole thereof is provided with a keyway which can form a key connection between the fixed toothed disk 50305 and the transmission shaft 50301, thus to realize a circumferential and fixed connection to limit rotation between the fixed toothed disk 50305 and the transmission shaft 50301, the fixed shaft 50305*b* is inserted into the central through hole of the moving toothed disk 50306, and one end surface of the toothed disk 50305*a* facing the moving toothed disk 50306 is provided with second skewed teeth which are engaged correspondingly with the first skewed teeth 50306*b* of the moving toothed disk 50306 and distributed circumferentially. Specifically, the fixed toothed disk 50305 is fixed on the transmission shaft 50301 through the flat key 50311 to prevent relative rotation of the fixed toothed disk 50305 and the transmission shaft 50301. Both ends of the fixed toothed disk 50305 are axially stopped by the shaft shoulder of the transmission shaft 50301, the distance sleeves 50406, etc.

A main body of the angle adjuster end cover 50307 has a three-stage stepped hollow disk-like structure, which is sheathed on the transmission shaft 50301 through a bearing, a maximum outer diameter section 50307*a* is provided with a flange which is connected with the rotary seat 50310 sheathed on the moving toothed disk 50306 and a flange which is connected with the bearing gland 50308, respectively, an intermediate diameter section 50307*b* is used for matching with the rotary seat 50310 and limiting an axial movement distance of the moving toothed disk 50306, a minimum diameter section 50307*c* is used for matching with the moving toothed disk 50306, i.e., the large-diameter through hole in the moving toothed disk 50306 is matched with an outer circle of the minimum diameter section 50307*c* to form an axial sliding connection, one end surface of the minimum diameter section 50307*c* is provided with a plurality of spring mounting holes 50307*d* which are used for mounting the springs 50309 and distributed circumferentially and uniformly, the minimum diameter section 50307*c* is one end of the angle adjuster end cover 50307 close to the driving shaft 50201, and the bearing gland 50308 is fixed on an outer side of the angle adjuster end cover 50307 by bolts and used for axially limiting the bearing. The springs 50309 are installed between the angle adjuster end cover 50307 and the moving toothed disk 50306 through the spring mounting holes 50307*d* to provide a thrust force for the moving toothed disk 50306 towards the fixed toothed disk 50305.

A main body of the rotary seat 50310 is cylindrical, which is sheathed on an outer side of the moving toothed disk 50306, a left end of the rotary seat 50310 is provided with a rotary speed reducer connecting disk 50310*a* which is used for connecting an output disk of the rotary speed reducer 50303 with a self-locking function, a right end of the rotary seat 50310 is provided with an end cover connecting disk 50310*b* which is used for installing the angle adjuster end cover 50307, and the intermediate diameter section 50307*b* in the angle adjuster end cover 50307 is matched and connected with an inner cavity of the rotary seat 50310 to leave a space for mounting the moving toothed disk 50306; and the rotary seat 50310 has a through hole in an inner part and grooves 50310*c* corresponding to the lug bosses 50306*a* of the moving toothed disk 50306, a circumferential and fixed connection is formed between the rotary seat 50310 and the moving toothed disk 50306 by the lug bosses 50306*a* and the grooves 50310*c*, and the moving toothed disk 50306 can be axially displaced relative to the rotary seat 50310.

The adjuster connecting seat 509 is used for connecting the angle adjuster 503 with the gearbox 502, the gearbox 502 is sheathed on the driving shaft 50201 and is mainly used for transferring torque and rotation of the driving shaft 50201 to the main shaft 510, the adjuster connecting seat 509 is a hollow cylinder, an outer circle of the adjuster connecting seat 509 is divided by three diameters, wherein a middle section has a largest diameter to form a middle bulge, both end surfaces of the middle section are fitted and fixedly connected with the gearbox 502 and the rotary speed reducer 50303, respectively, to realize relative axial positioning among the three elements, a left section (an end close to the driving shaft 50201) is inserted into a cavity of the gearbox 502 and is connected with a bearing sheathed on the driving shaft 50201 to be used as an axial stop of the bearing sheathed on the driving shaft 50201, and a sealing groove is formed in the left section to seal the cavity of the gearbox 502 by installing a sealing ring; and a right section is extended towards an inner part of the rotary speed reducer 50303 to facilitate installation and guidance of the rotary speed reducer 50303.

An inner diameter of the adjuster connecting seat 509 is divided by three apertures, wherein an inner diameter of a left inner section is matched with the transmission shaft 50301 and has a sealing groove to conduct secondary sealing to the gearbox 502 by installing a sealing ring; and a middle inner section and a right inner section are matched with outer diameters of the two-stage stepped shaft of the driving piston 50302, respectively, the right inner section has a sealing ring mounting groove and is provided with a sealing ring, i.e., the middle inner section and the right inner section are matched with the outer circle of the small-diameter end and the outer circle 50302*b* of the large-diameter end of the driving piston 50302, respectively, to form the first seal and the second seal, thus to form the sealing cavity Y, wherein a sealing groove 50302*a* corresponding to the middle inner section and provided with the sealing ring is formed in the driving piston 50302 to form the first seal, the right inner section having the sealing ring mounting groove and provided with the sealing ring is matched with the outer circle 50302*b* of the large-diameter end to from the second seal, the sealing cavity Y located between the adjuster connecting seat 509 and the driving piston 50302 is formed by the first seal and the second seal, the oil inlet is arranged on an outer surface of the adjuster connecting seat 509 in a position corresponding to the sealing cavity Y, and hydraulic oil enters the sealing cavity Y through the oil inlet on the adjuster connecting seat 509 to push the driving piston 50302 to move towards the right end, thus to push the transmission piston 50304 and the moving toothed disk 50306, and further compress the springs 50309 by the moving toothed disk 50306, thereby disengaging the skewed teeth of the moving toothed disk 50306 and the fixed toothed disk 50305.

The rotary speed reducer 50303 is sheathed on the right section of the adjuster connecting seat 509 and is fixedly connected with the middle section of the adjuster connecting seat 509, and the output disk (such as the toothed disk or a worm gear) of the rotary speed reducer 50303 is fixedly connected with the rotary seat 50310 by bolts, thus to limit relative rotation of the output disk of the rotary speed reducer 50303 and the rotary seat 50310. The rotary speed reducer 50303 mainly has two functions: the first is to drive the driving shaft 50201 by the transmission shaft 50301 to rotate at a relatively low speed (compared with being driven by the main motor 501), and transfer the rotation by the gearbox 502 to accurately control an output rotation angle; the second is to prevent the main motor 501 from driving the driving shaft 50201 to rotate, thus to realize locking and anti-rotation of the whole gearbox 502 in a locked condition because the rotary speed reducer 50303 has a self-locking action and a self-locking torque of the rotary speed reducer 50303 is greater than an output torque of the main motor 501.

Preferably, the rotary speed reducer 50303 is a worm and gear rotary speed reducer with a self-locking function, i.e., the rotary speed reducer connecting disk 50310*a* is connected with a worm gear which is used as the output disk in the worm and gear rotary speed reducer, and the worm gear is sheathed on the transmission shaft 50301 through the adjuster connecting seat 509 and the driving piston 50302, thus to ensure synchronous rotation of the worm gear and the rotary seat 50310. A transmission ratio of an existing worm and gear rotary speed reducer can reach greater than 1:100, but the main shaft 510 driven by the main motor 501 in the prior art (the main shaft 510 is driven by the gearbox 502) has a minimum rotation speed of about 50 r/min (300°/s), and therefore, an output rotation speed of the main shaft 510 can be controlled to be within 1/100 (≤3°/s) of the prior art by the angle adjuster 503 through the worm and gear rotary speed reducer, which will be very conducive to accurate adjustment and timely stop, and greatly improve toolface azimuth adjustment accuracy and adjustment efficiency.

Specifically, the worm and gear rotary speed reducer comprises a driving source, a worm, a worm gear and a rotary support, the rotary support is sheathed on and fixedly connected with the adjuster connecting seat 509, the worm gear is rotationally connected with an outer circle of the rotary support through a raceway and is matched and connected with the worm, thus to achieve a purpose of making the output disk (i.e., the worm gear) of the rotary speed reducer coaxial with the rotary seat 50310, and the driving source is connected with one end of the worm to drive the worm to rotate. As worm and gear transmission has a characteristic of reverse self-locking and can realize reverse self-locking, i.e., the worm gear can be driven by the worm, but the worm cannot be driven by the worm gear, the worm and gear rotary speed reducer has the self-locking function. The driving source is an electric motor or a hydraulic motor, and is preferred to be a hydraulic motor in the present embodiment in order to be suitable for complex coal mine operations.

In other embodiments, the rotary speed reducer 50303 is any one of the rotary speed reducers such as an RV speed reducer and a harmonic speed reducer, and a structure used as the output disk (or called a rotary disk) in the above-mentioned rotary speed reducer is also fixedly connected with the rotary seat 50310.

The angle adjuster 503 has two working conditions, and a working principle thereof is as follows:

Locked condition: no pressure oil enters the sealing cavity Y formed between the driving piston 50302 and the adjuster connecting seat 509 from the oil inlet of the adjuster connecting seat 509, the driving piston 50302 is not driven by externally supplied pressure oil, and an axial force towards the fixed toothed disk 50305 is always exerted by the springs 50309 onto the moving toothed disk 50306 to keep the skewed teeth of the moving toothed disk 50306 engaged with the skewed teeth of the fixed toothed disk 50305; at this time, the main motor 501 and the driving shaft 50201 are connected with the rotary speed reducer 50303 through the transmission shaft 50301, the fixed toothed disk 50305, the moving toothed disk 50306 and the rotary seat 50310, and the rotary speed reducer 50303 has a self-locking function within a working capacity thereof (i.e., the self-locking torque of the rotary speed reducer 50303 is greater than the output torque of the main motor 501), thus to lock a transmission system of the gearbox 502, and the main motor 501 cannot transfer motion through the gearbox 502; however, if the rotary speed reducer 50303 is driven at this time, the driving shaft 50201 can be driven by the rotary speed reducer 50303 to rotate at a relatively low speed (compared with being driven by the main motor 501), and the rotation and torque are transferred by the gearbox 502 to accurately control a rotation angle of the main shaft 510 and the active drill pipe 506, thus to conduct accurate and efficient adjustment to the toolface azimuth.

Unlocked condition: pressure oil is injected into the sealing cavity Y between the driving piston 50302 and the adjuster connecting seat 509 through the oil inlet of the adjuster connecting seat 509, the driving piston 50302 is driven by a hydraulic force to push the transmission piston 50304 and the moving toothed disk 50306 to move in a direction away from the fixed toothed disk 50305, at this time, the springs 50309 are compressed by the moving toothed disk 50306 and retract, the skewed teeth of the moving toothed disk 50306 and the fixed toothed disk 50305 are disengaged, and the self-locking action of the rotary speed reducer 50303 cannot be transferred to the transmission shaft 50301, the driving shaft 50201 and the main motor 501. Therefore, the driving shaft 50201 can be driven by the main motor 501 to rotate, thus to output rotation and torque by the gearbox 502.

Figure 18:
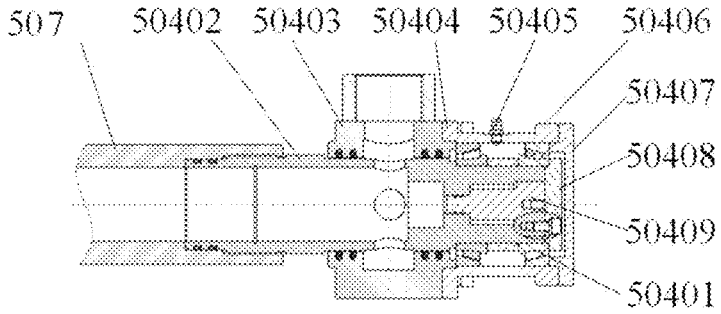
FIG. 18 is a structural schematic diagram of a water swivel.
Figure 19:
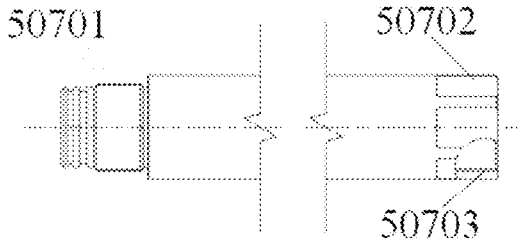
FIG. 19 is a structural schematic diagram of a connecting shaft.
Figure 20:
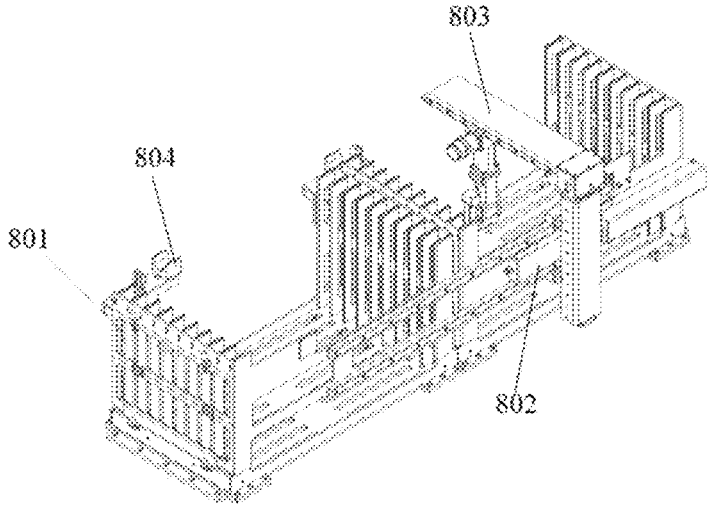
FIG. 20 is a schematic diagram of a drill pipe storage system.
Figure 21:
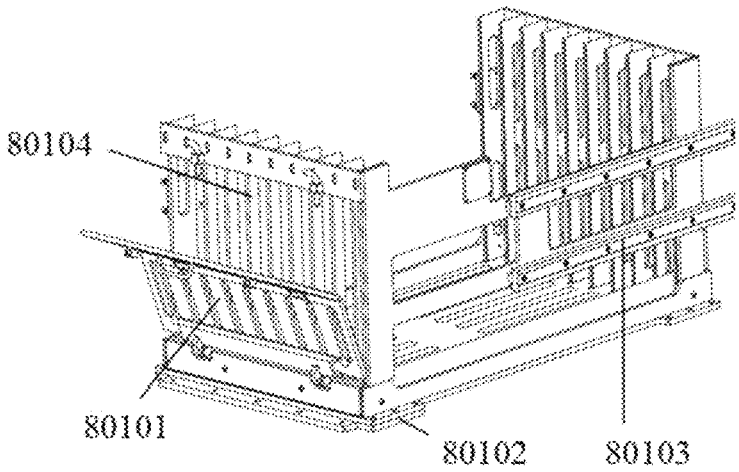
FIG. 21 is a structural schematic diagram of a drill pipe box.
Figure 22:
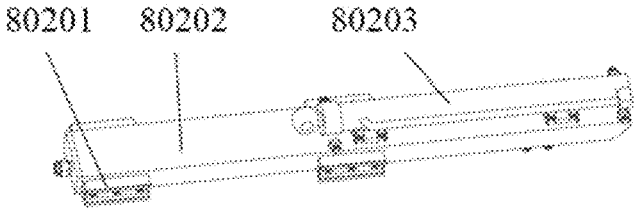
FIG. 22 is a structural schematic diagram of a translation assembly in a first viewing angle.
Figure 23:
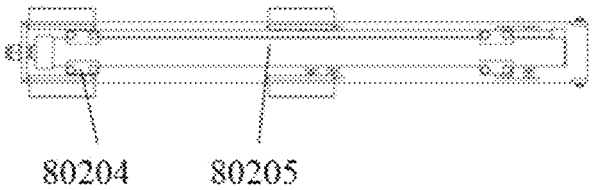
FIG. 23 is a structural schematic diagram of a translation assembly in a second viewing angle.
Figure 24:
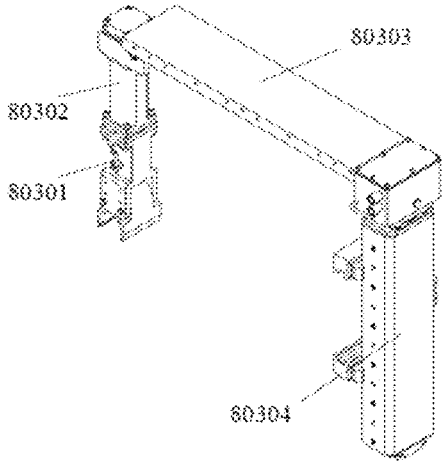
FIG. 24 is a structural schematic diagram of a grasping manipulator.
Figure 25:
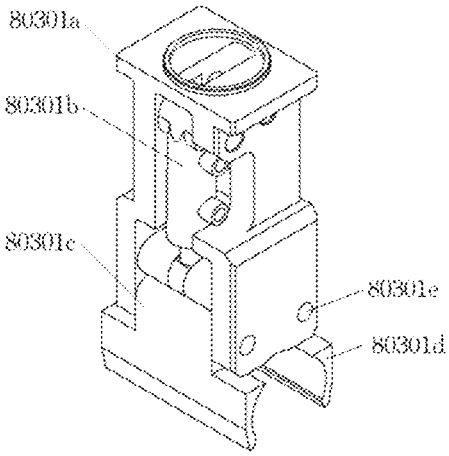
FIG. 25 is an axonometric diagram of a mechanical claw.
Figure 26:
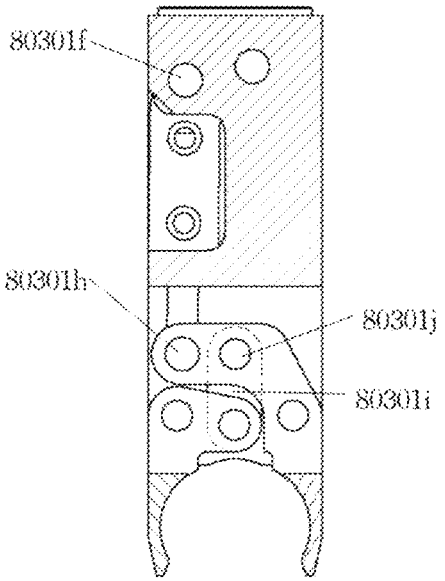
FIG. 26 is a front view of a mechanical claw.

Referring to FIGS. 18-19 in particular, the water swivel 504 is a water inlet device for drilling driving water, the driving water enters the main shaft 510 of the power head 504 through the water swivel 504 and then reaches a position of a drill bit through a plurality of connected drill pipes, a main feature of the water swivel 504 is axial force balance, the water swivel 504 comprises a mandrel 50402, a water inlet assembly 50403, a bearing seat 50404, a sealing shaft 50409 and mandrel support bearings 50401, the water inlet assembly 50403 is sheathed on and rotationally connected with the mandrel 50402, the bearing seat 50404 is sheathed on and rotationally connected with the mandrel 50402 through the mandrel support bearings 50401 which are arranged in both ends of the bearing seat 50404, and the sealing shaft 50409 is connected with a right end of the mandrel 50402 by threads to seal the right end of the mandrel 50402.

The mandrel 50402 is a hollow shaft, a left end of the mandrel 50402 is fixedly connected with the connecting shaft 507 by threads, the threads on the mandrel 50402 are external threads 50701, the threads on the connecting shaft 507 are internal threads 50703, a middle part of the mandrel 50402 has a water inlet hole, the water inlet hole is communicated with the water inlet assembly 50403, and the right end of the mandrel 50402 is internally provided with mounting threads used for mounting the sealing shaft 50409.

The water inlet assembly 50403 comprises a water inlet and a shell communicated with the water inlet. The water inlet is used for connecting a water pipe joint, the shell is sheathed on and rotationally connected with the mandrel 50402, an inner cavity of the shell is communicated with the water inlet hole of the mandrel 50402, the shell is matched with the bearing seat 50404, i.e., one side of the shell is connected with one side of the bearing seat 50404 to form a mandrel mounting structure, at the same time, the inner cavity of the shell has a symmetrical structure with a plane of symmetry perpendicular to an axis of the mandrel 50402 so as to make the shell uniformly stressed in an axial direction, and therefore, the axial force balance of the water swivel 504 can be achieved. As the inner cavity of the shell in the water inlet assembly 50403 is completely symmetrical about a median surface, an acting force of the driving water on the water inlet assembly 50403 is balanced in the axial direction of the mandrel, so as to improve a stress condition of the mandrel support bearings 50401 and extend service life.

Preferably, a sealing ring is arranged between the shell and the mandrel 50402 to form a sealing structure.

Specifically, a cover plate 50408 is installed on the right end of the mandrel 50402 by screws to axially fix the sealing shaft 50409, and a water swivel end cover 50407 is installed on a right end of the bearing seat 50404 by screws to axially fix the mandrel support bearings 50401. The bearing seat 50404 is provided with a grease nipple 50405 which is communicated with an inner cavity of the bearing seat 50404. A sealing ring is arranged at a junction between the sealing shaft 50409 and the mandrel 50402 to seal the junction and prevent water leakage.

The connecting shaft 507 is a hollow shaft and is arranged in the main shaft 510, both ends of the connecting shaft 507 are connected with the mandrel 50402 of the water swivel 504 and the active drill pipe 506, respectively, to transfer an axial impact on the water swivel 504 to the active drill pipe 506 having an axial floating structure, thus to improve a stress condition of the water swivel 504. A left end of the connecting shaft 507 is provided with external threads 50701 which are used for being connected with a threaded hole in a right end of the active drill pipe 506, and a right end of the connecting shaft 507 is provided with internal threads 50703 which are used for being connected with the external threads 50701 of the mandrel 50402. A hexagonal head 50702 is arranged on an outer side of the right end of the connecting shaft 507, the hexagonal hole connecting sleeve 508 is fixedly connected with one end of the main shaft 510 of the power head close to the water swivel 504 by threads, an inner hole of the hexagonal hole connecting sleeve 508 is a hexagonal hole matched with the hexagonal head 50702, the hexagonal head 50702 on the right end of the connecting shaft 507 is inserted into the hexagonal hole of the hexagonal hole connecting sleeve 508 to form a moving pair between the hexagonal hole connecting sleeve 508 and the connecting shaft 507 and limit rotation of the connecting shaft 507, and the moving pair formed between the hexagonal hole connecting sleeve 508 and the connecting shaft 507 is matched with the axial floating structure for displacement limitation of the active drill pipe 506 so that an entirety of the mandrel 50402, the connecting shaft 507 and the active drill pipe 506 is also provided with the axial floating structure for displacement limitation, thus to make the mandrel 50402 in the water swivel 504 and the connecting shaft 507 also have an axial floating function.

The axial floating structure of the active drill pipe 506 comprises springs and a drill pipe end cover, the active drill pipe 506 can be connected with the chuck 505 in a way of torque transfer through the spline, the flat key, etc., mounting holes are formed in a right end surface of the active drill pipe 506, and the springs are installed between the active drill pipe 506 and the chuck 505 through the mounting holes, thus to make the active drill pipe 506 have the axial floating function to cushion an axial impact, and axial limitation is achieved by the drill pipe end cover fixedly connected with the chuck 505, thus to make the active drill pipe 506 have the axial floating function for displacement limitation.

Specifically, assuming that a maximum distance between the right end surface of the active drill pipe 506 and a left end surface of the chuck 505 corresponding to the active drill pipe 506 is a, and a pitch of the threads of the active drill pipe 506 and a drill pipe joint connected with the active drill pipe 506 is p, then $a \leq p$. This is because that an axial impact of threaded connection will certainly occur within a displacement of a pitch (of course, it is very likely that the impact occurs at each pitch); if one thread (one pitch) cannot be connected, it is certain that subsequent threads cannot be connected. However, a floating distance should not be too small; if the floating distance is too small, a floating cushioning effect cannot be played due to insufficiency of the floating distance. Therefore, according to the characteristics of being basically symmetrical on both sides of the threads, a minimum value of a is slightly greater than 0.5p, preferably $a \in [0.65p, 0.95p]$, and most preferably 0.65p.

A uniformly distributed multi-section axial stop end surface is naturally formed by the hexagonal head 50702 of the connecting shaft 507 and the intermediate cylindrical section, and the stop end surface is matched with a left end surface of the hexagonal hole connecting sleeve 508 and can limit rightward axial displacement of the connecting shaft 507. Assuming that when the active drill pipe 506 and the connecting shaft 507 are located at a foremost end under a floating action, and the distance between the stop end surface and the left end surface of the hexagonal hole connecting sleeve 508 is b, it should be that $b > a$. This is because that such a distance setting can play the floating function of the active drill pipe 506, and prevent an axial rightward impact from being transferred directly from the connecting shaft 507 to the mandrel support bearings 50401. In addition, as the distance b is appropriately greater (i.e., not much greater) than the distance a between the end surfaces of the active drill pipe 506 and the chuck 505, preferably $b \geq a+0.35p$, a cushioning distance of more than one pitch can be ensured even when a minimum preferred value of 0.65p is selected for a, so that an axial cushioning structure has better cushioning and protection effects, and can limit the rightward displacement of the connecting shaft 507 and prevent serious damage to the chuck 505 or other parts of the power head in an extreme case that the floating function of the active drill pipe 506 fails or the end surfaces of the active drill pipe 506 and the chuck 505 are crushed.

The main shaft 510 is arranged in a box body of the gearbox 502 and driven by the gearbox 502 to rotate, one end of the main shaft 510 away from the water swivel 504 is connected with the chuck 505 to drive the chuck 505 to rotate, and then the torque is transferred to the active drill pipe 506 by the chuck 505. That is, the mandrel 50402, the sealing shaft 50409 and the cover plate 50408 in the water swivel 504, the active drill pipe 506, the connecting shaft 507 and the hexagonal hole connecting sleeve 508 are rotated relative to the water inlet assembly, the bearing seat 50404, the water swivel end cover 50407 and the box body of the gearbox 502.

Through the above connection relationship, the axial force balance of the water swivel 504 can be achieved during drilling, thus to solve the problem that the mandrel support bearings 50401 are easy to damage. A working principle thereof is as follows:

The drilling driving water enters the mandrel 50402 from the water inlet assembly 50403, passes through the mandrel 50402, the connecting shaft 507 and the active drill pipe 506, and then directly reaches a downhole motor and the drill bit. Firstly, as the inner cavity of the shell of the water inlet assembly 50403 is completely symmetrical about a median surface, an acting force of the driving water on the water inlet assembly 50403 is balanced in the axial direction of the mandrel, so that the stress condition of the mandrel support bearings 50401 is greatly improved, and the service life is extended;

Secondly, the mandrel 50402 of the water swivel 504 is connected with the active drill pipe 506 through the connecting shaft 507, the hexagonal head 50702 of the connecting shaft 507 is matched with the hexagonal hole of the hexagonal hole connecting sleeve 508 to form a stable moving pair and prevent relative rotation, the active drill pipe 506 has the axial floating function for displacement limitation, which can float back and forth to cushion an axial impact on the power head during drilling and limit axial floating distances of the active drill pipe 506, the connecting shaft 507 and the mandrel 50402, thus to protect other related parts and make the connecting shaft 507 and the mandrel 50402 have axial floating displacements, therefore, the water swivel 504 (the mandrel 50402) is moved axially with the active drill pipe 506 and the connecting shaft 507 during rotation with the active drill pipe 506 and drilling with the power head, an axial impact on the water swivel 504 (the mandrel 50402) is transferred to the active drill pipe 506, and the active drill pipe 506 is cushioned by the springs installed between the active drill pipe 506 and the main shaft 510 to further improve the stress condition of the mandrel support bearings 50401.

Axial displacement limitation of the drill pipe end cover on the active drill pipe 506 can be adjusted adaptively according to actual needs of other related parts and components in order to adapt to different coal mine drills.

To sum up, the solution that the impact is transferred to the active drill pipe 506 with the floating function by the connecting shaft 507 in combination with the symmetrical inner cavity of the shell in the water inlet assembly 50403 of the water swivel 504 improves the stress condition of the mandrel support bearings 50401, the axial force generated by the pressure of the drilling driving water in the water swivel 504 is evenly distributed, and the working impact of the power head is withstood by the active drill pipe 506 with the floating function; therefore, the drilling driving water pressure balancing mechanism solves the problems that the hydraulic force in the water swivel 504 of an existing drill is not balanced, no force conductive mechanism is provided and the mandrel support bearings 50401 are easy to damage, and is especially suitable for a condition when the pressure of the drilling driving water is high, such as when a mud pulse is used in directional drilling.

The chuck 505 is a drill pipe clamping mechanism of the power head of the directional drill. In general, the chuck 505 in the present embodiment does not undertake the work of clamping the drill pipes for drilling, so a normally open chuck 505 is preferred, thus to remove the active drill pipe 506 at a front end of the chuck 505 and use the chuck 505 to clamp the corresponding drill pipe for construction when it is necessary to temporarily replace a drill pipe with a larger diameter or a fishing drill pipe during downhole drilling. Specifically, a piston type hydraulic chuck 505 disclosed by a Chinese patent with the publication number of CN105822238B is preferred.

The active drill pipe 506 is a drill pipe connecting mechanism during normal drilling, a front end of the active drill pipe 506 is provided with a threaded joint similar to a male joint of the drill pipe, which is used for connecting the drill pipe inserted into the drill during drilling, the active drill pipe 506 is connected with the front end of the chuck 505 by the drill pipe end cover and bolts to limit the axial displacement of the active drill pipe 506, and the springs are arranged between the active drill pipe 506 and the chuck 505 to make the active drill pipe 506 have the axial floating function.

In another embodiment, the active drill pipe 506 is directly connected with the main shaft 510, a specific structure thereof is the same as a floating drill pipe connecting device disclosed by a Chinese patent with the publication number of CN112253017B, which also has the axial floating function to meet the requirement that one end of the connecting shaft 507 is connected with the active drill pipe 506 having an axial floating structure, the key is to transfer the active drill pipe 506 from being connected with the chuck 505 to being connected with the main shaft 510, and other details are disclosed in the above-mentioned patent and are not repeated herein.

The power head can provide various working conditions including sliding directional drilling, toolface azimuth adjustment, rotary drilling, combined drilling and drill pipe fishing for the intelligent directional drill. A working principle thereof is as follows:

(1) Sliding Directional Drilling

In the working condition of sliding directional drilling, the angle adjuster 503 is in the locked condition, and the main shaft 510 cannot be driven by the main motor 501 to rotate; and the power head is connected with a plurality of drill pipes through the active drill pipe 506, and the downhole motor is installed on a front end of the drill pipe at the foremost end. A drilling driving medium (pressure fluid) enters the power head from the water swivel 504, and enters the downhole motor through the connecting shaft, the active drill pipe and the drill pipes in sequence to drive the downhole motor to rotate and implement sliding directional drilling.

(2) Toolface Azimuth Adjustment

In the working condition of toolface azimuth adjustment, the angle adjuster 503 is in the locked condition, and the main shaft 510 cannot be driven by the main motor 501 to rotate, but can only be driven by the rotary speed reducer 50303 to rotate; at this time, the oil is not supplied to the main motor 501, but supplied to the hydraulic motor in the rotary speed reducer 50303.

The transmission shaft 50301 is driven by the rotary speed reducer 50303 to rotate, the main shaft 510 and the active drill pipe 506 are driven by the driving shaft 50201 in the gearbox 502 to rotate, and then the drill pipe connected with the active drill pipe 506 is driven by the active drill pipe 506 to rotate, thus to achieve the toolface azimuth adjustment. Due to the large transmission ratio of the rotary speed reducer 50303 and the transmission ratio of the gearbox 502, efficient and accurate toolface azimuth adjustment can be achieved by controlling the rotation speed of the rotary speed reducer 50303.

(3) Rotary Drilling

In the working condition of rotary drilling, the angle adjuster 503 is in the unlocked condition, the main shaft 510 can be driven by the main motor 501 to rotate, and the main shaft 510 and the drill pipes can be driven to rotate by supplying oil to the main motor 501 to implement rotary drilling; at this time, the driving medium is not supplied to the downhole motor through the water swivel 504.

(4) Combined Drilling

In the working condition of combined drilling, the angle adjuster 503 is in the unlocked condition, and the main shaft 510 can be driven by the main motor 501 to rotate. At this time, the driving medium is supplied to the downhole motor through the water swivel 504, thus to drive the downhole motor to rotate, and then the drill pipes are driven by the main motor 501 to rotate in order to achieve combined drilling.

(5) Drill Pipe Fishing

In case a drill pipe is lost, it is necessary to use a fishing drill pipe to take out the drill pipe from a hole. Generally, the diameter of the fishing drill pipe is larger than the diameter of an engineering drill pipe, so it is necessary to use the chuck 5 to clamp the fishing drill pipe for construction. In the working condition of drill pipe fishing, it is necessary to first remove the active drill pipe 506, the connecting shaft 507, the water swivel 504, etc., install the fishing drill pipe into the power head, clamp the fishing drill pipe by the chuck 505, and then connect a plurality of fishing drill pipes in sequence until the fishing drill pipes come into contact with the drill pipe lost in the hole. In this working condition, the angle adjuster 503 is in the unlocked condition, and the main shaft 510 can be driven by the main motor 501 to rotate.

Referring to FIGS. 20-28 in particular, the drill pipe storage system 8 comprises drill pipe boxes 801, a translation assembly 802, a grasping manipulator 803 and pipe placing troughs 804; the drill pipe storage system adopts a matrix drill pipe storage method with a number of columns in a horizontal direction and layers in a vertical direction to store drill pipes; in order to further increase the capacity of the drill pipe boxes, two drill pipe boxes are arranged in a same plane and placed on the moving platform 1 adjacently, so that all drill pipes can be stored in the drill pipe boxes and transported to an engineering site together with the drill during relocation of the directional drill.

Main functions and structural characteristics of the components are as follows:

The drill pipe storage system comprises drill pipe boxes 801 arranged in a matrix form, which are used for fixed placement and storage of the drill pipes. A top part of each drill pipe box 801 has an open structure, a side wall 80104 is uniformly provided with drill pipe holding grooves through partition boards, and a base 80102 is fixedly installed on the moving platform 1 by bolts. In order to facilitate manual replenishing, taking or placing of the drill pipes, a turnable moving baffle 80101 is arranged outside the side wall 80104, and the baffle 80101 is provided with a pin seat at a top part and an ear plate at a bottom part, which is connected with a pin seat on the base 80102 and the side wall 80104 through connecting pins. A slide rail 80103 used for translational motion of the grasping manipulator 803 is arranged outside the drill pipe box along a length direction of the drill pipes.

The translation assembly 802 is a driving device for the grasping manipulator 803 to move along the slide rail 80103 outside the drill pipe box 801. Two stages of traveling cylinders are taken as an example in the present embodiment, wherein a cylinder barrel of a first traveling cylinder 80205 is fixedly connected with the drill pipe box 801 through a cylinder mounting seat 80204, a piston rod of the first traveling cylinder 80205 is fixedly connected with an end surface cover plate of a buckle plate 80202, and the buckle plate 80202 can be pushed to move when the piston rod of the first traveling cylinder 80205 is extended; upper and lower sides of the buckle plate 80202 are provided with a second slide block 80201, and the second slide block 80201 is matched with the slide rail 80103 to form a moving pair between the buckle plate 80202 and the drill pipe box 801; and a cylinder barrel of a second traveling cylinder 80203 is fixedly installed on the buckle plate 80202, and a piston rod of the second traveling cylinder 80203 is fixedly connected with the grasping manipulator 803.

The grasping manipulator 803 is used for conveying the drill pipes from the drill pipe box 801 to specified pipe placing troughs 804. The grasping manipulator 803 is comprised of a mechanical claw 80301, a first telescopic barrel 80304, a second telescopic barrel 80302, a crossbeam assembly 80303, etc., wherein the first telescopic barrel 80304 is arranged on one side of the drill pipe box 801 along a vertical direction and is connected with the slide rail 80103, one end of the crossbeam assembly 80303 is connected with a top end of the first telescopic barrel 80304, the second telescopic barrel 80302 is connected with the other end of the crossbeam assembly 80303 and is arranged vertically downward, and the mechanical claw 80301 is connected with a bottom part of the second telescopic barrel 80302. The main functions and characteristics of the components include:

(1) First Telescopic Barrel 80304

The first telescopic barrel 80304 is externally provided with a cylinder ear seat which is used for connecting the piston rod of the second traveling cylinder 80203, and is also provided with a slide block matched with the slide rail 80103 to enable the first telescopic barrel 80304 to move along the slide rail 80103 outside the drill pipe box 801 under the action of the translation assembly 802. The first telescopic barrel 80304 is internally provided with a first telescopic cylinder which is fixedly connected with a barrel wall, and a piston rod of the first telescopic cylinder is fixedly connected with the crossbeam assembly 80303 to enable the crossbeam assembly 80303 to move up and down along the first telescopic barrel 80304. The first telescopic cylinder is fixedly connected with a lower end cover of the first telescopic barrel 80304, the piston rod of the first telescopic cylinder is fixedly connected with the crossbeam assembly 80303 by a first pin shaft, and the crossbeam assembly 80303 is driven to move up and down when the piston rod of the first telescopic cylinder works.

(2) Crossbeam Assembly 80303

A sliding track is arranged in the crossbeam assembly 80303, the sliding track is used for driving the parts of the second telescopic barrel 80302 and the mechanical claw 80301 to move along a length direction of the crossbeam assembly 80303, and the sliding track is preferably moved in a mode that a translation gear is driven by a motor to be engaged with a rack in the present application. The motor is fixedly installed on a motor mounting seat in the second telescopic barrel 80302, and the rack is fixedly connected with a bottom part of the crossbeam assembly 80303 by bolts.

(3) Second Telescopic Barrel 80302

The parts such as the mechanical claw 80301 and the second telescopic barrel 80302 can be moved along the length direction of the crossbeam assembly 80303, which are preferably moved in a mode that a translation gear is driven by a motor to be engaged with a rack in the present application. Therefore, a top end of the second telescopic barrel 80302 is provided with a motor mounting seat and a track seat which are fixedly connected with an outer part of the second telescopic barrel 80302 by welding. The track seat can be moved along a slide rail arranged in the crossbeam assembly; the second telescopic barrel 80302 is internally provided with a second telescopic cylinder which is fixedly connected with a barrel wall, and a piston rod of the second telescopic cylinder is fixedly connected with the mechanical claw 80301 to enable the mechanical claw 80301 to move up and down along the second telescopic barrel 80302; and the second telescopic cylinder is fixedly connected with an upper end cover of the second telescopic barrel 80302, the piston rod of the second telescopic cylinder is fixedly connected with the mechanical claw 80301 by a first pin shaft, and the mechanical claw 80301 is driven to move up and down when the piston rod of the second telescopic cylinder works.

(4) Mechanical Claw 80301

An upper part of the mechanical claw 80301 is provided with a connecting body 80301*a* which is fixedly connected with the second telescopic barrel 80302, a lower part is provided with a first clamping jaw 80301*d* and a second clamping jaw 80301*c*, and an inner part is provided with a third clamping cylinder 80301*b*; under a retracting action of a piston rod of the third clamping cylinder 80301*b*, clamping sections at lower parts of the clamping jaws are synchronously retracted inward from both ends to clamp the drill pipes; and when the piston rod of the third clamping cylinder 80301*b* is extended, each component is moved in a reverse direction to release the drill pipes. Specifically, a cylinder barrel of the third clamping cylinder 80301*b* is fixedly connected with the connecting body 80301*a* by a first pin shaft 80301*f*; and the piston rod of the third clamping cylinder 80301*b* is hinged with a cylinder connecting hole formed in the first clamping jaw 80301*d* by a second pin shaft 80301*h*; the second clamping jaw 80301*c* and the first clamping jaw 80301*d* have a fixing pin shaft connecting hole, respectively, and are hinged and fixedly connected with the connecting body 80301*a* by clamping jaw fixing pin shafts 80301*e*; a transmission rod 80301*i* is also arranged between the second clamping jaw 80301*c* and the first clamping jaw 80301*d*, connecting holes are formed in the first clamping jaw 80301*d* and the second clamping jaw 80301*c*, and both ends of the transmission rod are hinged with the second clamping jaw 80301*c* and the first clamping jaw 80301*d* by a transmission rod pin shaft 80301*j* in combination with the connecting holes, respectively, thus to transfer motion of the first clamping jaw 80301*d* to the second clamping jaw 80301*c*; under the retracting action of the piston rod of the third clamping cylinder 80301*b*, clamping sections at lower parts of the first clamping jaw 80301*d* and the second clamping jaw 80301*c* are synchronously retracted inward from both ends to clamp the drill pipes; when the piston rod of the third clamping cylinder 80301*b* is extended, each component is moved in a reverse direction to release the drill pipes; and lower halves of the first clamping jaw 80301*d* and the second clamping jaw 80301*c* are clamping sections with inner and outer surfaces being mainly circular arc surfaces, and inner arc surfaces of the clamping sections are matched with an outer surface of each drill pipe.

Specifically, main functions and structural characteristics of the parts in the mechanical claw 80301 are as follows:

(1) Connecting Body 80301*a*

The connecting body 80301*a* is used for fixedly installing the parts such as the cylinder and the clamping jaws, and connecting the mechanical claw with the second telescopic barrel or other related parts. The connecting body 80301*a* has a basically symmetrical open thick-wall cavity structure, a top part is an arm connecting end which can have a variety of connecting structures, the figures show a preferred pin shaft and spigot socket type connecting mode, therefore, the connecting body 80301*a* has a first pin shaft hole and a spigot used for fixing pin shaft installation, and a second pin shaft hole used for fixing the first pin shaft 80301*f*. A middle part is provided with a cylinder mounting cavity and a reinforcing bar. A lower part is a clamping jaw mounting structure which has a third pin shaft hole and a clamping jaw moving cavity used for mounting the clamping jaw fixing pin shaft 80301*e*.

(2) First Clamping Jaw 80301*d*

The first clamping jaw 80301*d* is divided into two parts; an upper half is a 7-shaped connecting section, which has a cylinder connecting hole, a transmission rod connecting hole and a fixing pin shaft connecting hole that are used for passing through the second pin shaft 80301*h*, the transmission rod pin shaft 80301*j* and the clamping jaw fixing pin shaft 80301*e*, respectively, thus to form rotating pairs with the piston rod of the cylinder, the transmission rod 80301*i* and the connecting body 80301*a*, respectively; and the connecting section has a transmission rod mounting groove running downward from a top surface for mounting the transmission rod 80301*i*. A lower half is a clamping section with inner and outer surfaces being mainly circular arc surfaces, and is used for clamping the drill pipes. An inner arc surface of the clamping section is matched with the outer surface of each drill pipe, and an outer shape is designed according to a structure of a drill pipe storage device and a drill pipe placement form.

(3) Second Clamping Jaw 80301*c*

The second clamping jaw 80301*c* is divided into two parts; an upper half is a connecting section, which has a fixing pin shaft connecting hole and a transmission rod connecting hole that are used for passing through the clamping jaw fixing pin shaft 80301*e* and the transmission rod pin shaft 80301*j*, respectively, thus to form rotating pairs with the connecting body and the transmission rod, respectively; and the connecting section has a transmission rod mounting groove running downward from a top surface for mounting the transmission rod 80301*i*. A lower half is a clamping section with inner and outer surfaces being mainly circular arc surfaces, and is used for clamping the drill pipes. An inner arc surface of the clamping section is matched with the outer surface of each drill pipe, and an outer shape is designed according to a structure of a drill pipe storage device and a drill pipe placement form.

(4) Transmission Rod 80301*i*

The transmission rod 80301*i* is a flat connecting rod as a whole, and upper and lower ends of a rod body have a connecting hole, respectively, used for installing the transmission rod pin shaft 80301*j*, thus to form two rotating pairs with the second clamping jaw 80301*c* and the first clamping jaw 80301*d*. Both ends of the rod body are in a circular arc shape to save motion space.

Figure 27:
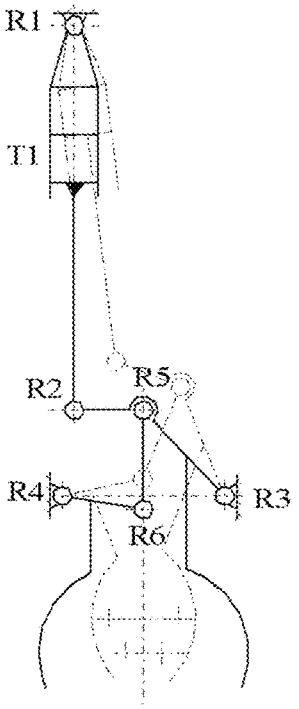
FIG. 27 is a schematic diagram of a motion principle of a mechanical claw.
Figure 28:
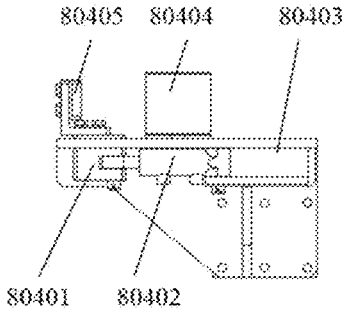
FIG. 28 is a structural schematic diagram of a pipe placing trough.

A method for arranging members of the mechanical claw in the present embodiment is as follows:

A top end of the connecting body 80301*a* is connected with upper end components such as the second telescopic barrel 80302, which is regarded as a fixed frame of the mechanical claw 80301. A rotating pair R1 is formed by the cylinder barrel of the third clamping cylinder 80301*b* and the connecting body 80301*a*, a moving pair Tl is formed by the cylinder barrel and the piston rod, a rotating pair R2 is formed by the piston rod and the first clamping jaw 80301*d*, a rotating pair R3 is formed by the first clamping jaw 80301*d* and the connecting body 80301*a*, a rotating pair R4 is formed by the second clamping jaw 80301*c* and the connecting body 80301*a*, and rotating pairs R5 and R6 are formed by the transmission rod 80301*i* with the first clamping jaw 80301*d* and the second clamping jaw 80301*c*, respectively. When the mechanical claw 80301 is switched between a releasing state and a clamping state, the motion state of each member and moving pair is shown in FIG. 27.

The mechanical claw mechanism is a 5-link mechanism with a unique degree of freedom. Therefore, the use of a driving member (the third clamping cylinder 80301*b*) allows the mechanism to have a definite motion, so as to realize clamping and releasing of the first clamping jaw 80301*d* and the second clamping jaw 80301*c*.

Arrangement characteristics and functions of the members and the moving pairs are as follows:

(1) A center point connecting line of the rotating pairs R2 and R5, and a center point connecting line of R3 and R4 are perpendicular to an axis of the third clamping cylinder 80301*b*.

(2) The transmission rod 80301*i* is parallel to the axis of the third clamping cylinder 80301*b* and is located on a perpendicular bisector of the center point connecting line of R3 and R4, and a center point of R6 is located below the center point connecting line of R3 and R4.

A motion process of the mechanical claw is as follows:

(1) It is assumed that an initial state is that the piston rod of the third clamping cylinder 80301*b* is fully extended and the clamping jaws are completely released.

(2) The piston rod of the third clamping cylinder 80301*b* is retracted, the connecting section of the first clamping jaw 80301*d* is driven by the piston rod to swing upward at a specific angle β, and the clamping section of the first clamping jaw 80301*d* swings inward at the angle β to be retracted inward. At the same time, by a feedback motion of the swing of the first clamping jaw 80301*d*, the cylinder barrel is driven by the piston rod to swing to the right at a certain angle (about 1/3 β).

(3) The swing is transferred synchronously to the second clamping jaw 80301*c* by the first clamping jaw 80301*d* through the transmission rod 80301*i* to drive the clamping section of the second clamping jaw 80301*c* to swing upward at the angle β, and the clamping section of the second clamping jaw 80301*c* swings inward at the angle β to be retracted inward synchronously with the first clamping jaw 80301*d*, thus to clamp the drill pipes.

(4) When the mechanical claw needs to be released, the third clamping cylinder 80301*b* is extended, and each rod is moved in a reverse direction.

The above technical solution can solve the problem that a unilateral grasping mechanical claw of a drill pipe grasping manipulator needs a large motion space, which is not conducive to structural arrangement of the mechanical claw, and the problem that the drill pipe is easy to deviate during a grasping process. The above technical solution can also solve the problems of complex structure, high manufacturing cost and difficult processing of an existing bilateral clamping mechanical claw.

Each pipe placing trough 804 comprises a slide plate 80401, a second clamping cylinder 80402, a drill pipe trough seat 80403, a drill pipe trough 80404 and a drill pipe baffle 80405; the drill pipe trough seat 80403 is fixedly connected with one side of the drill pipe box 801 facing the machine frame 2, is provided with the drill pipe trough 80404 on an upper part, and is internally provided with a cylinder mounting hole and a slide rail; an inner surface of an upper half of the drill pipe trough 80404 is mainly a circular arc surface, and is matched with an outer diameter of each drill pipe; a cylinder barrel of the second clamping cylinder 80402 is fixedly connected with a bottom part of the drill pipe trough seat 80403 by pin shafts, a piston rod is connected with the slide plate 80401, and the slide plate 80401 is slidably connected with the drill pipe trough seat 80404 by the slide rail arranged on the drill pipe trough seat 80404 so that the slide plate 80401 is driven by the second clamping cylinder 80402 to move along the slide rail in a length direction of the drill pipe trough seat 80404, thus to drive the drill pipe baffle 80405 fixedly connected with the slide plate 80401 to move. Two pipe placing troughs 804 are provided, which are corresponding to both ends of each drill pipe, respectively, and aligned with a drill pipe clamping position in the machine frame 2 for the convenience of placing the drill pipe; the drill pipe can be axially limited by matching the second clamping cylinder 80402 with the drill pipe baffle 80405 connected with the slide plate 80401, thus to adapt to drill pipes with different lengths to a certain extent and increase a fault tolerance rate.

A working principle of the drill pipe storage system is as follows:

Installation and fixation: the drill pipe boxes 801 are fixedly connected with the tracked vehicle through the base 80102, the moving baffle 80101 is opened, the drill pipe boxes 801 are fully filled with the drill pipes, and the moving baffle 80101 is connected with the side wall 80104 by pins.

Box selection principle: the grasping manipulator 803 is driven by the translation assembly 802 to move along the slide rail 80103 in an axial direction of the drill pipes to switch directly between two drill pipe boxes, and the drill pipes in the two drill pipe boxes can be grasped.

Column selection principle: the mechanical claw 80301 of the grasping manipulator 803 can be moved along the crossbeam assembly 80303, thus to switch between each column of drill pipes in the drill pipe boxes.

Layer selection principle: the grasping manipulator is driven by the telescopic cylinders in the telescopic barrels of the grasping manipulator to move up and down to grasp the drill pipes in different layers.

Fault tolerance mechanism of pipe placing troughs: when no drill pipe is placed in the pipe placing troughs 804, the second clamping cylinders 80402 therein shall be extended, so as to increase a placing space along a length direction of the drill pipes; and when a drill pipe is placed in the pipe placing troughs 804, the second clamping cylinders 80402 therein shall be retracted, so as to make the drill pipe aligned with the drill pipe box 801 or the machine frame 2 for the convenience of a subsequent conveying process.

Drill Pipe Conveying Process (1) from Drill Pipe Boxes to Pipe Placing Troughs

Initial state: it is assumed that the drill pipe boxes 801 are fully filled with the drill pipes (the drill pipe boxes 801 may also not be fully filled in practical applications), and the grasping manipulator 803 is in any position of the slide rail 80103; on the premise of not interfering with the drill pipes and drill pipe boxes, the first telescopic barrel 80304 and the second telescopic barrel 80302 are extended or retracted by any length, i.e., the mechanical claw 80301 is at a random height, and the mechanical claw is released;

a1) Box selection: according to the control of the control system 6, the grasping manipulator 803 is driven by the translation assembly 802 to move along the slide rail 80103 to grasp the drill pipes from any one of the drill pipe boxes. In the present application, it is preferred to start drill pipe grasping from the drill pipe box on a left side;

a2) Column selection: generally, it is set to start conveying from the column of drill pipes closest to the machine frame 2, and the mechanical claw is driven by a gear-rack mechanism formed by the second telescopic barrel 80302 and the crossbeam assembly 80303 to move along the crossbeam assembly to switch among the columns;

a3) Layer selection: a height of the mechanical claw 80301 is adjusted by the cylinders in the first telescopic barrel 80304 and the second telescopic barrel 80302 according to a real-time drill pipe storage condition judged by the control system 6, thus to make the mechanical claw 80301 suitable for grasping a drill pipe selected by the system.

a4) Grasping: the drill pipe selected to be grasped is clamped by the mechanical claw 80301;

a5) Lifting: the cylinder in the first telescopic barrel 80304 is fully extended, and the cylinder in the second telescopic barrel 80302 is fully retracted to make the mechanical claw 80301 in a highest position;

a6) Aligning: the grasping manipulator 803 is driven by the translation assembly 802 to move along the slide rail 80103 to a position aligned with the machine frame 2. In order to improve efficiency, the position in the present application is the same as a box selection position of the drill pipe box on the left side, i.e., the position of the pipe placing troughs 804.

a7) Pipe placing: the mechanical claw is driven by the gear-rack mechanism driven by the motors of the second telescopic barrel 80302 and the crossbeam assembly 80303 to move along the crossbeam assembly to a position above the pipe placing troughs 804; at the same time, the second clamping cylinders 80402 of the pipe placing troughs are extended to expand the drill pipe placing space, and the cylinder in the second telescopic barrel 80302 is extended to place the drill pipe in the pipe placing troughs; and at the same time, the second clamping cylinders 80402 of the pipe placing troughs are retracted to make the drill pipe aligned with the machine frame 2 more accurately. Then the mechanical claw 80301 is released, and the cylinder in the second telescopic barrel 80302 is fully retracted to move along the crossbeam assembly 80303 and the slide rail 80103 to a position above a next drill pipe to be grasped for preparations.

(2) from Pipe Placing Troughs to Drill Pipe Boxes

Initial state: it is assumed that a drill pipe has been placed back in the pipe placing troughs 804 by the main manipulator 4, and the pipe placing troughs 804 are clamped.

b1) Lifting: the cylinder in the first telescopic barrel 80304 is fully extended, and the cylinder in the second telescopic barrel 80302 is fully retracted to make the mechanical claw in a highest position.

b2) Aligning: the grasping manipulator is driven by the translation assembly 802 to move along the slide rail 80103 to a position aligned with the machine frame 2, the mechanical claw 80301 is moved along the crossbeam assembly 80303 to a position above the drill pipe in the pipe placing troughs, the mechanical claw is released, and at the same time, the second clamping cylinders 80402 of the pipe placing troughs are extended to expand the drill pipe placing space.

b3) Grasping: the cylinder in the second telescopic barrel 80302 is extended until the mechanical claw comes into contact with the drill pipe, the mechanical claw is clamped, the cylinder in the second telescopic barrel 80302 is fully retracted, and the cylinder in the first telescopic barrel 80304 is fully extended to make the mechanical claw and the drill pipe in a highest position.

b4) Box selection: the drill pipe is carried by the mechanical claw to move along the slide rail 80103. In the present application, it is preferred to start drill pipe placing from the drill pipe box on a right side first.

b5) Column selection: the drill pipe is carried by the mechanical claw to move along the crossbeam assembly 80303 to a vacant storage position in any column of the drill pipe boxes. In the present application, it is preferred to start drill pipe placing from the column farthest from the machine frame 2.

b6) Pipe placing: the cylinder of the first telescopic barrel 80304 is retracted to match the cylinder in the second telescopic barrel 80302 to be extended until the drill pipe comes into contact with a bottom plate of the drill pipe boxes or a drill pipe already placed, the mechanical claw is released, the drill pipe is placed back, the cylinder in the second telescopic barrel 80302 is fully retracted, and the cylinder in the first telescopic barrel 80304 is fully extended to make preparations for conveying a next drill pipe.

The following are specific drill pipe grasping process and drill pipe placing back process. Drill pipe grasping process:

The drill pipe boxes 801 are fixedly connected with the moving platform 1 through the base 80102, the moving baffle 80101 is opened, the drill pipe boxes 801 are fully filled with the drill pipes, and after the drill pipes are filled, the moving baffle 80101 is connected with the side wall 80104 by pins; the grasping manipulator 803 is driven by the translation assembly 802 to move along the slide rail 80103 of the drill pipe boxes 801 in an axial direction of the drill pipes to grasp the drill pipes in the two drill pipe boxes 801 on the left side and the right side, and the mechanical claw 80301 can be moved along the crossbeam assembly 80303 to grasp the drill pipes in each column; and the translation distance of the grasping manipulator 803 can be increased by the translation assembly 802 through the two stages of traveling cylinders.

When a drill pipe in the drill pipe box on the right side needs to be grasped by the grasping manipulator 803, the first traveling cylinder 80205 and the second traveling cylinder 80203 are fully retracted; at this time, the grasping manipulator 803 is located in the middle of the drill pipe box on the right side, and the mechanical claw 80301 is driven to move up and down to grasp the drill pipes in different layers by controlling the telescopic cylinders in the telescopic barrels of the grasping manipulator 803; the parts of the mechanical claw 80301 and the second telescopic barrel 80302 can be moved along a slide rail (a rack) of the crossbeam assembly, and a mode that a gear is driven by a motor to be engaged with the rack is adopted in the present application to grasp the drill pipes in different columns; when the mechanical claw 80301 is fully released, the clamping cylinder in the mechanical claw 80301 is fully extended; when a drill pipe needs to be clamped, the piston rod of the clamping cylinder in the mechanical claw 80301 is retracted, the first clamping jaw 80301*d* is driven by the piston rod to rotate around the fixing pin shaft, the clamping section of the first clamping jaw 80301*d* swings inward and is retracted, and the swing of the first clamping jaw 80301*d* is transferred synchronously to the second clamping jaw 80301*c* through the transmission rod to drive the clamping section of a left clamping jaw to swing inward and be retracted so that the left clamping jaw and a right clamping jaw can be retracted synchronously inward to clamp the drill pipe; after the mechanical claw 80301 is moved to place the drill pipe in the drill pipe troughs 80404 of a conveying device, the clamping cylinder in the mechanical claw 80301 is extended, and the drill pipe is released by the mechanical claw 80301; and the position of the drill pipe is adjusted from both sides to the middle by the drill pipe baffle 80405 under the action of the second clamping cylinders 80402 in the pipe placing troughs 804, and the drill pipe is clamped simultaneously until the drill pipe is grasped by other mechanisms (the main manipulator 4) to the machine frame 2, thus the drill pipe is connected.

When a drill pipe in the drill pipe box on the left side needs to be grasped by the grasping manipulator 803, the first traveling cylinder 80205 is fully extended, and a moving stroke of the piston rod is controlled by the second traveling cylinder 80203, so as to reach an optimal position for the grasping manipulator 803 to grasp the drill pipe.

Drill Pipe Placing Back Process:

When a drill pipe is placed back, the second clamping cylinders 80402 in the pipe placing troughs 804 are extended, then the drill pipe is conveyed back to the pipe placing troughs 804 by other mechanisms (the main manipulator 4), and an axial space for placing the drill pipe is increased, which increases the fault tolerance rate; before the mechanical claw 80301 is moved to the pipe placing troughs 804 to grasp the drill pipe, the second clamping cylinders 80402 in the pipe placing troughs 804 are clamped once and then released to calibrate the position of the drill pipe relative to the drill pipe boxes 801; and subsequently, the drill pipe is grasped by the mechanical claw 80301 under the action of the clamping cylinder in the mechanical claw 80301, and the mechanical claw 80301 is moved along the crossbeam assembly 80303 to select a vacant drill pipe position in the drill pipe boxes 801 by an electronically controlled program, and is accurately positioned by the traveling cylinder to place the drill pipe back in the drill pipe boxes 801.

Referring to FIGS. 29-39 in particular, the main manipulator 4 comprises a first cylinder seat 401, a pitching cylinder 402, a rotary driver 403, a pitching arm 404, a rotary shaft 405, a rotary arm 406, a manipulator claw 407 and a pressing rod 408. A bottom part of the first cylinder seat 401 is connected with the moving platform of the drill by bolts and is located between the drill pipe boxes 801 and the machine frame 2, and an upper part has a U-shaped through groove and a circular through hole and is connected with the pitching cylinder 402 by pin shafts, thus to fixedly and rotationally connect one end of the pitching cylinder 402 to the moving platform 1.

The pitching cylinder 402 is a double-head combined cylinder, which comprises a cylinder barrel 40203 as well as a piston rod I 40201 and a piston rod II 40202 located at both ends of the cylinder barrel, a vertical plane where an axis of the pitching cylinder 402 is located is parallel to a vertical plane where an axis of the machine frame 2 is located, the piston rod II 40202 on one end of the pitching cylinder 402 is hinged with the first cylinder seat 401 by pin shafts, and the piston rod I 40201 on the other end of the pitching cylinder 402 is hinged with the pitching arm 404 by pin shafts.

The pitching arm 404 is a main supporting member of the main manipulator 4, which carries other parts of the main manipulator 4 and is connected with the machine frame 2; the pitching arm 404 comprises a connecting sleeve 40401, an increment sensor mounting plate 40402, a supporting body 40403, a third end cover 40404, a shaft seat 40405, a second cylinder seat 40406, a sealing cover 40407 and a rotary barrel 40408; a main body of the rotary barrel 40408 is a multistage stepped cylinder with flanges on both ends, the flanges are used for installing the sealing cover 40407 and connecting the machine frame connecting seat 207 in the machine frame 2, respectively; one side of the rotary barrel 40408 close to the machine frame 2 is provided with an angle marking plate mounting section, an outer diameter of the angle marking plate mounting section is matched with an inner diameter of the angle marking plate 902, and the angle marking plate 902 is movably sheathed on the angle marking plate mounting section and is rotated along with the machine frame 2.

The connecting sleeve 40401 has a cylindrical structure, which is sheathed on the rotary barrel 40408 and rotationally connected with the rotary barrel 40408; one side of the connecting sleeve 40401 close to the angle marking plate 902 is provided with the increment sensor mounting plate 40402 used for mounting an increment sensor 903, the increment sensor mounting plate 40402 is located on a center horizontal line of the connecting sleeve 40401 so that an angle of the increment sensor 903 is 0° in an initial position of the main manipulator 4, and the sealing cover 40407 is fixedly connected with the rotary barrel 40408 through the flanges of the rotary barrel 40408, which can effectively prevent water, cinder, etc. from entering the connecting sleeve 40401.

One end of the supporting body 40403 is fixedly connected with the connecting sleeve 40401, the other end of the supporting body 40403 is connected with the shaft seat 40405, and a middle part of one side of the supporting body 40403 close to the first cylinder seat 401 is provided with the second cylinder seat 40406 to connect the pitching cylinder 402.

A right side of the shaft seat 40405 is provided with a mounting flange of the rotary driver 403, and a left side of the shaft seat 40405 is provided with a mounting flange of the third end cover 40404 to connect the rotary driver 403 and the third end cover 40404, respectively; an inner cavity of the shaft seat 40405 has a mounting hole used for mounting the rotary shaft 405; after the third end cover 40404 is fixedly installed on the shaft seat 40405, the rotary shaft 405 can be axially limited; one end of the rotary shaft 405 is circumferentially and fixedly connected with an output shaft of the rotary driver 403, the other end of the rotary shaft 405 is connected with the rotary arm 406, and the rotary arm 406 is connected with the manipulator claw 407.

When the piston rod I 40201 is fully retracted, the piston rod II 40202 is fully extended, and the main manipulator 4 (the rotary arm 406) is in a horizontal position, i.e., an inclination angle of an upper plane of the main manipulator 4 is 0°, that is, in the initial position of the main manipulator 4, an angle of the increment sensor 903 is also 0°; the piston rod II 40202 is retracted, the main manipulator 4 is pitched up, and the inclination angle is increased; and when the main manipulator 4 is in the horizontal position, the piston rod II 40202 is fully extended, the piston rod I 40201 is further extended, and the main manipulator 4 is pitched down to form a negative inclination angle.

The rotary driver 403 is used for providing rotary power for the main manipulator 4, motion is transferred to the manipulator claw 407 through the rotary shaft 405 and the rotary arm 406 to enable the manipulator claw 407 to turn to or move away from the power head 5, and the rotary driver 403 can be any mechanism that can achieve rotary motion, which is preferably a hydraulic motor or a swing cylinder in the present application.

A basic structure of the rotary shaft 405 is in a cylindrical shaft class, a left end thereof is provided with a flange matched and connected with the rotary arm 406, and a right end thereof is provided with a connecting structure matched with the rotary driver 403, such as the spline and the flat key, so as to form a circumferential and fixed connection. The rotary arm 406 is a long rod-shaped part used for connecting the rotary shaft 405 and the manipulator claw 407, and is preferred to be in a hollow circular tube shape for the convenience of processing and weight control.

Figure 29:
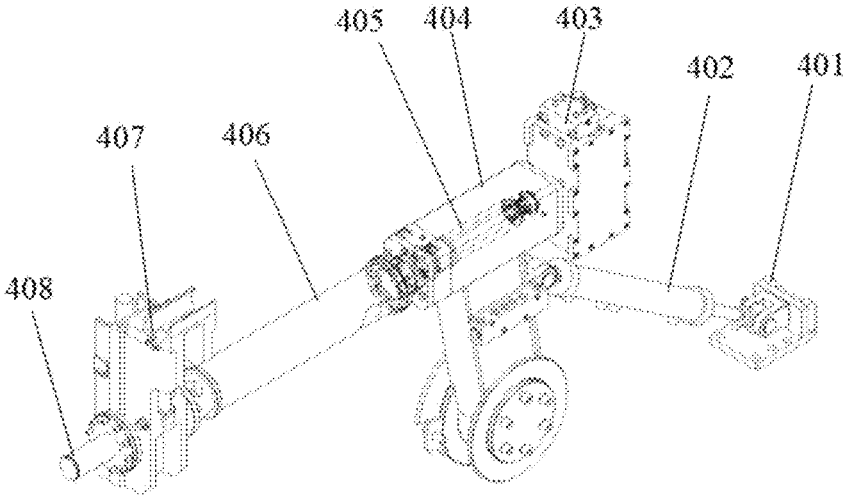
FIG. 29 is a structural schematic diagram of a main manipulator.
Figure 30:
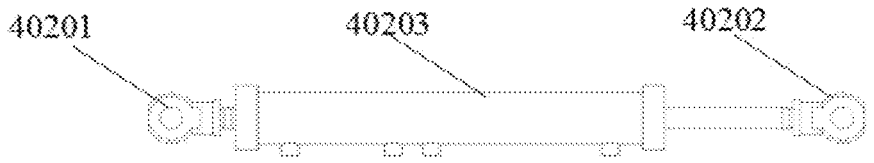
FIG. 30 is a structural schematic diagram of a pitching cylinder.
Figure 31:
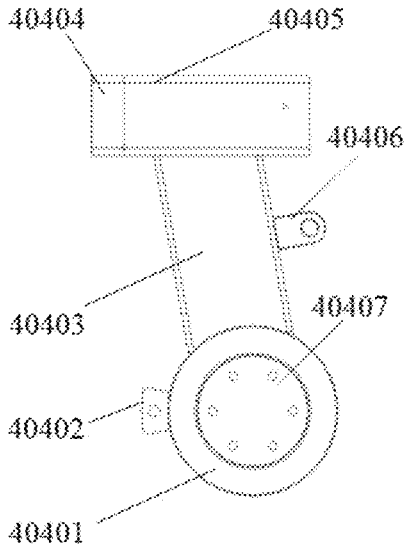
FIG. 31 is a structural schematic diagram of a pitching arm in a first viewing angle.
Figure 32:
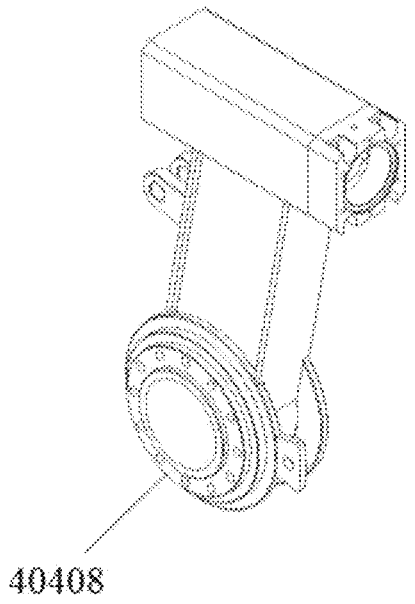
FIG. 32 is a structural schematic diagram of a pitching arm in a second viewing angle.
Figure 33:
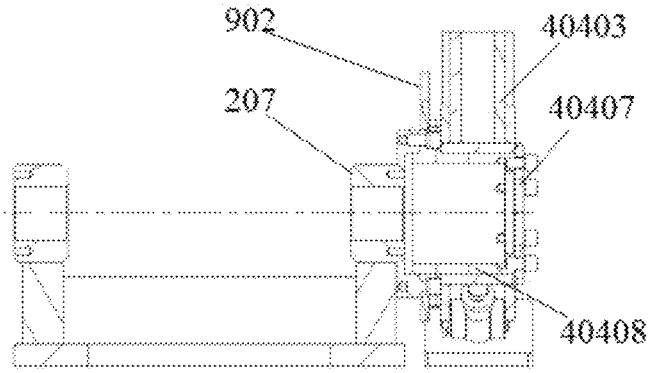
FIG. 33 is a schematic diagram of mounting positions of a main manipulator and a machine frame.
Figure 34:
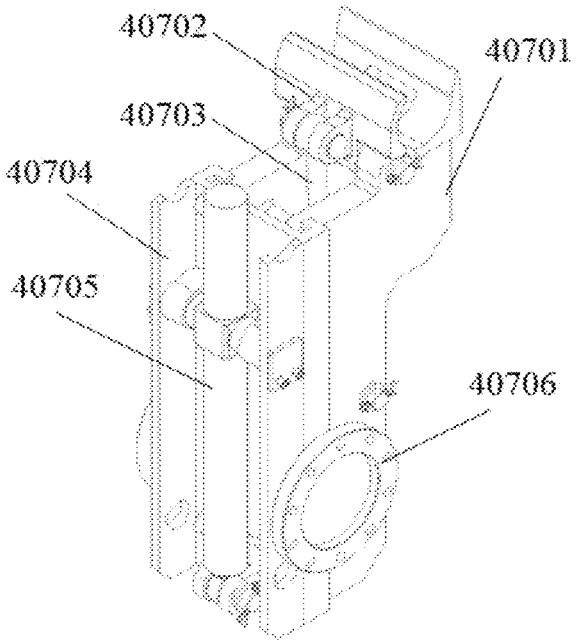
FIG. 34 is a structural schematic diagram of a manipulator claw.
Figure 35:
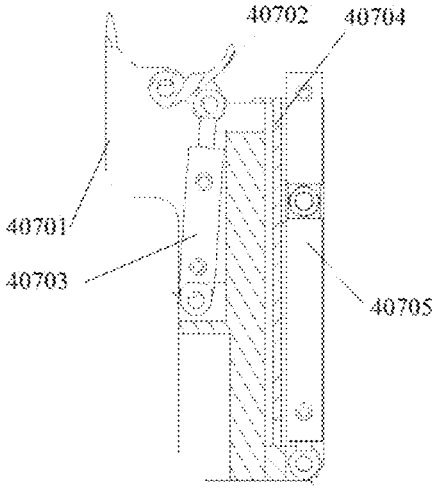
FIG. 35 is a sectional structural schematic diagram of a manipulator claw.
Figure 36:
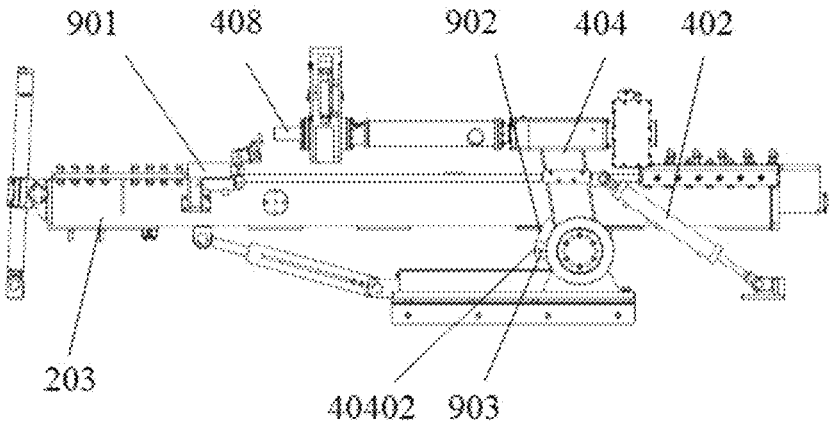
FIG. 36 is a structural schematic diagram of a manipulator positioning system.
Figure 37:
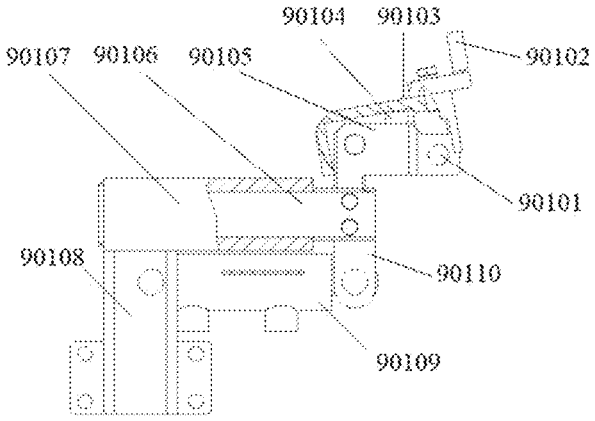
FIG. 37 is a structural schematic diagram of an isogonism sensor in a first viewing angle.
Figure 38:
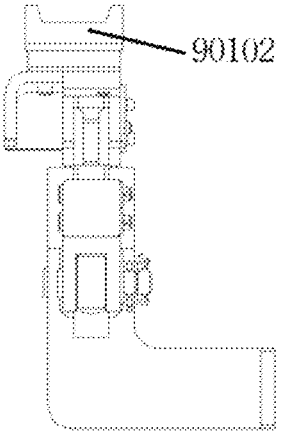
FIG. 38 is a structural schematic diagram of an isogonism sensor in a second viewing angle.
Figure 39:
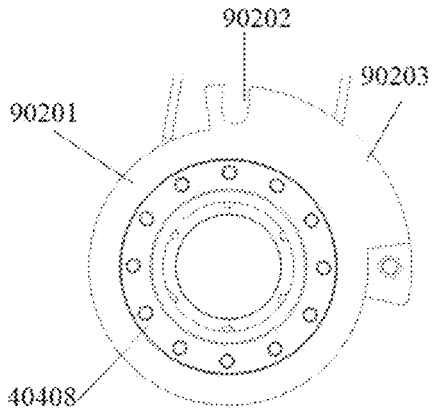
FIG. 39 is a structural schematic diagram of an angle marking plate.

The manipulator claw 407 is an executing mechanism for clamping drill pipes, and has two freedoms of motion: translation and clamping. The manipulator claw 407 comprises a moving claw body 40701, clamping jaws 40702, a first clamping cylinder 40703, a fixing seat 40704, a moving cylinder 40705 and connecting flanges 40706, the fixing seat 40704 is comprised of a bottom plate approximately U-shaped in cross-section and two side plates symmetrically arranged on one side of the bottom plate, and the bottom plate and the two side plates form an inner cavity used for placing the moving cylinder 40705. A pair of first slide rails are symmetrically arranged on the other side of the bottom plate. Two connecting flanges 40706 are provided, which are fixed on both sides of the fixing seat 40704 having the side plates, respectively, and are connected with the rotary arm 406 and the pressing rod 408, respectively, a top part of the moving claw body 40701 is a fixed jaw and is matched with the clamping jaws 40702 to realize drill pipe clamping and fixation, and the fixed jaw is hinged with the clamping jaws 40702 by pin shafts. A bottom part of the moving claw body 40701 is provided with a third cylinder seat connected with the moving cylinder 40705 for installing a piston rod of the moving cylinder 40705, an inner cavity of the moving claw body 40701 is used for placing the first clamping cylinder 40703, and two side plates of the cavity of the moving claw body 40701 are provided with second slide rails which are matched with the first slide rails of the fixing seat 40704 to form a moving pair, thus to make the moving claw body 40701 driven by the moving cylinder 40705 to slide back and forth. The piston rod of the moving cylinder 40705 is extended, and the moving claw body 40701 is moved downward as shown in FIG. 29; otherwise, the piston rod of the moving cylinder 40705 is retracted, and the moving claw body 40701 is moved upward. Moreover, when the piston rod of the moving cylinder 40705 is fully retracted to make the moving claw body 40701 move to a highest point, a distance between a rotating center line of the rotary arm 406 and a clamping center line of the moving claw body 40701 is equal to a distance between the rotating center line of the rotary arm 406 and a drilling center line on the machine frame 2 (also in a position between the power head and the clamper) so that the moving claw body 40701 can transfer a drill pipe from the initial position to the drilling center line between the power head 5 and the clamper 3.

Specifically, the piston rod of the moving cylinder 40705 is connected with the moving claw body 40701 by pin shafts, and the cylinder barrel is hinged with the fixing seat 40704 by pin shafts symmetrical on both sides; therefore, when the moving cylinder 40705 is extended or retracted to drive the moving claw body 40701 to move, the moving cylinder 40705 has a freedom of rotation, which can avoid a phenomenon of sliding track stuck. The clamping jaws 40702 are provided with a fourth cylinder seat connected with the first clamping cylinder 40703 on a back surface of a drill pipe clamping surface, and are hinged with a piston rod of the first clamping cylinder 40703 by pin shafts, and a cylinder barrel of the first clamping cylinder 40703 is hinged with the moving claw body 40701 by pin shafts.

Generally, the clamping jaws 40702 are arranged on one side of the manipulator claw 407 close to the machine frame 2 in order to avoid motion interference with the drill pipe in a turnover process of the manipulator claw 407 for conveying or taking back the drill pipe.

One end of the pressing rod 408 is a flange connected with the manipulator claw 407, and the other end is a round rod used for pressing down a pressing block of an isogonism sensor 901 to send a signal.

The manipulator positioning system 9 comprises the isogonism sensor 901, the pressing rod 408, the increment sensor 903 and the angle marking plate 902; a function of the isogonism sensor 901 is to judge whether the main manipulator 4 has reached a same inclination angle as the machine frame 2, and the isogonism sensor 901 comprises a proximity sensor 90101, a pressing plate 90102, a pressing plate seat 90103, a spring group 90104, a supporting seat 90105, a slide rod 90106, a slide seat 90107, a mounting frame 90108, a slide cylinder 90109 and a slide cylinder seat 90110; a lower part of the mounting frame 90108 is provided with a flange used for mounting the isogonism sensor 901 on the machine frame 2, and an upper part of the mounting frame 90108 is provided with a rod used for connecting and supporting the slide seat 90107; the slide cylinder 90109 is hinged by pin shafts with the mounting frame 90108 and the slide cylinder seat 90110 fixedly connected with the slide rod 90106, respectively, and the slide rod 90106 is matched with the slide seat 90107 to form a moving pair, i.e., the slide rod 90106 is arranged in and slidably connected with the slide seat 90107 and is driven by the slide cylinder 90109 to move to make other parts installed thereon extended or retracted towards the manipulator claw 407 of the main manipulator 4; a lower part of the supporting seat 90105 is fixedly connected with the slide rod 90106, the supporting seat 90105 has a hinge hole, the pressing plate seat 90103 is installed on and hinged with the supporting seat 90105 by a pin shaft, and one end of the supporting seat 90105 close to the manipulator claw 407 is provided with the proximity sensor 90101; the pressing plate seat 90103 is a hollow shell, and one side of the pressing plate seat 90103 facing the proximity sensor 90101 is provided with a side plate extending downward to be paired with the proximity sensor 90101 to form a signal sensing group so that when the side plate of the pressing plate seat 90103 enters a sensing range of the proximity sensor 90101, the sensor sends a signal; the spring group 90104 is arranged between the pressing plate seat 90103 and the supporting seat 90105, the spring group 90104 is used for supporting the pressing plate seat 90103, the pressing plate seat 90103 is lifted in a natural state to avoid engagement of the side plate of the pressing plate seat 90103 with the proximity sensor 90101, the spring group 90104 can be one or more springs, a support structure may also be added outside or inside the spring group 90104, and in other embodiments, the spring group 90104 may also be replaced with other elastic parts; and the pressing plate 90102 is a bent plate in an inverted "L" shape, an upper section of the pressing plate 90102 is used for making contact with the pressing rod 408, and a lower section of the pressing plate 90102 is used for fixedly connecting with the pressing plate seat 90103.

A working principle of the isogonism sensor 901 is as follows:

In a natural state, the pressing plate seat 90103 and the pressing plate 90102 are lifted upward under the action of the spring group 90104, the side plate extending downward in the pressing plate seat 90103 is not in the sensing range of the proximity sensor 90101, and the signal of the proximity sensor 90101 is switched off; when the main manipulator 4 moves downward and approaches a same inclination angle position as the machine frame 2, the pressing rod 408 at a front end of the main manipulator 4 comes into contact with the pressing plate 90102, and the pressing plate 90102 and the pressing plate seat 90103 are pressed down; and when the side plate extending downward in the pressing plate seat 90103 reaches a position that can be sensed by the proximity sensor 90101, the signal of the proximity sensor 90101 is switched on.

The angle marking plate 902 is a circular ring with a local fan-shaped bulge, the circular ring is provided with a plate body 90201 and a bulged fan-shaped block 90203, the fan-shaped block 90203 has a shifting notch 90202, a shifting rod is fixed on one side of the machine frame 2 facing the main manipulator 4, and the shifting rod is inserted into the shifting notch 90202 so that when an inclination angle of the machine frame 2 is changed, the angle marking plate 902 is changed by a same angle as the machine frame 2; and an inner hole of the circular ring is matched with the outer diameter of the angle marking plate mounting section on one side of the rotary barrel 40408 of the pitching arm 404 in the main manipulator 4 facing the machine frame 2 to make the angle marking plate 902 movably sheathed on the rotary barrel 40408.

The fan-shaped block 90203 is paired with the increment sensor 903 to form a signal sensing group; when the inclination angle of the machine frame 2 is 0°, a lower edge line of the fan-shaped block 90203 is at an angle θ to a horizontal line, and an initial angle of the main manipulator 4 (the inclination angle of the upper plane of the main manipulator 4, i.e., a center line of the rotary arm 406) is 0°, i.e., an initial angle in the position of the increment sensor 903 is 0°, an initial inclination angle of the increment sensor 903 is at least 0 less than the angle of the lower edge line of the fan-shaped block 90203, and the signal is not switched on at this time. Therefore, when the inclination angle of the main manipulator 4 is increased, the signal can only be switched on if the increment sensor 903 is moved upward to an area covered by the fan-shaped block 90203, indicating that the main manipulator 4 is at an inclination angle suitable for conveying the drill pipe.

The signal sensing group formed by pairing the side plate of the pressing plate seat 90103 formed by matching the isogonism sensor 901 with the pressing rod 408 with the proximity sensor 90101 is mutually matched with the signal sensing group formed by pairing the fan-shaped block 90203 with the increment sensor 903 to form a positioning system, so as to position the manipulator in the drill pipe conveying process, and the positioning system is simple and reliable. A relationship between the two signal sensing groups is that when the initial angle in the position of the increment sensor 903 is 0°, i.e., the main manipulator 4 is in the horizontal position (i.e., in the initial position), if the machine frame body in the machine frame 2 is also in the horizontal position, and the slide rod 90106 is driven by the slide cylinder 90109 to move to make other parts (the supporting seat 90105 and the pressing plate seat 90103) installed thereon extended towards the manipulator claw 407 of the main manipulator 4, the pressing rod 408 can come into contact with the pressing plate 90102, i.e., the pressing plate can be pressed down at a vertical height of the pressing rod, the pressing plate 90102 and the pressing plate seat 90103 are pressed down, the side plate extending downward in the pressing plate seat 90103 reaches a position that can be sensed by the proximity sensor 90101, and the signal of the proximity sensor 90101 is switched on, so as to realize the function of mutually matching for positioning in the drill pipe conveying process. It should be noted that the position relationship between the pressing rod and the isogonism sensor in this paragraph is only used for representing the relationship in the vertical direction to show a matching relationship between the signal sensing group formed by pairing the side plate of the pressing plate seat 90103 formed by matching the isogonism sensor 901 with the pressing rod 408 with the proximity sensor 90101 and the signal sensing group formed by pairing the fan-shaped block 90203 with the increment sensor 903, and is not used as a position limitation in a transverse direction. A transverse relationship can be adjusted by the slide cylinder 90109 as required to avoid motion interference.

A drill pipe conveying process of a drill pipe conveying manipulator for a directional drill is as follows:

Assuming that a drilling inclination angle of the machine frame 2 is α, α greater than 0° is a pitch up inclination angle, and a less than 0° is a pitch down inclination angle;

Conveying a Drill Pipe to the Machine Frame 2:

s1) Initial state of the manipulator: the piston rod II 40202 of the pitching cylinder 402 is fully extended and the piston rod I 40201 is fully retracted to make the inclination angle of the main manipulator 4 be 0°, i.e., the rotary arm 406 is in the horizontal position, at this time, the angle marking plate 902 is not engaged with the increment sensor 903, the manipulator claw 407 is in the vertical position, the clamping jaws 40702 and the fixed jaw of the moving claw body 40701 are opened upward, the clamping jaws 40702 are opened under the action of the retraction of the first clamping cylinder 40703, the piston rod of the moving cylinder 40705 is fully extended, the moving claw body 40701 and the clamping jaws 40702 are in a lowest position and are directly opposite an initial position of the drill pipe to be conveyed, then the drill pipe is taken out from a drill pipe box 801 by other associated conveying devices (the grasping manipulator 803) of the drill, front and rear ends of the drill pipe are placed in drill pipe troughs 80404 of the two pipe placing troughs 804, respectively, at this time, a drill pipe clamping center of the manipulator claw 407 just coincides with a center of the drill pipe to be conveyed, at the same time, the slide cylinder 90109 is fully retracted, and the proximity sensor 90101, the pressing plate 90102, etc. are retracted to avoid interference with the pressing rod 408 of the main manipulator 4;

In other embodiments, the drill pipe can also be placed in the initial position or the clamping center line of the moving claw body 40701 directly by workers, so as to meet the needs of taking the drill pipe from and placing the drill pipe back to the initial position by the main manipulator 4;

s2) Drill pipe clamping: the first clamping cylinder 40703 is extended to make the clamping jaws 40702 matched with the fixed jaw to clamp the drill pipe;

s3) Manipulator claw extension: the piston rod of the moving cylinder 40705 is retracted to drive the moving claw body 40701 and the clamping jaws 40702 to move upward and reach the highest position;

s4) Pitch up: the piston rod II 40202 of the pitching cylinder 402 is retracted, and the rotary shaft 405 and the rotary arm 406 are driven by the pitching arm 404 to increase the inclination angle; when the pitch up inclination angle of the main manipulator 4 reaches (a+0), the increment sensor 903 enters a coverage range of the angle marking plate 902, the increment sensor 903 is switched on and sends a signal, indicating that the main manipulator 4 is at an inclination angle suitable for conveying the drill pipe, and the main manipulator 4 stops pitching up; at the same time, the slide cylinder 90109 is extended to make the pressing plate 90102 located in a position where the pressing plate 90102 can be in contact with and pressed down by the pressing rod 408;

In an actual construction process, the drilling inclination angle of the machine frame 2 needs to be set according to construction requirements; if a is negative and an absolute value is greater than 0, the increment sensor 903 will directly enter the coverage range of the angle marking plate 902, and the increment sensor 903 is switched on and sends a signal; at this time, the main manipulator 4 does not need to be pitched up, and the steps are adjusted according to the condition that the main manipulator 4 is pitched up to make the increment sensor 903 switched on and send a signal;

s5) Pitch down: the piston rod II 40202 of the pitching cylinder 402 is extended, and the rotary shaft 405 and the rotary arm 406 are driven by the pitching arm 404 to pitch down to decrease the inclination angle; when the inclination angle of the main manipulator 4 reaches a (i.e., the same as the drilling inclination angle of the machine frame 2), the side plate in the pressing plate seat 90103 is driven by the pressing rod 408 to enter the sensing range of the proximity sensor 90101, the proximity sensor 90101 is switched on and sends a signal, and the main manipulator 4 stops pitching down; at the same time, as the inclination angle of the main manipulator 4 is decreased by θ, the increment sensor 903 is out of the coverage range of the angle marking plate 902, and the signal is switched off;

In an actual construction process, the drilling inclination angle of the machine frame 2 needs to be set according to construction requirements; if the increment sensor 903 is still in the coverage range of the angle marking plate 902 after the piston rod II 40202 is fully extended, the piston rod I 40201 can be further extended to further decrease the inclination angle of the main manipulator 4 until the pressing plate 90102 is pressed down by the pressing rod 408 to make the side plate in the pressing plate seat 90103 enter the sensing range of the proximity sensor 90101, the proximity sensor 90101 is switched on and sends a signal, and then the main manipulator 4 stops pitching down;

s6) Turnover: the manipulator claw 407 is driven by the rotary driver 403 through the rotary shaft 405 and the rotary arm 406 to turn towards the machine frame 2, preferably to rotate counterclockwise by 90°, and the drill pipe is conveyed into the drilling center line between the power head 5 and the clamper 3 on the machine frame 2;

s7) Manipulator claw release: after the drill pipe is clamped by the clamper 3 or the power head 5, the clamping jaws 40702 are released, and drill pipe conveying is completed;

s8) Turnover recovery: the manipulator claw 407 is driven by the rotary driver 403 to turn away from the machine frame 2, preferably to rotate clockwise by 90°, and the manipulator claw 407 leaves the machine frame 2; at the same time, the slide cylinder 90109 is retracted to make the pressing plate 90102 retracted so as to avoid contact interference with the pressing rod 408;

In other embodiments, the piston rod of the moving cylinder 40705 can be fully extended first as required, and the moving claw body 40701 and the clamping jaws 40702 are located away from the machine frame 2 to avoid motion interference;

s9) Inclination angle zeroing: the piston rod I of the pitching cylinder is fully retracted and the piston rod II is fully extended to make the inclination angle of the main manipulator 4 return to 0°;

s10) Manipulator claw retraction: the piston rod of the moving cylinder 40705 is fully extended to make the moving claw body 40701 and the clamping jaws 40702 return to the lowest position and make the main manipulator 4 restored to the initial state.

Taking Out a Drill Pipe from the Machine Frame:

q1) Initial state: the same as step s1, and the difference is that the drill pipe is not placed in the initial position;

q2) Manipulator claw extension: the same as step s3;

q3) Pitch up: the same as step s4;

q4) Pitch down: the same as step s5;

q5) Turnover: the same as step s6, and the difference is that an empty manipulator claw turns towards the machine frame 2, enters the drilling center line, and just comes into contact with the drill pipe;

q6) Drill pipe clamping: the first clamping cylinder 40703 is extended, and the drill pipe is clamped by the clamping jaws 40702;

q7) Turnover recovery: the same as step s8;

q8) Inclination angle zeroing: the same as step s9;

q9) Manipulator claw retraction: the same as step s10, and when the manipulator claw is retracted to the lowest position, the drill pipe returns to the initial position;

q10) Manipulator claw release: the first clamping cylinder 40703 is retracted, the clamping jaws 40702 are released, and the main manipulator 4 is restored to the initial state. The drill pipe can be taken away from or placed in this position.

The control system 6 mainly refers to an electronic control system, comprising a controller, an associated function module thereof, a sensor, a human-machine interaction system, a drilling track measurement system, etc. The control system 6 receives personnel control instructions and converts the instructions into execution parameters of each mechanism or system of the drill by compilation, so as to realize intelligent directional drilling, track measurement, drill pipe installation and removal, etc. Components in the control system 6 of the present application are not limited by types, and can be used in the drill mentioned by the present application through matching of program types and parameters, and the key is that the control system 6 comprises a drilling condition drive module and a toolface azimuth detection and initialization system.

The drilling condition drive module is used for automatic switching control of drilling conditions. As the power head 5 in the present embodiment has two rotation driving devices: the main motor 501 and the angle adjuster 503, switching of sliding directional drilling, toolface azimuth adjustment, rotary drilling (the same as drill pipe fishing) and combined drilling functions can be realized in combination with an external drilling medium pump driving the downhole motor through the water swivel. In the drilling condition drive module, a control switch of the main motor 501 is set as MI, a control switch of the rotary speed reducer 50303 in the angle adjuster 503 is set as MII, a control switch of the drilling driving medium is P, a locked/unlocked condition selector switch (i.e., whether to inject hydraulic oil into the sealing cavity Y) of the angle adjuster is T, and a control method therefor is shown in the table below:

| | Type of working condition | MI | MII | P |
|---|---|---|---|---|
| T = 1 | Sliding directional drilling | 0 | 0 | 1 |
| | Toolface azimuth adjustment | 0 | 1 | 0 |
| T = 0 | Rotary drilling | 1 | 0 | 0 |
| | Combined drilling | 1 | 0 | 1 |

In the table, T=1 indicates that the adjuster 503 is in the locked condition, and T=0 indicates that the adjuster 503 is in the unlocked condition;

MI=1 indicates that the main motor 501 is hydraulically driven, and MI=0 indicates that the main motor 501 is not hydraulically driven;

MII=1 indicates that the rotary speed reducer 50303 is hydraulically driven, and MII=0 indicates that the rotary speed reducer 50303 is not hydraulically driven;

P=1 indicates that the medium pump outputs the driving medium to the downhole motor, and P=0 indicates that the medium pump has no output.

Figure 40:
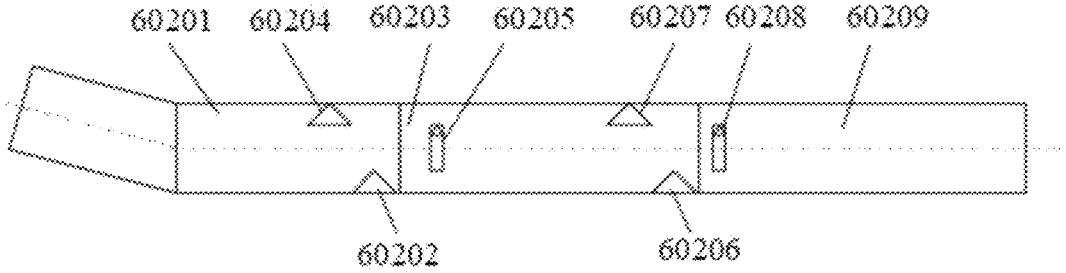
FIG. 40 is a structural schematic diagram of a toolface azimuth detection and initialization system.

Device Composition of the Toolface Azimuth Detection and Initialization System is as Follows:

As shown in FIG. 40, the toolface azimuth detection and initialization system is comprised of a first signal source 60202 and a second signal source 60204 which are installed in a downhole motor 60201; a first sensor 60205; a third signal source 60206 and a fourth signal source 60207 which are installed in a gauging nipple mounting pipe 60203; and a second sensor 60208 which is installed in a drill pipe 60209.

Figure 41:
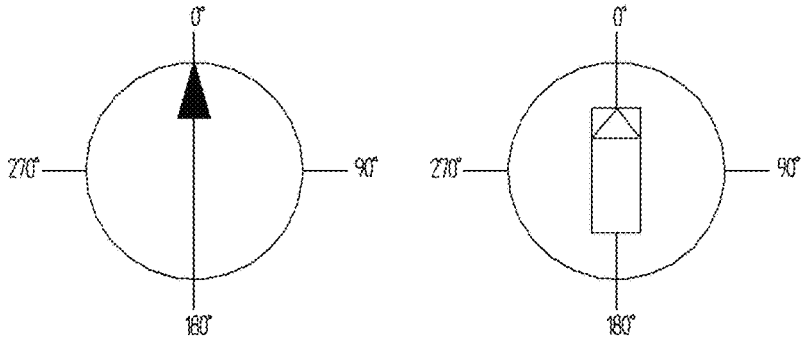
FIG. 41 is a directional schematic diagram of a signal source and a sensor.

Working Principle of Toolface Azimuth Detection and Initialization System (1) Direction Description of Sensors and Signal Sources According to the directional construction practice, 0° of the toolface azimuth is generally set right above the circle (12 o'clock direction), so the 0° direction of the two signal sources combined with the sensors is the same as this, as shown in FIG. 41.

Figure 42:
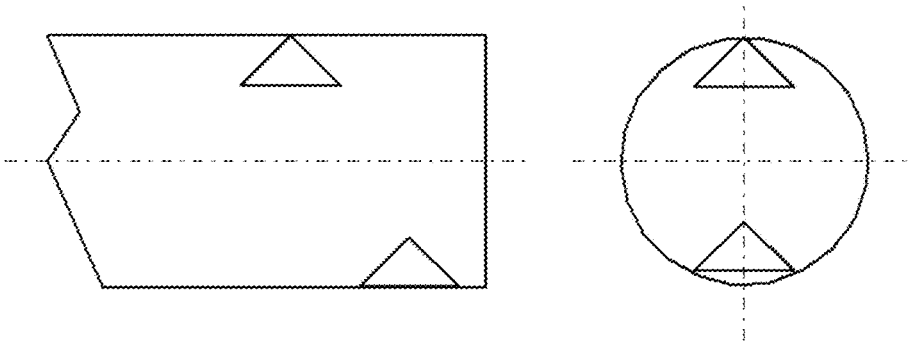
FIG. 42 is a schematic diagram of a setting method of a signal source.

To simplify the control system and reduce the types of components, the first signal source 60202 and the second signal source 60204 use signals of the same type and the same intensity, which are distinguished by the difference in distances from the sensors. The third signal source 60206 and the fourth signal source 60207 are the same as the first signal source 60202 and the second signal source 60204. The setting method of the signal sources is shown in FIG. 42.

The first signal source 60202 and the second signal source 60204 are arranged on two circles distributed along the axis inside the downhole motor 60201, respectively, and the projections of the two signal sources in a vertical plane are located on both ends of the same diameter of one circle. The first sensor 60205 is installed in the gauging nipple mounting pipe 60203. The setting of the third signal source 60206, the fourth signal source 60207 and the second sensor 60208 is the same as that of the above-mentioned signal sources and sensor. The direction of a combination signal of the third and fourth signal sources is consistent with that of the first sensor 60205, so as to convert a relative value and an absolute value of an angle.

A side view involved in the toolface azimuth detection and initialization system is in a direction from the drill pipe 60209 to the downhole motor 60201, i.e., from right to left in FIG. 40.

(2) Measurement Principles of Sensors

The first signal source 60202 and the second signal source 60204 are regarded as a signal combination identifier, called a first combination signal. The first signal source 60202 and the second signal source 60204 have same intensity, but the first signal source 60202 is close to the first sensor 60205, so the intensity of the first signal source 60202 received by the first sensor 60205 is significantly higher than that of the second signal source 60204. Therefore, the first combination signal has directivity. The third signal source 60206 and the fourth signal source 60207 form a second combination signal with directivity in a similar way.

The first sensor 60205 and the second sensor 60208 can measure angle values (0-360°) of the first combination signal and the second combination signal relative to the first sensor 60205 and the second sensor 60208, respectively.

(3) Basic Working Principle of System

The drill pipe 60209 is located out of a hole and is connected with a connecting mechanism (a chuck 505 or an active drill pipe 506, etc.) of the drill pipe 60209 of the drill, which can rotate an initial direction of the second sensor 60208 to a 0° direction conveniently and accurately.

The gauging nipple mounting pipe is installed in front of the drill pipe 60209 and is connected with the drill pipe 60209 through a threaded joint. Because an angle and tightness of threads are not consistent, the second combination signal will not accurately point to the 0° direction after the joint is connected. For the same reason, an initial direction of the second combination signal is not easy to adjust. However, the second sensor 60208 can measure a value of a direction of the second combination signal relative to the second sensor 60208, and the initial direction of the second sensor 60208 coincides with 0°. In fact, a measured angle ρ between the second combination signal and the second sensor 60208 is an absolute value at this time.

Similarly, the first combination signal on the downhole motor 60201 will not point to the 0° direction accurately, and an initial direction thereof is not easy to adjust. The first sensor 60205 measures a relative angle q of the first combination signal on the downhole motor 60201 in front of the first sensor 60205, and an absolute value of the angle of the first combination signal is $\omega=\varphi+\rho$.

(4) Measurement Process of Relative Angle

It is assumed that the downhole motor 60201, the gauging nipple mounting pipe 60203 and the drill pipe 60209 are connected and enter the hole as shown in FIG. 40, and at this time, an actual angle of the toolface azimuth of the downhole motor 60201 is unknown.

The second sensor 60208 is adjusted to point to the 0° direction.

The first sensor 60205 measures the relative angle ω between the first combination signal on the downhole motor 60201 and the first sensor 60205.

The second sensor 60208 measures a relative angle ρ between the second combination signal on the gauging nipple mounting pipe 60203 and the second sensor 60208.

Since the second sensor 60208 points to the 0° direction, and in fact, p is an absolute value at this time, the initial angle of the toolface azimuth of the downhole motor 60201 is $\omega=\varphi+\rho$.

(5) Initialization Process of Toolface Azimuth

1) Simplification of ω Value

Since the toolface azimuth is a projection angle in the vertical plane, it is only necessary to take an angle value thereof in one circle, so the ω value can be simplified by taking 360° as one period.

If $\omega>360°$, taking $\omega'=0\text{-}360°$ first

If $\omega<360°$, taking $\omega'=\omega$ first

2) Calculation and Adjustment of Adjustment Value

In the present embodiment, two initialization zero point positions of 0° and 180° are set, and an initialization angle of the downhole motor 60201 is adjusted according to a closer zero point to improve efficiency. A specific method is as follows:

When $\omega'\epsilon(0°, 90°]$ U (270°, 360°, the initialization zero point is 0°;

At this time, the adjustment value δ and the adjustment direction are:

When $\omega'\epsilon(0°, 90°]$, $\delta=\omega'$, making anti-clockwise adjustments;

When $\omega'\epsilon(270°, 360°$, $\delta+360°-\omega'$, making clockwise adjustments.

When $\omega'\epsilon(90°, 270°]$, the initialization zero point is 180°.

At this time, the adjustment value δ and the adjustment direction are:

When $\omega'\epsilon(90°, 180°]$, $\delta=180°-\omega'$, making clockwise adjustments;

When $\omega'\epsilon(180°, 270°]$, $\delta=\omega'-180°$, making anti-clockwise adjustments.

3) Zeroing of System

When the initialization zero point is 0°, the toolface azimuth is adjusted to 0° according to the adjustment value calculated in the previous step, and the value of the toolface azimuth measured by the measurement system is reset to zero. When the toolface azimuth needs to be adjusted, an entered toolface azimuth value is an executed value of a mechanism.

When the initialization zero point is 180°, the toolface azimuth is adjusted to 180° according to the adjustment value calculated in the previous step, and the value of the toolface azimuth measured by the measurement system is reset to zero. When the toolface azimuth needs to be adjusted, the entered toolface azimuth value is the same as that at the initialization zero point of 0°, and the system automatically subtracts 180° before making adjustments.

The hydraulic system 7 comprises a driving motor, a hydraulic pump, a hydraulic valve, a hydraulic cylinder, a hydraulic motor, a hydraulic speed reducer and various hydraulic accessories. The hydraulic system of the present application can be of various types, which can be matched with the control system and each executing mechanism of the present application through appropriate element parameters and function selection. Due to large driving force and strict explosion-proof safety requirements of a coal mine drill, the hydraulic system is preferred to be driven by a flameproof motor, and mechanical energy is converted into hydraulic energy by the hydraulic pump, thus to drive the executing mechanisms such as the power head 5, the machine frame 2, the clamper 3, the main manipulator 4, the tracked vehicle (moving platform 1) and the drill pipe storage system 8 to work. The key is to comprise a chuck pressure control system, and the chuck pressure control system is used to match with the drilling condition drive module in the control system 6 to realize automatic switching of drilling conditions of the power head.

The chuck pressure control system specifically comprises a pressure reducing valve 70101, an electromagnetic directional valve 70102, a first check valve 70103, a second check valve 70104, a third check valve 70105, a hydraulic operated directional valve 70106, a chuck 505 and an oil tank 70107. The pressure reducing valve 70101 is a fixed pressure reducing valve, which can reduce an upstream hydraulic pressure to a set pressure and can form a low-pressure oil circuit or a control oil circuit; the electromagnetic directional valve 70102 is a three-position four-way electromagnetic directional valve, which can automatically change a flow direction of oil through electromagnetic reversing; the first check valve 70103, the second check valve 70104 and a check valve III 5 can control one-way flow of oil; the hydraulic operated directional valve 70106 is a two-position three-way hydraulic operated directional valve, which can automatically change the flow direction of oil through the control oil circuit; the chuck 505 is used for clamping the drill pipes and is in a released state when not drilling; the chuck 505 is kept clamped by pressure oil when it is necessary to clamp the drill pipes, and is kept in a high-pressure clamping state when it is necessary to place or pull out a sleeve; and the oil tank 70107 is a component for storing hydraulic oil in the hydraulic system, and also plays a role of cooling and heat dissipation to a certain extent.

Pipe Connection is as Follows:

An oil circuit P1 from a main pump enters a port P of the hydraulic operated directional valve 70106 via the first check valve 70103; an oil circuit P2 from an auxiliary pump is divided into two branches: one branch enters the port P of the hydraulic operated directional valve 70106 via the second check valve 70104, the other branch enters a port P of the electromagnetic directional valve 70102 via the pressure reducing valve 70101, and a drainage port of the pressure reducing valve 70101 and a port T of the electromagnetic directional valve 70102 are connected with the oil tank 70107; oil outlet at a port A of the electromagnetic directional valve 70102 is divided into two streams: one stream of oil is connected with the port P of the hydraulic operated directional valve 70106 via the third check valve 70105, and the other stream of oil is connected with a hydraulic operated port of the hydraulic operated directional valve 70106; a port B of the electromagnetic directional valve 70102 is connected with a port T of the hydraulic operated directional valve 70106; and the port A of the hydraulic operated directional valve 70106 is connected with a control port of the chuck 505.

Figure 43:
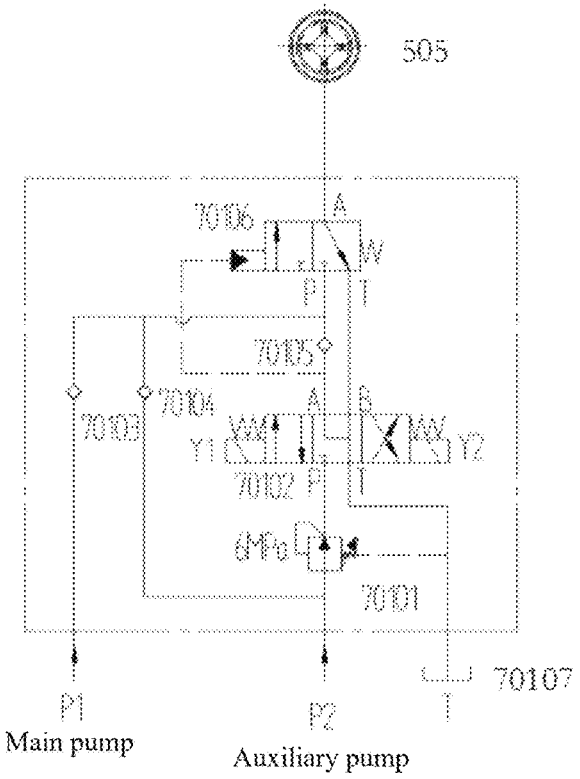
FIG. 43 is a schematic diagram of a working condition I of a chuck pressure control system.
Figure 44:
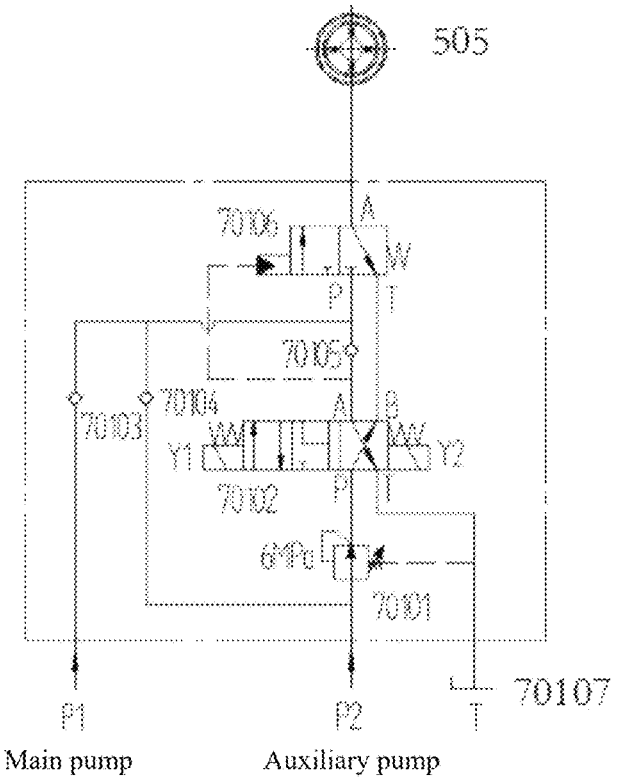
FIG. 44 is a schematic diagram of a working condition II of a chuck pressure control system.
Figure 45:
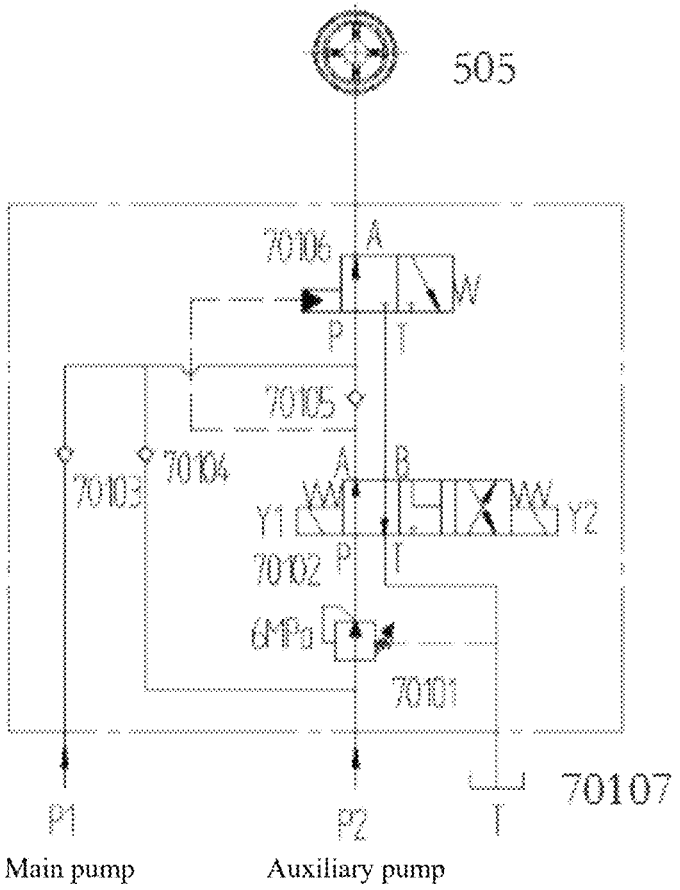
FIG. 45 is a schematic diagram of a working condition III of a chuck pressure control system.

The system provides three working conditions, as shown in FIG. 43 to FIG. 45.

As shown in FIG. 43, the chuck 505 is in the released state. When a left position Y1 and a right position Y2 of the electromagnetic directional valve 70102 are in a de-energized state, the electromagnetic directional valve 70102 is in a neutral position, and the hydraulic operated directional valve 70106 works in the right position under the action of a spring force. Pressure oil P1 from the main pump reaches and stops at an outlet of the second check valve 70104, an outlet of the third check valve 70105 and the P port of the hydraulic operated directional valve 70106 via the first check valve 70103. Meanwhile, one stream of pressure oil P2 from the auxiliary pump reaches and stops at an outlet of the first check valve 70103, the outlet of the third check valve 70105 and the P port of the hydraulic operated directional valve 70106 via the second check valve 70104; and the other stream of the pressure oil P2 from the auxiliary pump reaches and stops at the port P of the electromagnetic directional valve 70102 via the pressure reducing valve 70101. Pressure oil in the chuck is returned to the oil tank 70107 via the right position of the hydraulic operated directional valve 70106 and the neutral position of the electromagnetic directional valve 70102, the chuck 505 is in the released state, and at the same time, control oil of the hydraulic operated directional valve 70106 is drained to the oil tank 70107 via the neutral position of the electromagnetic directional valve 70102.

As shown in FIG. 44, the chuck 505 is in a low-pressure clamping state. When the right position Y2 of the electromagnetic directional valve 70102 is energized, the electromagnetic directional valve 70102 works in the right position, and the hydraulic operated directional valve 70106 works in the right position under the action of a spring force. The pressure oil P1 from the main pump reaches and stops at the outlet of the second check valve 70104, the outlet of the third check valve 70105 and the P port of the hydraulic operated directional valve 70106 via the first check valve 70103, and the control oil of the hydraulic operated directional valve 70106 is drained to the oil tank 70107 via the right position of the electromagnetic directional valve 70102. One stream of pressure oil P2 from the auxiliary pump reaches and stops at the outlet of the first check valve 70103, the outlet of the third check valve 70105 and the P port of the hydraulic operated directional valve 70106 via the second check valve 70104; and the other stream of oil is reduced to a set pressure of 6 MPa by the pressure reducing valve 70101, the pressure oil reaches the chuck 505 via the right position of the electromagnetic directional valve 70102 and the right position of the hydraulic operated directional valve 70106, and at this time, the chuck is in a 6 MPa low-pressure clamping state.

As shown in FIG. 45, the chuck 505 is in the high-pressure clamping state. When the left position Y1 of the electromagnetic directional valve 70102 is energized, the electromagnetic directional valve 70102 works in the left position, and the hydraulic operated directional valve 70106 works in the left position under the action of the control oil. The pressure oil P1 from the main pump reaches and stops at the outlet of the second check valve 70104 and the outlet of the third check valve 70105 via the first check valve 70103, and finally flows into a normally open hydraulic chuck via the left position of the hydraulic operated directional valve 70106. The pressure oil P2 from the auxiliary pump is divided into two streams: one stream of oil is reduced to 6 MPa by a check valve 1 and reaches a control port of the hydraulic operated directional valve 70106 via the left position of the electromagnetic directional valve 70102 so that the hydraulic operated directional valve is reversed and works in the left position; and the other stream of oil reaches and stops at the outlet of the first check valve 70103 and the outlet of the third check valve 70105 via the second check valve 70104, and finally flows into the chuck 505 via the left position of the hydraulic operated directional valve 70106. In this state, the main pump and the auxiliary pump are combined to form a high-pressure oil source so that the normally open chuck is in the high-pressure clamping state.

A working process of the intelligent directional drill is as follows:

1. Automatic Directional Drilling (1) Drilling Condition (Taking any Drill Pipe During Drilling as an Example)

dz0) Initial State

It is assumed that a designed drilling inclination angle is a (taking the drilling inclination angle $\alpha$ which serves as a pitch up inclination angle as an example), and the machine frame body 203 is adjusted to the inclination angle, the drill bit, the downhole motor, the track measurement probe and other drilling tools are ready, and the value of the toolface azimuth is reset to zero by the toolface azimuth detection and initialization system 602;

The power head 5 is provided with an active drill pipe 506, a connecting shaft 507, a hexagonal hole connecting sleeve 508 and a water swivel 504, the power head is located at a rearmost end of the machine frame 2 (i.e., the thrust displacement is 0), the active drill pipe 506 is not connected with a drill pipe, the angle adjuster 503 is in the locked condition, and the chuck 505 is controlled by the chuck pressure control system 701 to be in the released state;

A drill pipe is placed in a clamping hole in the front half of the clamper 3, the rear half of the clamper 3 is released, the drill pipe boxes 801 are fully filled with drill pipes (or filled with a required number of drill pipes suitable for a depth of a hole), the grasping manipulator 803 is located in any position where no interference with the drill pipes and other components of the drill will occur, the cylinder in the first telescopic barrel 80304 is fully extended, the cylinder in the second telescopic barrel 80302 is fully retracted to make the mechanical claw 80301 in a highest position, the mechanical claw is released, no drill pipe is placed in the pipe placing troughs 804, the second clamping cylinders 80402 are released to expand the drill pipe placing space, the inclination angle of the main manipulator 4 is 0°, the manipulator claw 407 is in the vertical position, the clamping jaws 40702 and the moving claw body 40701 are opened upward and are directly opposite the initial position (i.e., the pipe placing troughs 804), the clamping jaws 40702 are opened under the action of the retraction of the first clamping cylinder 40703, the piston rod of the moving cylinder 40705 is fully extended, the moving claw body 40701 and the clamping jaws 40702 are in a lowest position, a drill pipe clamping center of the manipulator claw 407 just coincides with a drill pipe placing center of the pipe placing troughs 804, the slide cylinder 90109 of the isogonism sensor 901 is fully retracted, and the proximity sensor 90101, the pressing plate 90102, etc. are retracted to avoid motion interference with the pressing rod 408 of the main manipulator 4; if the directional drill is not in the above initial state, the directional drill will operate automatically and restore to the above state after a power supply is switched on and an automatic drilling function is activated.

dz01) First Stage of Drill Pipe Conveying (the Drill Pipe Storage System)

- dz01-1) Box selection: according to the arrangement of the control system 6, the grasping manipulator 803 is driven by the translation assembly 802 to move along the slide rail 80103 to grasp the drill pipes from any one of the drill pipe boxes 801. In the present application, it is preferred to start drill pipe grasping from the drill pipe box on a left side;
- dz01-2) Column selection: the mechanical claw 80301 is driven by a gear-rack mechanism formed by the second telescopic barrel 80302 and the crossbeam assembly 80303 to move along the crossbeam assembly to switch among the columns. In the present application, it is preferred to start conveying from the column of drill pipes closest to the machine frame;
- dz01-3) Layer selection: a height of the mechanical claw is adjusted by the cylinders in the first telescopic barrel 80304 and the second telescopic barrel 80302 according to a drill pipe storage condition, thus to make the mechanical claw 80301 suitable for grasping a drill pipe selected by the system;

dz01-4) Grasping: the drill pipe selected to be grasped is clamped by the mechanical claw 80301;

dz01-5) Lifting: the cylinder in the first telescopic barrel 80304 is fully extended, and the cylinder in the second telescopic barrel 80302 is fully retracted to make the mechanical claw in the highest position;

dz01-6) Aligning: the grasping manipulator is driven by the translation assembly 802 to move along the slide rail 80103 to a position aligned with the machine frame 2 (i.e., a middle position of the two pipe placing troughs 804); in order to improve efficiency, the position in the present application is the same as a box selection position of the drill pipe box on the left side;

dz01-7) Pipe conveying: the mechanical claw 80301 is driven by the gear-rack mechanism formed by the second telescopic barrel 80302 and the crossbeam assembly 80303 to move along the crossbeam assembly to a position above the pipe placing troughs 804, the cylinders in the first telescopic barrel 80304 and the second telescopic barrel 80302 are moved in combination to adjust the height of the mechanical claw to place the drill pipe in the pipe placing troughs 804; at the same time, the second clamping cylinders 80402 of the pipe placing troughs are retracted to make the drill pipe aligned with the machine frame 2 more accurately, the mechanical claw is released, the cylinder in the first telescopic barrel 80304 is fully extended, and the cylinder in the second telescopic barrel 80302 is fully retracted; the mechanical claw 80301 moves along the crossbeam assembly 80303 and the slide rail 80103 to a position above a next drill pipe to be grasped for preparations;

dz02) Second Stage of Drill Pipe Conveying (the Main Manipulator 4)

dz02-1) Drill pipe clamping: the first clamping cylinder 40703 is extended, the drill pipe in the pipe placing troughs 804 is clamped by the clamping jaws 40702, and at the same time, the second clamping cylinders 80402 of the pipe placing troughs are extended to expand the drill pipe placing space (for the convenience of taking out the present drill pipe and making preparations for subsequent drill pipe placement);

dz02-2) Manipulator claw extension: the piston rod of the moving cylinder 40705 is retracted to drive the moving claw body 40701 and the clamping jaws 40702 to move upward and reach the highest position;

dz02-3) Pitch up: the piston rod II 40202 of the pitching cylinder 402 is retracted, and the pitch up inclination angle of the main manipulator is increased; when the pitch up inclination angle of the main manipulator reaches ($\alpha+\theta$), the increment sensor 903 enters a coverage range of the angle marking plate 902, the increment sensor 903 is switched on and sends a signal, indicating that the main manipulator 4 is at an inclination angle suitable for conveying the drill pipe, and the main manipulator 4 stops pitching up; at the same time, the slide cylinder 90109 of the isogonism sensor 901 is extended to make the pressing plate 90102 located in a horizontal position where the pressing plate 90102 can be in contact with and pressed down by the pressing rod 408;

dz02-4) Pitch down: the piston rod II 40202 of the pitching cylinder 402 is extended, and the inclination angle of the main manipulator 4 is decreased; when the inclination angle of the main manipulator reaches a (i.e., the same as the inclination angle of the machine frame body 203), the side plate of the pressing plate seat 90103 of the isogonism sensor 901 is driven by the pressing rod 408 to enter the sensing range of the proximity sensor 90101, the isogonism sensor is switched on and sends a signal, and the main manipulator 4 stops pitching down; at the same time, as the inclination angle of the main manipulator is decreased by $\theta$, the increment sensor 903 is out of the coverage range of the angle marking plate 902, and the signal of the increment sensor 903 is switched off;

dz02-5) Turnover: the manipulator claw is driven by the rotary driver 403 to turn towards the machine frame 2, a preferred solution is to rotate counterclockwise by 90° as shown in FIG. 1, and the drill pipe is conveyed to a position between the power head 5 and the rear half of the clamper 3 on the machine frame body 203;

dz02-6) Manipulator claw release: the drill pipe is clamped by the rear half of the clamper 3, the clamping jaws 40702 are released, and drill pipe conveying is completed;

dz02-7) Turnover recovery: the manipulator claw 407 is driven by the rotary driver 403 to turn away from the machine frame, and a preferred solution is to rotate clockwise by 90° as shown in FIG. 1; at the same time, the slide cylinder 90109 of the isogonism sensor 901 is retracted to make the pressing plate 90102, etc. retracted and avoid contact interference with the pressing rod 408;

dz02-8) Inclination angle zeroing: the piston rod II 40202 of the pitching cylinder 402 is fully extended, and the piston rod I 40201 remains fully retracted to make the inclination angle of the main manipulator return to 0°;

dz02-9) Manipulator claw retraction: the piston rod of the moving cylinder 40705 is fully extended to make the moving claw body 40701 and the clamping jaws 40702 return to the lowest position, and make the main manipulator restored to the initial state.

dz03) Drilling dz03-1) Angle adjuster unlocking: the drilling condition drive module selects a working condition of "rotary drilling", an oil circuit from the hydraulic system 7 to the sealing cavity Y in the angle adjuster 503 is connected, and the driving piston 50302 is driven by a hydraulic force to move towards the moving toothed disk and push the transmission piston 50304 and the moving toothed disk 50306 to make the moving toothed disk 50306 separate from the fixed toothed disk 50305, thus to switch the angle adjuster 503 to the unlocked condition;

dz03-2) Rear end connection: the chuck is controlled by the chuck pressure control system to be in the low-pressure clamping state, the main motor 501 of the power head 5 rotates forward to drive the active drill pipe 506 to rotate, the power head is driven by the thrust cylinder 204 in the machine frame 2 to move forward, and the active drill pipe 506 is connected with the rear end of the drill pipe conveyed in step dz02;

dz03-3) Front end connection: the rear half of the clamper 3 is released, the active drill pipe and the drill pipe with the rear end connection completed in the previous step are driven by the main motor and the thrust cylinder to continue rotating and moving forward, connection between a front end joint of the drill pipe and the last drill pipe (which is clamped by the front half of the clamper) in the hole is completed, and then the front half of the clamper is released;

dz03-4) Angle adjuster locking: the drilling condition drive module selects a working condition of "toolface azimuth adjustment", oil supply to the sealing cavity Y of the angle adjuster 503 is stopped, the moving toothed disk 50306 is engaged with the fixed toothed disk 50305 under the action of the springs 50309, and the angle adjuster is switched to the locked condition;

dz03-5) Toolface azimuth adjustment: the transmission shaft 50301 is driven by the rotary speed reducer 50303 to rotate at a low speed, and rotation motion is transferred to the gearbox 502 through the driving shaft 50201 of the motor, then transferred to the drill pipes through the main shaft 510 of the power head, and finally transferred to the downhole motor in the hole, thus to achieve accurate toolface azimuth adjustment;

dz03-6) Automatic drilling: the drilling condition drive module selects a working condition of "sliding directional drilling", the rotary speed reducer 50303 stops driving, and an external medium pump truck (such as a water pump truck) is used to inject a drilling medium into the downhole motor through the water swivel 504, thus to drive the downhole motor to make the drill bit rotate; the power head 5, all the drill pipes connected with the active drill pipe 506 and the downhole motor are driven by the thrust cylinder 204 to move forward, thus to realize sliding directional drilling.

dz03-7) Power head resetting: after the present drill pipe is fully drilled into the hole, the present drill pipe is clamped by the front half of the clamper, the drilling condition drive module selects the working condition of "rotary drilling", the angle adjuster 503 is switched to the unlocked condition, the main motor 501 rotates backward to drive the active drill pipe 506 to rotate backward and be disconnected from the threaded joint at the rear end of the drill pipe, the power head is driven by the thrust cylinder 204 to return to the rearmost end of the machine frame 2, and the chuck is controlled by the chuck pressure control system to be in the released state.

At this point, the clamper 3, the main manipulator 4, the power head 5, the drill pipe storage system 8 and the isogonism sensor 901 are all restored to the dz0) initial state, and drilling is continued according to steps dz01)-dz03) until set track and depth are achieved.

When the drilling inclination angle $\alpha$ is a pitch down inclination angle, the difference is that:

dz02-31) Pitch up: when a drilling inclination angle of the machine frame body is a pitch down inclination angle, the angle marking plate is driven to rotate by the shifting rod connected to the machine frame body, and the increment sensor is made not enter the coverage range of the angle marking plate, the piston rod II of the pitching cylinder is retracted, and the inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

Or dz02-32) pitch up: when a drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

dz02-41) Pitch down: when the previous step is dz02-31), the piston rod II of the pitching cylinder is extended, and the inclination angle of the main manipulator is decreased; when the piston rod II is fully extended, if the side plate in the pressing plate seat does not enter a sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

Or dz02-42) pitch down: when the previous step is dz02-32), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down.

(2) Drill Pipe Withdrawal Condition tz0) Initial State

It is assumed that the designed drilling inclination angle is a, and the drill has completed the present drilling construction.

The drilling condition drive module 601 selects the working condition of "sliding directional drilling";

The power head is located at a foremost end of the machine frame 2 (i.e., the thrust displacement is already a full stroke), the active drill pipe 506 is connected with the last drill pipe exposed in the hole (called an "ending drill pipe"), and the angle adjuster 503 is in the locked condition; and the chuck 505 is controlled by the chuck pressure control system to be in the released state.

Both the front half and the rear half of the clamper 3 are released;

The drill pipe boxes 801 have sufficient drill pipe recovery space;

The grasping manipulator 803 is located in any position where no interference with the drill pipes and other components of the drill will occur, the cylinder in the first telescopic barrel 80304 is fully extended, the cylinder in the second telescopic barrel 80302 is fully retracted to make the mechanical claw 80301 in the highest position, and the mechanical claw is released;

No drill pipe is placed in the pipe placing troughs 804, and the second clamping cylinders 80402 are released to expand the drill pipe placing space;

The inclination angle of the main manipulator 4 is 0°, the manipulator claw 407 is in the vertical position, the clamping jaws 40702 and the moving claw body 40701 are opened upward, and the clamping jaws 40702 are opened under the action of the retraction of the first clamping cylinder 40703; the piston rod of the moving cylinder 40705 is fully extended, the moving claw body 40701 and the clamping jaws 40702 are in the lowest position, and a drill pipe clamping center of the manipulator claw 407 just coincides with the drill pipe placing center of the pipe placing troughs 804; and the slide cylinder 90109 of the isogonism sensor 901 is fully retracted, and the proximity sensor 90101, the pressing plate 90102, etc. are retracted to avoid interference with the pressing rod 408 of the main manipulator;

If the drill is not in the above initial state, the drill will operate automatically and restore to the above state after a power supply is switched on and an automatic drill pipe withdrawal function is activated.

tz01) Drill Pipe Withdrawal

- tz01-1) Sliding drill pipe withdrawal: the drilling condition drive module maintains the working condition of "sliding directional drilling", the chuck is controlled by a chuck multistage pressure control system to be in the low-pressure clamping state, the power head 5, all the drill pipes connected with the active drill pipe 506 and the downhole motor are driven by the thrust cylinder 204 to withdraw until the ending drill pipe is completely out of the hole (the power head reserves a displacement required for unthreading);
- tz01-2) Angle adjuster unlocking: the drilling condition drive module selects the working condition of "rotary drilling", an oil circuit from the hydraulic system to the sealing cavity Y in the angle adjuster 503 is connected, and the driving piston 50302 is driven by a hydraulic force to push the transmission piston 50304 and the moving toothed disk 50306 to separate from the fixed toothed disk 50305, thus to switch the angle adjuster to the unlocked condition;
- tz01-3) Front end disconnection: the ending drill pipe is clamped by the rear half of the clamper 3, a drill pipe before the ending drill pipe is clamped by the front half of the clamper 3, the front half and the rear half rotate relative to each other, threaded connection between the two drill pipes are pre-loosened, the rear half is released, the main motor 501 of the power head 5 rotates backward to drive the active drill pipe 506 to rotate backward, at the same time, the power head is driven by the thrust cylinder 204 of the machine frame 2 to withdraw, and the ending drill pipe is disconnected from the drill pipe before the ending drill pipe;
- tz01-4) Rear end disconnection: the ending drill pipe is clamped by the rear half of the clamper 3, the active drill pipe 506 is driven by the main motor 501 to continue rotating backward and is driven by the thrust cylinder 204 to withdraw, and the ending drill pipe is disconnected from the active drill pipe;

tz02) Second Stage of Pipe Conveying for Drill Pipe Withdrawal (the Main Manipulator)

- tz02-1) Manipulator claw extension: the same as step dz02-2);
- tz02-2) Pitch up: the same as step dz02-3);
- tz02-3) Pitch down: the same as step dz02-4);
- tz02-4) Turnover: the same as step dz02-5), and the difference is that an empty manipulator claw turns towards the machine frame 2, enters the drilling center line, and just comes into contact with the drill pipe;
- tz02-5) Drill pipe clamping: the first clamping cylinder 40703 is extended, and the drill pipe is clamped by the clamping jaws 40702. At the same time, the rear half of the clamper 3 is released;
- tz02-6) Turnover recovery: the same as step dz02-7);
- tz02-7) Inclination angle zeroing: the same as step dz02-8);
- tz02-8) Manipulator claw retraction: the same as step dz02-9), and when the manipulator claw is retracted to the lowest position, the drill pipe enters the pipe placing troughs 804. At the same time, the second clamping cylinders 80402 of the pipe placing troughs are retracted to make the drill pipe aligned with the drill pipe boxes;
- tz02-9) Manipulator claw release: the clamping jaws 40702 are released, and the main manipulator is restored to the initial state;

tz03) First Stage of Pipe Conveying for Drill Pipe Withdrawal (the Drill Pipe Storage System)

- tz03-1) Aligning: the grasping manipulator 803 is driven by the translation assembly 802 to move along the slide rail 80103 to a position aligned with the middle position of the two pipe placing troughs 804. In order to improve efficiency, the position in the present application is the same as a box selection position of the drill pipe box on the left side, and is also the same as the position where the drill pipe is conveyed to the machine frame 2 by the main manipulator 4;
- tz03-2) Pipe taking: the mechanical claw 80301 is driven by the gear-rack mechanism formed by the second telescopic barrel 80302 and the crossbeam assembly 80303 to move along the crossbeam assembly to a position above the pipe placing troughs 804, the cylinders in the first telescopic barrel 80304 and the second telescopic barrel 80302 are moved in combination to adjust the height of the mechanical claw to make the mechanical claw come into contact with the drill pipe in the pipe placing troughs, the clamping center coincides with the center of the drill pipe, and the drill pipe is clamped by the mechanical claw; at the same time, the second clamping cylinders 80402 of the pipe placing troughs are extended to expand the drill pipe placing space for the convenience of taking out the drill pipe;
- tz03-3) Lifting: the cylinder in the second telescopic barrel 80302 is fully retracted, and the cylinder in the first telescopic barrel 80304 is fully extended to lift the mechanical claw and the drill pipe to a high position;
- tz03-4) Box selection: according to the arrangement of the control system, the grasping manipulator is driven by the translation assembly 802 to move along the slide rail 80103 to place the drill pipe back to any one of the drill pipe boxes. In the present application, it is preferred to start drill pipe placing back from the drill pipe box on the right side;
- tz03-5) Column selection: the mechanical claw 80301 is driven by the gear-rack mechanism formed by the second telescopic barrel 80302 and the crossbeam assembly 80303 to move along the crossbeam assembly to switch among the columns. In the present application, it is preferred to start drill pipe placing back from the column farthest from the machine frame;
- tz03-6) Layer selection: the height of the mechanical claw is adjusted by the cylinders in the first telescopic barrel 80304 and the second telescopic barrel 80302 according to the real-time drill pipe storage condition judged by the control system, thus to start drill pipe placing back from a lowest position where the drill pipe can be placed in a specified column;
- tz03-7) Pipe placing: the mechanical claw 80301 is released, the cylinder in the first telescopic barrel 80304 is fully extended, and the cylinder in the second telescopic barrel 80302 is fully retracted to make the mechanical claw return to the high position;

tz04) Power head and clamper resetting: the power head is driven by the thrust cylinder 204 to return to the front end of the machine frame 2, and the main motor 501 rotates forward to drive the active drill pipe 506 to rotate forward and be connected with the present ending drill pipe. The front half of the clamper is released, and the drilling condition drive module selects the working condition of "sliding directional drilling". The chuck 505 is controlled by the chuck multistage pressure control system to be in the released state.

At this point, the clamper 3, the main manipulator 4, the power head 5, the drill pipe storage system 8, the isogonism sensor 901, etc. are all restored to the tz0) initial state, and drill pipe withdrawal is continued according to steps tz01)-tz04) until all the drill pipes are withdrawn from the hole.

When the drilling inclination angle $\alpha$ is a pitch down inclination angle, the difference is that:

tz02-21) Pitch up: when a drilling inclination angle of the machine frame body is a pitch down inclination angle, the angle marking plate is driven to rotate by the shifting rod connected to the machine frame body, and the increment sensor is made not enter a coverage range of the angle marking plate, the piston rod II of the pitching cylinder is retracted, and the inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

Or tz02-22) pitch up: when the drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

tz02-31) Pitch down: when the previous step is tz02-21), the piston rod II of the pitching cylinder is extended, and the inclination angle of the main manipulator is decreased; when the piston rod II is fully extended, if the side plate in the pressing plate seat does not enter the sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

Or tz02-32) pitch down: when the previous step is tz02-22), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down.

Supplement: the three steps dz01-dz03 in the drilling condition describe the working processes of the drilling system (the power head, the machine frame and the clamper), the main manipulator and the drill pipe storage system during drilling, respectively. According to the time length of each process and the spatial relationship of the mechanism operation, executive modes such as serial execution and parallel execution can be selected for each process to save the overall time of a drilling process and improve the efficiency. Similarly, for the four steps tz01-tz04 in the drill pipe withdrawal condition, the executive modes such as serial execution and parallel execution can also be selected to save the overall time of a drill pipe withdrawal process and improve the efficiency.

2. Automatic Rotary Drilling

The drilling condition drive module always selects the working condition of "rotary drilling", and the chuck 505 is always controlled by the chuck pressure control system to be in the low-pressure clamping state. In rotary drilling, the downhole motor is not required, and the drill bit only needs to be installed on the drill pipe at the foremost end.

The drill pipe conveying process is exactly the same as that of automatic directional drilling, the drilling and drill pipe withdrawal processes are similar to those of automatic directional drilling, and the distinctive features are that:

(1) The angle adjuster 503 is always in the unlocked condition.

(2) During drilling (dz03), the step of "dz03-5) Toolface azimuth adjustment" is not used, and the power head and the drill pipe are always driven by the main motor 501 in the drilling step (dz03-6).

3. Automatic Combined Drilling

The drilling condition drive module selects the working condition of "combined drilling", drilling tools of automatic combined drilling are the same as those of automatic directional drilling, and the drill pipe conveying process is exactly the same as that of automatic directional drilling; and the drilling and drill pipe withdrawal processes are similar to those of automatic directional drilling, and the distinctive features are that:

(1) The angle adjuster 503 is always in the unlocked condition.

(2) During drilling (dz03), an external medium pump truck (such as a water pump truck) is used to inject a drilling medium into the downhole motor through the water swivel 504, thus to drive the downhole motor to make the drill bit rotate, and the main motor 501 is used to drive the power head and the drill pipe to rotate.

4. Drill Pipe Fishing

During drilling, if a drill pipe cannot be taken out due to accidents such as drill pipe fracture, it is necessary to use special fishing drilling tools for fishing drilling; before the drill pipe fishing operation, the active drill pipe 506, the connecting shaft 507, the water swivel 504, etc. are removed first; the subsequent drilling, drill pipe withdrawal and drill pipe conveying operations are the same as those of automatic rotary drilling, and the difference is that: the drilling condition drive module always selects the working condition of "rotary drilling", the power head is directly connected with the drill pipe directly through the chuck rather than the active drill pipe; and when the chuck is required to clamp the drill pipe, the chuck is controlled by the chuck pressure control system to be in the high-pressure clamping state.

Finally, it should be noted that the above embodiments are only used for describing, rather than limiting the technical solution of the utility model. Although the utility model is described in detail with reference to the preferred embodiments, those ordinary skilled in the art shall understand that the technical solution of the utility model can be amended or equivalently replaced without departing from the purpose and the scope of the technical solution. The amendment or equivalent replacement shall be covered within the scope of the claims of the utility model.

The invention claimed is:

1. A coal mine intelligent directional drill, comprising a moving platform, a machine frame, a clamper, a main manipulator, a power head, a drill pipe storage system, a control system and a hydraulic system, wherein the machine frame, the drill pipe storage system, the control system, the hydraulic system and the main manipulator are installed on the moving platform, the clamper and the power head are installed on both ends of the machine frame, respectively, the power head comprises a main motor, a gearbox and a main shaft, the gearbox is provided with a driving shaft, one end of the driving shaft is connected with the main motor, the driving shaft is engaged with the main shaft through a gear in the gearbox, a drill pipe is circumferentially and fixedly connected with the main shaft, a downhole motor is arranged at the front end of the drill pipe to serve as a downhole drilling actuator, and the other end of the driving shaft is connected with an angle adjuster through the gearbox;

the angle adjuster comprises a transmission shaft, a fixed toothed disk, a moving toothed disk, a rotary seat and a rotary speed reducer with a self-locking function, one end of the transmission shaft is circumferentially and fixedly connected with the driving shaft, the fixed toothed disk and the moving toothed disk are sheathed on the transmission shaft, the fixed toothed disk is engaged with the moving toothed disk through skewed teeth, the fixed toothed disk is circumferentially and fixedly connected with the transmission shaft, the moving toothed disk is rotationally connected with the transmission shaft, and the moving toothed disk can slide along an axial direction of the transmission shaft;

the rotary seat is sheathed on and circumferentially and fixedly connected with the moving toothed disk, and an output disk of the rotary speed reducer is coaxially and fixedly connected with the rotary seat to transfer rotation of the output disk of the rotary speed reducer to the moving toothed disk;

the control system comprises a toolface azimuth detection and initialization system, the toolface azimuth detection and initialization system comprises a first segment, a second segment and a third segment which are connected in sequence, a first signal combination identifier is arranged in the first segment, a first sensor and a second signal combination identifier are arranged in the second segment, a second sensor is arranged in the third segment, an angle $\phi$ between the first sensor and the first signal combination identifier is measured by the first sensor, and an angle $\rho$ between the second sensor and the second signal combination identifier is measured by the second sensor;

the first signal combination identifier comprises a first signal source and a second signal source, and the first signal source and the second signal source are opposite and in staggered arrangement in the first segment; and the second signal combination identifier comprises a third signal source and a fourth signal source, and the third signal source and the fourth signal source are opposite and in staggered arrangement in the second segment;

the first segment is the downhole motor, the second segment is a gauging nipple mounting pipe, and the third segment is the drill pipe;

during measurement, the second sensor of the third segment is pointed to a 0° direction, an initial angle of a toolface azimuth of the first segment is $\omega=\phi+\rho$, and an upward direction perpendicular to a horizontal plane is taken as the 0° direction of the second sensor.

2. The coal mine intelligent directional drill as claimed in claim 1, characterized in that: the angle adjuster also comprises a driving piston and an adjuster connecting seat, the driving piston is sheathed on the transmission shaft and is located on one side of the fixed toothed disk away from the moving toothed disk, and one end of the driving piston away from the driving shaft is connected with the moving toothed disk;

the adjuster connecting seat is sheathed on the driving piston, an outer circle of the adjuster connecting seat is divided by three diameters, a middle section has a largest diameter, both end surfaces of the middle section are connected with the gearbox and the rotary speed reducer, respectively, to realize relative axial positioning among the gearbox, the adjuster connecting seat and the rotary speed reducer, and an inner diameter of the adjuster connecting seat is divided by three apertures, wherein the apertures of two sections away from the gearbox are matched with an outer diameter of the driving piston, and the two sections are sheathed on the driving piston;

the driving piston is a two-stage stepped shaft, a sealing groove is formed in an outer circle of a small-diameter end of the driving piston, a sealing ring is installed in the sealing groove and is matched with a corresponding position of the adjuster connecting seat sheathed on the driving piston to form a first seal, an outer circle of a large-diameter end is matched with a sealing ring installed in a corresponding position of the adjuster connecting seat to form a second seal, a sealing cavity located between the driving piston and the adjuster connecting seat is formed between the first seal and the second seal, an oil inlet communicated with the sealing cavity is arranged on the adjuster connecting seat, and the moving toothed disk is pushed by the driving piston to move in a direction away from the fixed toothed disk under the action of hydraulic oil entering the sealing cavity through the oil inlet to enable the moving toothed disk to slide along the axial direction of the transmission shaft.

3. The coal mine intelligent directional drill as claimed in claim 2, characterized in that: the angle adjuster also comprises an angle adjuster end cover, the other end of the transmission shaft is rotationally connected in the angle adjuster end cover, the moving toothed disk is a disk-like part with a central through hole, the central through hole is a stepped through hole, one side of the stepped through hole facing the angle adjuster end cover is a large-diameter through hole, the moving toothed disk is sheathed on and slidably connected with the angle adjuster end cover through the large-diameter through hole, one end surface of the moving toothed disk facing the driving piston is provided with first skewed teeth distributed circumferentially, the fixed toothed disk is provided with second skewed teeth engaged with the first skewed teeth, and springs are arranged between an inner end surface of the large-diameter through hole and one end surface of the angle adjuster end cover opposite to the inner end surface to make the first skewed teeth and the second skewed teeth engaged under a thrust force of the springs;

an outer circular surface of the moving toothed disk is provided with lug bosses distributed uniformly, the rotary seat is sheathed on the moving toothed disk and has grooves matched with the lug bosses to be circumferentially and fixedly connected with the moving toothed disk, and one end of the rotary seat is provided with a rotary speed reducer connecting disk which is fixedly connected with the output disk of the rotary speed reducer to transfer the rotation of the output disk of the rotary speed reducer to the moving toothed disk.

4. The coal mine intelligent directional drill as claimed in claim 1, characterized in that: the power head also comprises a water swivel, an active drill pipe, a hexagonal hole connecting sleeve and a connecting shaft, the water swivel comprises a mandrel, a water inlet assembly, a bearing seat, a sealing shaft and mandrel support bearings, the water inlet assembly is sheathed on and rotationally connected with the mandrel, and the bearing seat is sheathed on and rotationally connected with the mandrel through the mandrel support bearings which are arranged in both ends of the bearing seat;

the mandrel is a hollow shaft, a left end of the mandrel is fixedly connected with the connecting shaft, an inner side of a right end of the mandrel is connected with the sealing shaft to seal the right end of the mandrel, the mandrel has a water inlet hole, the water inlet hole is communicated with the water inlet assembly, the water inlet assembly comprises a water inlet and a shell communicated with the water inlet, an inner cavity of the shell has a symmetrical structure with a plane of symmetry perpendicular to an axis of the mandrel so as to make the shell uniformly stressed in an axial direction, the water inlet assembly is sheathed on the mandrel through the shell, and the inner cavity of the shell is communicated with the water inlet hole of the mandrel;

the connecting shaft is a hollow shaft and is arranged in the main shaft, both ends of the connecting shaft are connected with the mandrel of the water swivel and the active drill pipe having an axial floating structure, respectively, a hexagonal head is arranged on one end of the connecting shaft close to the mandrel, the hexagonal hole connecting sleeve is fixedly connected with one end of the main shaft close to the water swivel and is sheathed on the connecting shaft, and a hexagonal hole matched with the hexagonal head is formed in the hexagonal hole connecting sleeve to form a sliding connection between the connecting shaft and the hexagonal hole connecting sleeve to limit rotation, thus to enable the connecting shaft and the mandrel to float axially.

5. The coal mine intelligent directional drill as claimed in claim 4, characterized in that: the power head also comprises a chuck, the chuck is connected with one end of the main shaft away from the water swivel and rotates with the main shaft, the axial floating structure of the active drill pipe comprises springs and a drill pipe end cover, the active drill pipe is in key connection with the chuck, the springs are arranged on one end surface of the active drill pipe close to the chuck to enable the active drill pipe to float axially, and the drill pipe end cover is sheathed on the active drill pipe and is fixedly connected with the chuck to limit an axial floating distance of the active drill pipe.

6. The coal mine intelligent directional drill as claimed in claim 5, characterized in that: the hydraulic system comprises a chuck pressure control system, and the chuck pressure control system comprises a pressure reducing valve, an electromagnetic directional valve, a hydraulic operated directional valve, a main pump, an auxiliary pump and a chuck;

the electromagnetic directional valve is a three-position four-way electromagnetic directional valve with a port A, a port B, a port P and a port T; and the hydraulic operated directional valve has a port P, a port T, a port A and a hydraulic operated port, and the chuck has a control port;

the main pump is connected to the port P of the hydraulic operated directional valve; an oil circuit of the auxiliary pump is divided into two branches: one branch is connected to the port P of the hydraulic operated directional valve, and the other branch is connected to the port P of the electromagnetic directional valve through the pressure reducing valve; and a drainage port of the pressure reducing valve is connected with the port T of the electromagnetic directional valve and drains oil;

oil out of the port A of the electromagnetic directional valve is divided into two streams: one stream is connected with the port P of the hydraulic operated directional valve, and the other stream is connected with the hydraulic operated port of the hydraulic operated directional valve;

the port B of the electromagnetic directional valve is connected with the port T of the hydraulic operated directional valve; and the port A of the hydraulic operated directional valve is connected with the control port of the chuck.

7. The coal mine intelligent directional drill as claimed in claim 6, characterized in that: an oil circuit of the main pump enters the port P of the hydraulic operated directional valve via a first check valve, the oil circuit of the auxiliary pump is connected to the port P of the hydraulic operated directional valve via a second check valve, and the port A of the electromagnetic directional valve is connected to the port P of the hydraulic operated directional valve via a third check valve;

the electromagnetic directional valve has a position Y1 and a position Y2.

8. The coal mine intelligent directional drill as claimed in claim 7, characterized in that: in a working condition I, the position Y1 and the position Y2 are de-energized, and pressure oil from the main pump reaches and stops at the port P of the hydraulic operated directional valve; and pressure oil from the auxiliary pump reaches and stops at the port P of the electromagnetic directional valve via the pressure reducing valve;

in a working condition II, the position Y2 is energized, and pressure oil from the main pump reaches and stops at the port P of the hydraulic operated directional valve; and one stream of pressure oil from the auxiliary pump reaches and stops at the port P of the hydraulic operated directional valve, and the other stream flows through the electromagnetic directional valve via the pressure reducing valve and reaches the control port of the chuck via the hydraulic operated directional valve;

in a working condition III, the position Y1 is energized, pressure oil from the main pump flows into the control port of the chuck via the hydraulic operated directional valve, one stream of pressure oil from the auxiliary pump reaches the control port of the hydraulic operated directional valve via the electromagnetic directional valve to switch a working state of the hydraulic operated directional valve, the other stream flows into the control port of the chuck via the hydraulic operated directional valve, and hydraulic oil from the main pump and hydraulic oil from the auxiliary pump converge.

9. The coal mine intelligent directional drill as claimed in claim 8, characterized in that: the drill pipe storage system comprises a plurality of drill pipe boxes arranged in a matrix form, and drill pipes in all of the drill pipe boxes have a same orientation; and each drill pipe box comprises a base, a side wall is arranged above the base, partition boards are arranged on the side wall, and a distance between two adjacent partition boards is matched with a diameter of the drill pipes.

10. The coal mine intelligent directional drill as claimed in claim 9, characterized in that: one side of each drill pipe box is provided with a slide rail in a same direction as the drill pipes therein, a grasping manipulator is slidably arranged on the slide rail, and the grasping manipulator is driven by a translation assembly to slide on the slide rail;

the translation assembly comprises at least two stages of traveling cylinders, a first stage of traveling cylinder is fixed on the drill pipe storage system arranged in a matrix form, a piston rod of the first stage of traveling cylinder is provided with a buckle plate, the buckle plate is driven by the first stage of traveling cylinder to slide in the slide rail, and a next stage of traveling cylinder is fixed on the buckle plate; and a last stage of traveling cylinder is fixed on the buckle plate of the former stage of traveling cylinder, a piston rod of the last stage of traveling cylinder is fixedly connected with the grasping manipulator, and both sides of the buckle plate are provided with slide blocks used for matching with the slide rail.

11. The coal mine intelligent directional drill as claimed in claim 10, characterized in that: the grasping manipulator comprises:

a first telescopic barrel, which is provided with a crossbeam assembly on one end, drives the crossbeam assembly to move along a direction close to or away from the first telescopic barrel, is slidably connected with the guide rail and is fixedly connected with the translation assembly;

a second telescopic barrel, which is arranged on one end of the crossbeam assembly away from the first telescopic barrel and moves on the crossbeam assembly along the direction close to or away from the first telescopic barrel;

a mechanical claw, which is arranged on one end of the second telescopic barrel away from the crossbeam assembly and is used for grasping the drill pipes.

12. The coal mine intelligent directional drill as claimed in claim 11, characterized in that: pipe placing troughs are fixedly arranged on the drill pipe box and are used for fixing and temporarily storing drill pipes grasped by the grasping manipulator, each pipe placing trough comprises a drill pipe trough seat fixedly arranged on one side of the drill pipe box close to the machine frame, a drill pipe trough is arranged on the drill pipe trough seat, a second clamping cylinder is arranged on the drill pipe trough seat, a piston rod of the second clamping cylinder is connected with a slide plate, a drill pipe baffle is fixedly arranged on the slide plate, and the slide plate is driven by the second clamping cylinder to make the drill pipe baffle move in a direction toward or away from the drill pipe trough; and two pipe placing troughs are provided and correspondingly arranged on both ends of the drill pipe box close to one side of the machine frame, respectively so that a space used for temporarily storing the drill pipe is formed between the drill pipe baffle and the drill pipe trough.

13. The coal mine intelligent directional drill as claimed in claim 12, characterized in that: the main manipulator is arranged on the moving platform, located between the drill pipe box and the machine frame arranged on the moving platform, and used for conveying the drill pipe temporarily stored in the pipe placing troughs to the machine frame; the machine frame comprises a machine frame connecting seat fixedly connected with the moving platform of the drill and a machine frame body hinged on the machine frame connecting seat, the main manipulator comprises a pitching cylinder, a rotary driver, a pitching arm, a rotary shaft, a rotary arm and a manipulator claw, the pitching cylinder is a double-head combined cylinder, a piston rod II on one end of the pitching cylinder is hinged with the moving platform of the drill through a first cylinder seat fixedly connected with the moving platform of the drill, a piston rod I on the other end of the pitching cylinder is hinged with the pitching arm, a vertical plane where an axis of the pitching cylinder is located is parallel to a vertical plane where an axis of the machine frame is located, and when the piston rod I is fully retracted and the piston rod II is fully extended, the manipulator is in a horizontal position;

the pitching arm comprises a connecting sleeve, a supporting body, a shaft seat and a rotary barrel, one end of the rotary barrel is fixedly connected with the connecting seat in the machine frame, the connecting sleeve is sheathed on and rotationally connected with the rotary barrel, one end of the supporting body is fixedly connected with the connecting sleeve, the other end of the supporting body is connected with the shaft seat, the pitching cylinder is hinged with the supporting body, one end of the shaft seat is connected with the rotary driver, the rotary shaft is installed in an inner cavity thereof, one end of the rotary shaft is circumferentially and fixedly connected with an output shaft of the rotary driver, the other end of the rotary shaft is connected with the rotary arm, and the rotary arm is connected with the manipulator claw;

the manipulator claw comprises a moving claw body, clamping jaws, a first clamping cylinder, a fixing seat and a moving cylinder, the fixing seat is a concave cavity, the moving cylinder is hinged in the concave cavity, a moving pair is formed by the moving claw body and a back surface of the concave cavity, the rotary arm is connected with the manipulator claw through a side surface of the concave cavity, a top part of the moving claw body is a fixed jaw and is hinged and matched with the clamping jaws to realize drill pipe clamping and fixation, and a bottom part of the moving claw body is hinged with a piston rod of the moving cylinder to drive the moving claw body to move; the moving claw body is provided with an internal cavity, the first clamping cylinder is hinged in the internal cavity, and a back surface of one clamping jaw is hinged with a piston rod of the first clamping cylinder to drive the clamping jaws to clamp the drill pipe; when the piston rod of the moving cylinder is fully retracted to make the moving claw body move to a highest point, a distance between a rotating center line of the rotary arm and a clamping center line of the moving claw body is equal to a distance between the rotating center line of the rotary arm and a drilling center line of the machine frame; and when the piston rod of the moving cylinder is fully extended to make the moving claw body move to a lowest point, the clamping center line of the moving claw body coincides with a placement center line of the drill pipe temporarily stored in the pipe placing troughs.

14. The coal mine intelligent directional drill as claimed in claim 13, characterized in that: the drill also comprises a manipulator positioning system, the manipulator positioning system comprises an isogonism sensor, an increment sensor, an angle marking plate and a pressing rod, the pressing rod is connected with one side of the fixing seat opposite to the rotary arm, the isogonism sensor comprises a proximity sensor, a pressing plate, a pressing plate seat, an elastic part, a supporting seat, a slide rod, a slide seat, a mounting frame, a slide cylinder and a slide cylinder seat, a bottom part of the mounting frame is fixedly connected with the machine frame body in the machine frame, a top part of the mounting frame is connected with and used for supporting the slide seat, the slide rod is matched and connected with the slide seat to form a moving pair, the slide cylinder is hinged with the mounting frame and the slide cylinder seat fixedly connected with the slide rod, respectively, a bottom part of the supporting seat is fixedly connected with the slide rod, one end of the supporting seat close to the manipulator claw is provided with the proximity sensor, one end of the pressing plate seat is hinged with the supporting seat, one side of the pressing plate seat close to the proximity sensor is provided with a side plate extending downward to make the side plate paired with the proximity sensor to form a signal sensing group, the elastic part is arranged between the pressing plate seat and the supporting seat, the pressing plate seat is lifted in a natural state to avoid engagement of the side plate of the pressing plate seat with the proximity sensor, the pressing plate is a bent plate, a top end of the pressing plate is used for contacting the pressing rod, and a bottom end of the pressing plate is fixedly connected with the pressing plate seat;

the angle marking plate is a circular ring with a local fan-shaped bulge, the circular ring is provided with a plate body and a bulged fan-shaped block, an inner hole of the circular ring is movably sheathed on one side of the rotary barrel facing the machine frame, the fan-shaped block has a shifting notch, one side of the machine frame body in the machine frame facing the manipulator is fixedly connected with a shifting rod, the shifting rod is inserted into the shifting notch so that when an inclination angle of the machine frame body is changed, the angle marking plate is changed by a same angle as the machine frame body, the increment sensor is arranged on one side of the connecting sleeve close to the angle marking plate and is located on one side of the connecting sleeve close to the isogonism sensor, and the increment sensor is paired with the fan-shaped block to form a signal sensing group;

when the drilling center lines of the manipulator and the machine frame are both in a horizontal position, the increment sensor is in a horizontal position, an edge line of one end of the fan-shaped block close to the increment sensor is located above a horizontal line, the increment sensor is not engaged, and the pressing plate can be pressed down due to a vertical height of the pressing rod to make the proximity sensor engaged.

15. A drilling method for a coal mine intelligent directional drill, characterized in that: the coal mine intelligent directional drill as claimed in claim 14 is provided, the control system controls driving conditions of the main motor, the rotary speed reducer and the downhole motor and an engagement state of the fixed toothed disk and the moving toothed disk so that the coal mine intelligent directional drill has four working conditions of sliding directional drilling, rotary drilling, combined drilling and drill pipe fishing, and the sliding directional drilling comprises the following steps:

dz0) initial state: the value of the toolface azimuth is reset to zero by the toolface azimuth detection and initialization system, the chuck is controlled by the chuck pressure control system to be in a released state, the front half of the clamper clamps the existing drill pipes in a drill hole, the back half of the clamper is released, and the fixed toothed disk and the moving toothed disk are engaged through skewed teeth by sliding the moving toothed disk axially to make the angle adjuster in a locked condition; the piston rod II of the pitching cylinder is fully extended and the piston rod I is fully retracted to make the main manipulator in a horizontal position; and the piston rod of the moving cylinder is fully extended to make a drill pipe clamping center line of the manipulator claw coincide with a drill pipe placement center line of the pipe placing troughs, and the slide cylinder of the isogonism sensor is fully retracted;

dz01) first stage of drill pipe conveying dz01-1) box selection: the grasping manipulator is driven by the translation assembly to move along a length direction of the drill pipe box to grasp drill pipes from any one of the drill pipe boxes;

dz01-2) column selection: the mechanical claw moves along the crossbeam assembly to switch among columns of drill pipes;

dz01-3) layer selection: a height of the mechanical claw is adjusted by the first telescopic barrel and the second telescopic barrel according to a drill pipe storage condition, thus to make the mechanical claw reach a height suitable for grasping a drill pipe selected by the system;

dz01-4) grasping: the drill pipe selected to be grasped is clamped by the mechanical claw;

dz01-5) lifting: the first telescopic barrel is fully extended, and the second telescopic barrel is fully retracted to make the mechanical claw in a highest position;

dz01-6) aligning: the grasping manipulator is driven by the translation assembly to move along the slide rail to a position aligned with the middle position of a connecting line of the two pipe placing troughs;

dz01-7) pipe conveying: the mechanical claw moves along the crossbeam assembly to a position above the pipe placing troughs, and the first telescopic barrel and the second telescopic barrel are moved in combination to adjust the height of the mechanical claw so as to place the drill pipes in the pipe placing troughs;

dz02) second stage of drill pipe conveying dz02-1) drill pipe clamping: the first clamping cylinder is extended, and the drill pipe in the pipe placing trough is clamped by the clamping jaws;

dz02-2) manipulator claw extension: the piston rod of the moving cylinder is retracted to drive the moving claw body to move upward and reach the highest position;

dz02-31) pitch up: when a drilling inclination angle of the machine frame body is a pitch up inclination angle, or the drilling inclination angle of the machine frame body is a pitch down inclination angle, the angle marking plate is driven to rotate by the shifting rod connected to the machine frame body, and the increment sensor is made not enter a coverage range of the angle marking plate, the piston rod II of the pitching cylinder is retracted, and an inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

or dz02-32) pitch up: when a drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

dz02-41) pitch down: when the previous step is dz02-31), the piston rod II of the pitching cylinder is extended, and the inclination angle of the main manipulator is decreased; when the piston rod II is fully extended, if the side plate in the pressing plate seat does not enter a sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

or dz02-42) pitch down: when the previous step is dz02-32), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down;

dz02-5) turnover: the manipulator claw is driven by the rotary driver to turn towards the machine frame body, and the drill pipe is conveyed to a position between the power head and the rear half of the clamper on the machine frame body;

dz02-6) manipulator claw release: the drill pipe is clamped by the rear half of the clamper, the clamping jaws are released, and drill pipe conveying is completed;

dz02-7) turnover recovery: the manipulator claw is driven by the rotary driver to turn away from the machine frame, and the slide cylinder of the isogonism sensor is retracted to make the pressing plate retracted;

dz02-8) inclination angle zeroing: the piston rod II of the pitching cylinder is fully extended, and the piston rod I remains fully retracted to make the inclination angle of the main manipulator return to the horizontal position;

dz02-9) manipulator claw retraction: the piston rod of the moving cylinder is fully extended to make the moving claw body and the clamping jaws return to the lowest position, and make the main manipulator restored to the initial state;

dz03) drilling dz03-1) angle adjuster unlocking: the fixed toothed disk is separated from the moving toothed disk by siding the moving toothed disk axially to make the angle adjuster in an unlocked condition;

dz03-2) rear end connection: the chuck is controlled by the chuck pressure control system to be in a low-pressure clamping state, the main motor of the power head rotates forward to drive the active drill pipe to rotate, the power head is driven by the thrust cylinder in the machine frame to move forward, and the active drill pipe is connected with the rear end of the drill pipe conveyed in step dz02;

dz03-3) front end connection: the rear half of the clamper is released, the front half of the clamper clamps the last drill pipe in the drill hole, the active drill pipe and the drill pipe with the rear end connection completed in the previous step are driven by the main motor and the thrust cylinder to continue rotating and moving forward, connection between a front end joint of the drill pipe and an ending drill pipe in the hole is completed, and then the front half of the clamper is released;

dz03-4) angle adjuster locking: the fixed toothed disk and the moving toothed disk are engaged through skewed teeth by sliding the moving toothed disk axially to make the angle adjuster in the locked condition;

dz03-5) toolface azimuth adjustment: on the basis of resetting the value of the toolface azimuth to zero by the toolface azimuth detection and initialization system, a specified toolface azimuth is selected, the transmission shaft is driven by the rotary speed reducer to rotate at a low speed, and rotation motion is transferred to the gearbox through the driving shaft, then transferred to the drill pipes through the main shaft of the power head, and finally transferred to the downhole motor in the hole through the drill pipes, thus to achieve accurate toolface azimuth adjustment;

dz03-6) automatic drilling: the rotary speed reducer stops driving, and an external medium pump is used to inject a drilling medium into the downhole motor through the water swivel, thus to drive the downhole motor to make the drill bit rotate; the power head, all the drill pipes connected with the active drill pipe and the downhole motor are driven by the thrust cylinder to move forward, thus to realize sliding directional drilling;

dz03-7) power head resetting: after the present drill pipe is fully drilled into the hole, the present drill pipe is clamped by the front half of the clamper, the rear half is kept released, the fixed toothed disk is separated from the moving toothed disk by siding the moving toothed disk axially to make the angle adjuster in the unlocked condition, the main motor rotates backward to drive the active drill pipe to rotate backward and be disconnected from the threaded joint at the rear end of the drill pipe, the power head is driven by the thrust cylinder to return to the rearmost end of the machine frame, the chuck is controlled by the chuck pressure control system to be in the released state, and drilling is continued according to steps dz01)-dz03) until set track and depth are achieved.

16. The drilling method for a coal mine intelligent directional drill as claimed in claim 15, characterized in that: the sliding directional drilling also comprises a drill pipe withdrawal process, specifically comprising the following steps:

tz0) initial state the drill has completed current drilling construction, the power head is located at a foremost end of the machine frame, the active drill pipe is connected with the ending drill pipe, the angle adjuster is in the locked condition, the chuck is controlled by the chuck pressure control system to be in the released state, the front half and the rear half of the clamper are released, the first telescopic barrel is fully extended, the second telescopic barrel is fully retracted to make the mechanical claw in the highest position, the mechanical claw is released, no drill pipe is placed in the pipe placing troughs, the piston rod II of a main pitching cylinder is fully extended, the piston rod I is fully retracted to make the main manipulator in the horizontal position, the piston rod of the moving cylinder is fully extended to make the drill pipe clamping center line of the manipulator claw coincide with the drill pipe placement center line of the pipe placing troughs, and the slide cylinder of the isogonism sensor is fully retracted;

tz01) drill pipe withdrawal tz01-1) sliding drill pipe withdrawal: the chuck is controlled by a chuck multistage pressure control system to be in the low-pressure clamping state, the power head, all the drill pipes connected with the active drill pipe and the downhole motor are driven by the thrust cylinder to withdraw until the ending drill pipe is completely out of the hole;

tz01-2) angle adjuster unlocking: the fixed toothed disk is separated from the moving toothed disk by siding the moving toothed disk axially to make the angle adjuster in the unlocked condition;

tz01-3) front end disconnection: the ending drill pipe is clamped by the rear half of the clamper, a drill pipe before the ending drill pipe is clamped by the front half of the clamper, the front half and the rear half rotate relative to each other, threaded connection between the two drill pipes are pre-loosened, the rear half is released, the main motor rotates backward to drive the active drill pipe to rotate backward, at the same time, the power head is driven by the thrust cylinder to withdraw, and the ending drill pipe is disconnected from the drill pipe before the ending drill pipe;

tz01-4) rear end disconnection: the ending drill pipe is clamped by the rear half of the clamper, the active drill pipe is driven by the main motor to continue rotating backward and is driven by the thrust cylinder to withdraw, and the ending drill pipe is disconnected from the active drill pipe;

tz02) second stage of pipe conveying for drill pipe withdrawal tz02-1) manipulator claw extension: the piston rod of the moving cylinder is retracted to drive the moving claw body to move upward and reach the highest position;

tz02-21) pitch up: when the drilling inclination angle of the machine frame body is a pitch up inclination angle, or the drilling inclination angle of the machine frame body is a pitch down inclination angle, the angle marking plate is driven to rotate by the shifting rod connected to the machine frame body, and the increment sensor is made not enter the coverage range of the angle marking plate, the piston rod II of the pitching cylinder is retracted, and the inclination angle of the main manipulator is increased; when the increment sensor enters the coverage range of the angle marking plate, the increment sensor is switched on and sends a signal, indicating that the main manipulator is at an inclination angle suitable for conveying the drill pipe, and the main manipulator stops pitching up; at the same time, the slide cylinder of the isogonism sensor is extended to make the pressing plate located in a horizontal position where the pressing plate can be in contact with and pressed down by the pressing rod;

or tz02-22) pitch up: when the drilling inclination angle of the machine frame body is a pitch down inclination angle, the angle marking plate is driven to rotate by the shifting rod connected to the machine frame body, and the increment sensor is made directly enter the coverage range of the angle marking plate, the increment sensor is switched on and sends a signal, indicating that the manipulator is at an inclination angle suitable for conveying the drill pipe, without the need to retract the piston rod II of the pitching cylinder; at the same time, the slide cylinder is extended to make the pressing plate located in a position where the pressing plate can be in contact with and pressed down by the pressing rod;

tz02-31) pitch down: when the previous step is tz02-21), the piston rod II of the pitching cylinder is extended, and the inclination angle of the main manipulator is decreased; when the piston rod II is fully extended, if the side plate in the pressing plate seat does not enter the sensing range of the proximity sensor, the piston rod I is further extended until when the side plate of the pressing plate seat of the isogonism sensor is driven by the pressing rod to enter the sensing range of the proximity sensor, the isogonism sensor is switched on and sends a signal, the main manipulator stops pitching down, the increment sensor is out of the coverage range of the angle marking plate, and the signal of the increment sensor is switched off;

or tz02-32) pitch down: when the previous step is tz02-22), the piston rod I of the pitching cylinder is extended, the rotary shaft and the rotary arm are driven by the pitching arm to pitch down, and the inclination angle of the manipulator is decreased; when the pressing plate is pressed down by the pressing rod to make the side plate in the pressing plate seat enter the sensing range of the proximity sensor, and the proximity sensor is switched on and sends a signal, the main manipulator stops pitching down;

tz02-4) turnover: the manipulator claw is driven by the rotary driver to turn towards the machine frame body, and the manipulator claw not clamping drill pipes turns over to enter a space between the power head of the machine frame body and the rear half of the clamper and makes contact with the ending drill pipe;

tz02-5) drill pipe clamping: the first clamping cylinder is extended, and the ending drill pipe is clamped by the clamping jaws; and at the same time, the rear half of the clamper is released;

tz02-6) turnover recovery: the manipulator claw is driven by the rotary driver to turn away from the machine frame, and the slide cylinder of the isogonism sensor is retracted to make the pressing plate retracted;

tz02-7) inclination angle zeroing: the piston rod II of the pitching cylinder is fully extended, and the piston rod I remains fully retracted to make the inclination angle of the main manipulator return to the horizontal position;

tz02-8) manipulator claw retraction: the piston rod of the moving cylinder is fully extended to make the moving claw body and the clamping jaws return to the lowest position, and make the ending drill pipe enter the pipe placing trough;

tz02-9) manipulator claw release: the clamping jaws are released, and the main manipulator is restored to the initial state;

tz03) first stage of pipe conveying for drill pipe withdrawal tz03-1) aligning: the grasping manipulator is driven by the translation assembly to move along the slide rail to a position aligned with the middle position of a connecting line of the two pipe placing troughs;

tz03-2) pipe taking: the mechanical claw moves along the crossbeam assembly to a position above the pipe placing troughs, the first telescopic barrel and the second telescopic barrel are moved in combination to adjust the height of the mechanical claw to make the mechanical claw come into contact with the drill pipes in the pipe placing troughs, the clamping center of the mechanical claw coincides with the center of the drill pipe, and the drill pipe is clamped by the mechanical claw;

tz03-3) lifting: the second telescopic barrel is fully retracted, and the first telescopic barrel is fully extended to lift the mechanical claw and the drill pipe to a high position;

tz03-4) box selection: the grasping manipulator is driven by the translation assembly to move along the slide rail to place the drill pipe back to any one of the drill pipe boxes;

tz03-5) column selection: the mechanical claw moves along the crossbeam assembly to switch among the columns and select columns for storing drill pipes;

tz03-6) layer selection: the height of the mechanical claw is adjusted by the first telescopic barrel and the second telescopic barrel according to a real-time drill pipe storage condition judged by the control system, thus to start drill pipe placing back from a lowest position where the drill pipe can be placed in a specified column;

tz03-7) pipe placing: the mechanical claw is released, the first telescopic barrel is fully extended, and the second telescopic barrel is fully retracted to make the mechanical claw return to the high position;

tz04) power head and clamper resetting: the power head is driven by the thrust cylinder to return to the front end of the machine frame, the main motor rotates forward to drive the active drill pipe to rotate forward and be connected with the present ending drill pipe, the front half of the clamper is released, the chuck is controlled by the chuck pressure control system to be in the released state, and drill pipe withdrawal is continued according to steps tz01)-tz04) until all the drill pipes are withdrawn from the hole.

17. The drilling method for a coal mine intelligent directional drill as claimed in claim 15, characterized in that: in the working condition of rotary drilling, the fixed toothed disk is separated from the moving toothed disk by siding the moving toothed disk axially to make the angle adjuster always in the unlocked condition, the chuck is always controlled by the chuck pressure control system to be in the low-pressure clamping state, and the drill pipes are always driven by the main motor to rotate to realize rotary drilling;

in the working condition of combined drilling, the fixed toothed disk is separated from the moving toothed disk by siding the moving toothed disk axially to make the angle adjuster always in the unlocked condition, the chuck is always controlled by the chuck pressure control system to be in the low-pressure clamping state, the drill pipes are always driven by the main motor to rotate, and the external medium pump is used to inject a drilling medium into the downhole motor through the water swivel, thus to drive the downhole motor to make the drill bit rotate to realize combined drilling;

in the working condition of drill pipe fishing, the active drill pipe, the connecting shaft and the water swivel need to be removed, the drill pipes are connected directly through the chuck, the fixed toothed disk is separated from the moving toothed disk by siding the moving toothed disk axially to make the angle adjuster always in the unlocked condition, the chuck is always controlled by the chuck pressure control system to be in a high-pressure clamping state when clamping the drill pipe, and the drill pipes are driven by the main motor to rotate to realize drill pipe fishing.

18. The drilling method for a coal mine intelligent directional drill as claimed in claim 15, characterized in that: a method for resetting the value of the toolface azimuth to zero by the toolface azimuth detection and initialization system, with a known initial angle $\omega$ of the toolface azimuth, comprising the following steps:

S1: calculating an adjustment value $\delta$ and making adjustments:

when $\omega \in (0°, 90°] \cup (270°, 360°$, an initialization zero point is 0°;

at this time, the adjustment value $\delta$ and an adjustment direction are:

when $\omega \in (0°, 90°]$, $\delta=\omega$, making anti-clockwise adjustments;

when $\omega \in)$ $(270°, 360°$, $\delta=360°-\omega$, making clockwise adjustments;

when $\omega \in (90°, 270°]$, the initialization zero point is 180°;

at this time, the adjustment value $\delta$ and the adjustment direction are:

when $\omega \in (90°, 180°]$, $\delta=180°-\omega$, making clockwise adjustments;

when $\omega \in (180°, 270°]$, $\delta=\omega-180°$, making anti-clockwise adjustments.

19. The drilling method for a coal mine intelligent directional drill as claimed in claim 18, characterized in that: before step S1, the method further comprises step S0: simplifying the initial angle $\omega$ of the toolface azimuth, when $\omega>360°$, taking $\omega'=\omega-360°$, and when $\omega<360°$, taking $\omega'=\omega$ first; and in step S1, using $\omega'$ instead of $\omega$.

* * * * *